US007669993B2

(12) United States Patent
Hashii et al.

(10) Patent No.: US 7,669,993 B2
(45) **Date of Patent: *Mar. 2, 2010**

(54) INK CARTRIDGE AND RECORDING APPARATUS

(75) Inventors: Kazuhiro Hashii, Nagano-ken (JP); Satoshi Shinada, Nagano-ken (JP); Yasuto Sakai, Nagano-ken (JP); Kazumasa Harada, Nagano-ken (JP); Kazuaki Aoki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 246 days.

This patent is subject to a terminal disclaimer.

(21) Appl. No.: 11/619,525

(22) Filed: Jan. 3, 2007

(65) Prior Publication Data

US 2007/0103522 A1 May 10, 2007

Related U.S. Application Data

(63) Continuation of application No. 11/122,552, filed on May 5, 2005, now Pat. No. 7,237,883, which is a continuation of application No. 10/649,806, filed on Aug. 26, 2003, now Pat. No. 6,979,079.

(30) Foreign Application Priority Data

| | | |
|---|---|---|
| Nov. 26, 2002 | (JP) | P2002-341826 |
| Mar. 20, 2003 | (JP) | P2003-076890 |
| Mar. 20, 2003 | (JP) | P2003-076891 |
| May 6, 2003 | (JP) | P2003-128049 |
| Jul. 31, 2003 | (JP) | P2003-204804 |

(51) Int. Cl.
*B41J 2/175* (2006.01)

(52) U.S. Cl. ..... 347/86; 347/85

(58) Field of Classification Search ..... 347/20, 347/50, 56, 61–65, 67, 84–87; 400/124.1
See application file for complete search history.

(56) References Cited

U.S. PATENT DOCUMENTS 4,162,501 A 7/1979 Mitchell et al.

(Continued)

FOREIGN PATENT DOCUMENTS

CN 1380188 A 11/2002

(Continued)

OTHER PUBLICATIONS

Notice of Investigation of the U.S. International Trade Commission in the Matter of Certain Ink Cartridges and Components Thereof, Inv. No. 337-TA-565 (Mar. 17, 2006) (unsigned).

(Continued)

*Primary Examiner*—Juanita D Stephens
(74) *Attorney, Agent, or Firm*—Stroock & Stroock & Lavan LLP

(57) ABSTRACT

The ink cartridge includes an ink supply port formed at a position, offset to one side, of a wall configuring an ink container body; a positioning projecting portion, formed on one wall out of two opposing walls adjacent the wall, whose upper surface and side portion are regulated in position when the cartridge has been mounted on a recording apparatus; a lever, formed on the other wall out of the two walls, maintaining a normal hinged-open state and having a projection that is forcibly displaced outward when the cartridge is mounted on the recording apparatus; and electrodes that are connected to a memory unit storing information on the ink in an ink container and formed on the positioning projecting portion.

64 Claims, 30 Drawing Sheets

U.S. PATENT DOCUMENTS

| | | | |
|---|---|---|---|
| 4,306,245 | A | 12/1981 | Kasugayama et al. |
| 4,368,478 | A | 1/1983 | Koto |
| 4,436,439 | A | 3/1984 | Koto |
| 4,447,820 | A | 5/1984 | Terasawa |
| 4,712,172 | A | 12/1987 | Kiyohara et al. |
| 4,771,295 | A | 9/1988 | Baker et al. |
| 4,907,018 | A | 3/1990 | Pinkerpell et al. |
| 4,929,109 | A | 5/1990 | Ikenaga |
| 4,961,088 | A | 10/1990 | Gilliland |
| 4,969,759 | A | 11/1990 | Suzuki et al. |
| 4,990,938 | A | 2/1991 | Brandon et al. |
| 5,049,898 | A | 9/1991 | Arthur |
| 5,138,344 | A | 8/1992 | Ujita |
| 5,155,502 | A | 10/1992 | Kimura et al. |
| 5,208,610 | A | 5/1993 | Su et al. |
| 5,280,300 | A | 1/1994 | Fong et al. |
| 5,300,959 | A | 4/1994 | McClelland et al. |
| 5,317,339 | A | 5/1994 | Braun et al. |
| 5,359,357 | A | 10/1994 | Takagi et al. |
| 5,365,312 | A | 11/1994 | Hillmann et al. |
| 5,408,746 | A | 4/1995 | Thoman et al. |
| 5,410,641 | A | 4/1995 | Wakabayashi et al. |
| 5,411,343 | A | 5/1995 | Childers |
| 5,414,452 | A | 5/1995 | Accatino |
| 5,461,482 | A | 10/1995 | Wilson et al. |
| 5,467,118 | A | 11/1995 | Gragg et al. |
| 5,506,611 | A | 4/1996 | Ujita |
| 5,541,631 | A | 7/1996 | Hashimoto |
| 5,550,570 | A | 8/1996 | Kurata et al. |
| 5,610,635 | A | 3/1997 | Murray |
| D378,760 | S | 4/1997 | Shinada et al. |
| 5,619,237 | A | 4/1997 | Inoue et al. |
| 5,623,293 | A | 4/1997 | Aoki |
| 5,633,666 | A | 5/1997 | Haigo |
| D381,039 | S | 7/1997 | Shinada et al. |
| 5,646,660 | A | 7/1997 | Murray |
| 5,646,665 | A | 7/1997 | Swanson et al. |
| D382,296 | S | 8/1997 | Shinada et al. |
| 5,659,345 | A | 8/1997 | Altendorf |
| 5,666,146 | A | 9/1997 | Mochizuki et al. |
| 5,699,091 | A | 12/1997 | Bullock |
| 5,706,040 | A | 1/1998 | Reid et al. |
| 5,710,585 | A | 1/1998 | Sabonis et al. |
| D390,598 | S | 2/1998 | Miyazawa et al. |
| 5,748,210 | A | 5/1998 | Watanabe et al. |
| 5,788,388 | A | 8/1998 | Cowger |
| 5,812,156 | A | 9/1998 | Bullock |
| RE36,279 | E | 8/1999 | Ujita |
| 5,949,447 | A | 9/1999 | Arai et al. |
| 5,949,459 | A | 9/1999 | Gasvoda et al. |
| 5,956,057 | A | 9/1999 | Childers et al. |
| 5,992,975 | A | 11/1999 | Gasvoda et al. |
| 6,050,669 | A | 4/2000 | Yano et al. |
| 6,074,042 | A | 6/2000 | Gasvoda et al. |
| 6,102,508 | A | 8/2000 | Cowger |
| 6,102,517 | A | 8/2000 | Kobayashi |
| 6,137,503 | A | 10/2000 | Hashimoto et al. |
| 6,155,678 | A | 12/2000 | Komplin et al. |
| 6,168,262 | B1 | 1/2001 | Clark et al. |
| 6,179,415 | B1 | 1/2001 | Okazaki et al. |
| 6,183,077 | B1 | 2/2001 | Hmelar et al. |
| 6,196,670 | B1 | 3/2001 | Saruta |
| D440,600 | S | 4/2001 | Seino et al. |
| 6,217,146 | B1 | 4/2001 | Takahashi et al. |
| 6,224,192 | B1 | 5/2001 | Robinson et al. |
| 6,227,643 | B1 | 5/2001 | Purcell |
| 6,231,173 | B1 | 5/2001 | Pawlowski et al. |
| 6,276,780 | B1 | 8/2001 | Carrese et al. |
| 6,293,662 | B1 | 9/2001 | Shihoh et al. |
| 6,302,535 | B1 | 10/2001 | Sturgeon et al. |
| 6,328,414 | B1 | 12/2001 | Yoshino |
| 6,332,481 | B1 | 12/2001 | Shinada et al. |
| 6,338,104 | B1 | 1/2002 | Iwasaki |
| 6,361,136 | B1 | 3/2002 | Watanabe et al. |
| 6,361,138 | B1 | 3/2002 | Seino |
| 6,371,586 | B1 | 4/2002 | Saruta |
| 6,375,315 | B1 | 4/2002 | Steinmetz et al. |
| 6,431,699 | B2 | 8/2002 | Shihoh et al. |
| 6,435,649 | B2 | 8/2002 | Takahashi et al. |
| 6,460,984 | B1 | 10/2002 | Matsumoto et al. |
| 6,476,926 | B1 | 11/2002 | Yano et al. |
| 6,481,829 | B1 | 11/2002 | Bailey et al. |
| 6,488,369 | B1 | 12/2002 | Steinmetz et al. |
| 6,502,917 | B1 | 1/2003 | Shinada |
| 6,505,926 | B1 | 1/2003 | Trafton et al. |
| 6,554,412 | B1 | 4/2003 | Seino et al. |
| 6,588,871 | B2 | 7/2003 | Studholme |
| 6,722,762 | B2 | 4/2004 | Miyazawa et al. |
| 6,755,515 | B2 | 6/2004 | Usui et al. |
| 6,827,417 | B2 | 12/2004 | Seino |
| 6,945,641 | B2 | 9/2005 | Sakai et al. |
| 6,955,422 | B2 | 10/2005 | Miyazawa |
| 7,008,053 | B2 | 3/2006 | Hashii et al. |
| 7,014,304 | B2 | 3/2006 | Sasaki |
| 7,019,857 | B2 | 3/2006 | Abe |
| 7,020,414 | B2 | 3/2006 | Ito et al. |
| 7,244,018 | B2 * | 7/2007 | Hashii et al. ..... 347/86 |
| 2002/0085075 | A1 | 7/2002 | Shinada et al. |
| 2002/0158948 | A1 | 10/2002 | Miyazawa et al. |

FOREIGN PATENT DOCUMENTS

| | | | |
|---|---|---|---|
| DE | 32 27 589 | | 1/1984 |
| DE | 9116990.9 | U | 1/1995 |
| EP | 0 412 459 | | 2/1991 |
| EP | 0 440 261 | | 8/1991 |
| EP | 0 622 208 | A2 | 11/1994 |
| EP | 0 623 471 | A2 | 11/1994 |
| EP | 0 655 336 | | 5/1995 |
| EP | 0 710 568 | | 5/1996 |
| EP | 0 812 693 | | 12/1997 |
| EP | 0 822 084 | A2 | 2/1998 |
| EP | 0 839 660 | | 5/1998 |
| EP | 0 879 703 | | 11/1998 |
| EP | 0 940 260 | | 9/1999 |
| EP | 0 956 958 | A2 | 11/1999 |
| EP | 0 963 847 | | 12/1999 |
| EP | 0 997 297 | A1 | 5/2000 |
| EP | 1 114 726 | A1 | 7/2001 |
| EP | 1 122 076 | A1 | 8/2001 |
| EP | 1 122 077 | A2 | 8/2001 |
| EP | 1 219 438 | A2 | 7/2002 |
| EP | 1 247 651 | A2 | 10/2002 |
| EP | 1 297 962 | A1 | 4/2003 |
| GB | 2 303 824 | A | 3/1997 |
| GB | 2 326 378 | | 12/1998 |
| JP | 4-049051 | A | 2/1992 |
| JP | 05-193127 | | 8/1993 |
| JP | 09-011500 | | 1/1997 |
| JP | 09-193410 | | 7/1997 |
| JP | 9-240013 | A | 9/1997 |
| JP | 09-314861 | | 12/1997 |
| JP | 10-034965 | | 2/1998 |
| JP | 10-100432 | A | 4/1998 |
| JP | 10-157120 | A | 6/1998 |
| JP | 11-309870 | A | 11/1999 |
| JP | 2000-141688 | A | 5/2000 |
| JP | 2000-218813 | A | 8/2000 |
| JP | 2001-187457 | A | 7/2001 |
| JP | 2001-199082 | A | 7/2001 |
| JP | 2001-293875 | A | 10/2001 |
| JP | 2002-079690 | A | 3/2002 |
| JP | 2002-172763 | A | 6/2002 |
| JP | 2002-234178 | A | 8/2002 |

| | | | |
|---|---|---|---|
| WO | 96/40524 | | 12/1996 |
| WO | 01/54910 | A2 | 8/2001 |
| WO | 03/103973 | A | 12/2003 |

OTHER PUBLICATIONS

Respondent Ninestar Technology Co. Ltd.'s (Zhuhai) Third Supplemental Responses to Complainant's First and Second Sets of Interrogatories (Nos. 16-19 . . . and 146) (including Exhibits A-C), U.S. ITC Investigation No. 337-TA-565 (Aug. 18, 2006).
Respondent Ninestar Technology Co. Ltd.'s Third Supplemental Responses to Complainant's First and Second Set of Interrogatories (Nos. 21-24 . . . 138-145), U.S. ITC Investigation No. 337-TA-565 (Aug. 18, 2006).
Respondent Town Sky Inc.'s Third Supplemental Responses to Complainant's First and Second Set of Interrogatories (Nos. 21-24 . . . 138-145), U.S. ITC Investigation No. 337-TA-565 (Aug. 18, 2006).
Respondent Dataproducts USA LLC's Second Supplemental Objections and Responses to Complainant's First Set of Interrogatories, U.S. ITC Investigation No. 337-TA-565 (Aug. 16, 2006).
Respondent Dataproducts USA LLC's Second Supplemental Objections and Responses to Complainant's Second Set of Interrogatories, U.S. ITC Investigation No. 337-TA-565 (Aug. 16, 2006).
Office Action in Chinese Patent Appln. 200410081923.0 (Jun. 9, 2006), with English translation.
Office Action in Chinese Patent Appln. 200410081925.X (Jul. 28, 2006), with English translation.
Search Report in Japanese Patent Appln. No. 2004-183441, dated Mar. 9, 2006.
Search Report for UK Patent Appln. No. GB 0320851.9, dated Mar. 8, 2004.
Search Report for European Patent Appln. No. 03 019 652.1, dated Mar. 2, 2004.
Search Report for European Patent Appln. No. 03 019 652.1, dated Dec. 8, 2003.
German Office Action from DE 103 62 128.8-27 (Aug. 23, 2007) (w/ English translation).
Decision of Dusseldorf [LG] [Regional Court] Aug. 5, 2008, Court Docket No. 4b O 197/07 (with English translation).
Office Action issued by Korean Patent Office on Mar. 17, 2009 (with English translation).
Office Action from Chinese patent appln. No. 200710080006.4 (Sep. 19, 2008), with English translation.
Office Action issued by Japanese Patent Office on Jul. 21, 2009 (with partial English translation).
Office Action issued by Japanese Patent Office on Oct. 14, 2009 (with partial English translation).

* cited by examiner

INK CARTRIDGE AND RECORDING APPARATUS

CROSS-REFERENCE TO RELATED APPLICATION

This application is a continuation of application Ser. No. 11/122,552, filed on May 5, 2005, now U.S. Pat. No. 7,237,883, which is a continuation of application Ser. No. 10/649,806, filed on Aug. 26, 2003, now U.S. Pat. No. 6,979,079.

BACKGROUND OF THE INVENTION

The present invention relates to an ink cartridge, for supplying ink, that is removably mounted on a carriage mounting a recording head for ejecting ink droplets from nozzle openings to print data such as an image, and to an ink jet recording apparatus.

An ink cartridge that is removably mounted on a carriage in fluid communication with a recording head must have a secure liquid-tight relationship with a flow path forming member, such as an ink supply needle, that itself communicates with the recording head. At the same time, the ink cartridge is required to be easily mountable and removable for replacement. In the case of an ink cartridge carrying a memory unit storing ink information therein, the ink cartridge is provided with an electrode for contact with a recording apparatus, and is required to be housed in a cartridge holder so as to enable secure contact with a contact unit of the recording apparatus.

For example, as taught by International Patent Publication No. 01/54910, an ink supply port is formed on a wall surface defining an ink container. At the same time, a memory unit and an electrode group (a plurality of electrodes) are provided on one of plural opposing wall surfaces facing this wall surface, and two first projections are provided across this electrode group. Also, a lever biased in the hinging-open direction is provided on the other wall surface. That is, this document teaches involves an ink container having, on a container wall, an electrical storage device that contains information about ink in the container and which container is installed in a receiving station. Projections extend outward from the container wall having the electrical storage device and the projections are located on the sides of the storage device. The memory device, which is flush with the wall, lies between the two projections. Projections on the sides of the container extend outwards beyond the width of the ink container.

Also, an ink container receptacle of the recording apparatus for cooperating with the ink container is provided with two second projections for engaging the first projections at the upper surface and side portions thereof, and a recessed portion for engaging the lever.

By using such a configuration, the container can be loaded obliquely onto the ink container receptacle such that the first projections are first engaged with the second projections, and subsequently the other side is pushed in. In this process, an ink supply port abuts a flow path forming member for ink supply. Also, the lever engages the recessed portion. Accordingly, the ink container is fixed to the ink container receptacle in the state where ink can be supplied.

In the state where the ink cartridge has been fixed to the ink container receptacle, the ink container is always pressed upward by a spring provided on the ink container receptacle. Therefore, the two first projections of the ink container and the two second projections of the ink container receiver are engaged with each other in two up-and-down and right-and-left directions. Thus, the upper-and-lower and right-and-left positions of the ink container are maintained in a predetermined reference position, so that an electrode group of the ink container securely contacts a contact group of the ink container receptacle.

However, two positioning projecting portions are needed on both sides of an electrode group of the ink container. The need for these projecting portions is creates a problem in that the ink container and ink container receptacle are complicated in structure and are increased in width.

Also, there is a problem that, since the lever is flexed open away from the cartridge body by its own elastic force, a strong elastic force cannot be exerted, that is, in a case where the lever is deformed toward the container side and compactly housed in a box or the like, the outward engaging force of the lever will be reduced and the cartridge will not be held as securely as is desirable.

Further, since the ink container must be pivoted about a point when the ink container is attached to the ink container receptacle, there is also a problem in that, when the flow path forming member for engaging the ink supply port is long in length, a large bending force is applied to the flow path forming member, which can break or damage the flow path forming member and damage a packing located in the ink supply port.

U.S. Patent Application Publication No. 2002/0085075 discloses an ink container having a parallelepipedal shape in which an electrode group is disposed on a side surface. The ink container is fixed at a predetermined position of a holder by using a loading lever. According to the disclosure of this publication, since the ink cartridge is held at the predetermined position of the holder by the pressing force of the loading lever, the structure of the loading lever must be devised in order to establish reliable contact of the electrode group, resulting in a complicated structure.

U.S. Pat. No. 6,276,780 discloses an ink jet cartridge and carriage in which, during cartridge installation, a projection at a rear, lower corner of the ink cartridge is received in an opening under a retainer bar in the carriage. The cartridge is pivoted about the projection until the upper corner of the cartridge, diagonally across from the projection, fully displaces and slips under a latch. The ink cartridge does not have any intelligence in the form of an electronic memory device.

U.S. Pat. No. 6,460,984 describes an ink cartridge with a latching arm having a projection that cooperates with structure on the printer's carriage to secure the cartridge. In addition, during installation, a projection on the cartridge is received by a corresponding hole in the carriage. Again, the ink cartridge does not have any intelligence in the form of a electronic memory device.

European Patent Appln. No. 0 822 084 depicts several embodiments of an ink jet recording head, all of which have a holder member that receives ink tanks, as well as the recording device substrate, which itself includes recording elements driven through electrical contacts. The ink tanks are mounted in the holder member by a combination of a movable arm which engages an opening in the holder member and one or more projections which are received in corresponding openings in the holder member. The reference does not specifically explain how the assembled ink jet recording head is mounted on the carriage of the ink jet recording apparatus, nor is there mention of a memory device.

SUMMARY OF THE INVENTION

The invention has been made in view of and with the intent to overcome such problems, and an object of the invention is to provide an ink cartridge that enables simplification of the position regulating structure of an electrode group and reduction in size.

Also, another object of the present invention is to provide an ink cartridge that can be mounted by moving an ink supply port parallel to a flow path forming member at least at mounting time.

Further, yet another object of the invention is to provide an ink jet recording apparatus suitable for receiving the aforesaid ink cartridge.

To solve such problems, the present invention encompasses an ink cartridge that, when used, is mounted on a recording apparatus having a pressing member and a receiving part, and this ink cartridge has an ink container with having an upper wall, a bottom wall, a first side wall intersecting the bottom wall and a second side wall intersecting the bottom wall and facing the first side wall; an ink supply port disposed on the bottom wall at an offset position closer to the first side wall than to the second side wall; a first projecting portion disposed on the second side wall and located closer to the bottom wall than to the upper wall, the first projecting portion having a plurality of side portions for being restricted in position when the ink cartridge is mounted on the recording apparatus; a pressed portion disposed on the second side wall, the pressed portion having an upper surface for being pressed by the pressing member of the recording apparatus; a retaining member engageable with the receiving part of the recording apparatus; and a plurality of electrodes disposed on the first projecting portion, and electrically connected to a memory unit disposed on the ink container.

According thereto, the position of the second side wall where the electrodes are disposed is restricted by the side portions of the projecting portion in a lateral direction and by the pressed portion in a vertical direction. Therefore, the electrodes can be accurately positioned at their predetermined positions.

In this invention, the pressed portion can be formed as the upper surface of the projecting portion, and the upper surface of the projecting portion is pressed toward the bottom wall surface by a position restricting elastic piece formed on the recording apparatus.

According thereto, the electrodes formed on the projecting portion are pressed via the pressed portion by the position restricting elastic piece toward the bottom wall surface. Therefore, the positions of the electrodes in a loading direction can be held reliably and securely.

Also, the pressed portion can be pressed toward the bottom wall surface by a cartridge holding mounting lever of the recording apparatus.

According thereto, when the ink cartridge is properly aligned, the cartridge holding mounting lever presses the electrodes formed on the projecting portion toward the bottom wall surface to reliably and securely hold the positions of the electrodes in the insertion direction.

In this invention, the pressed portion can be formed as a second projecting portion disposed at a rear side of the first projecting portion in the insertion direction of the cartridge into the recording apparatus.

According thereto, the rotational movement of the mounting lever can be converted into the linear motion as much as possible, and therefore the electrodes can be precisely positioned to predetermined positions without being subjected to a rotational force.

Another aspect of this invention involves a guide projecting portion extending in the loading direction of the container and which is located below the lever.

Thereby, when the ink cartridge is loaded, the ink supply port side can be securely guided to the flow path forming member. Also, at the time that mounting is completed, the widthwise position of the front and rear of the ink cartridge can be held at a predetermined position.

Additionally, a recessed portion can be formed in another wall surface adjacent to the wall surface that is formed with the projecting portion.

According thereto, in a case where the ink cartridge is removed by using the rotation, the rotation at the time of cartridge removal can be guided into a predetermined locus, and the external force applied to the flow path forming member and caused by lateral shifting can be reduced to the minimum possible.

Also, in a case where the ink cartridge is removed linearly, the ink cartridge is prevented from interfering with a cartridge holder rib provided for restricting the position of the ink cartridge in the arraying direction, even if rotational shifting occurs.

Also, a valve body that is normally kept in a closed valve state by a biasing member and an elastic sealing member that abuts the valve body and that elastically contacts an outer circumference of an ink supply member formed in the recording apparatus are housed in the ink supply port.

Shifting due to vibration can be prevented without the need for a biasing device on the recording apparatus, and the cartridge can be elastically fixed via the retaining member using the biasing member housed in the ink supply port. The leakage of ink can be prevented by the valve body when the ink cartridge is not mounted on the recording apparatus and by the sealing member when the ink cartridge is mounted on the recording apparatus.

Additionally, the retaining member can be formed as a lever having an engagement portion engageable with the part of the recording apparatus. The lever has a projection that biases an upper portion of the lever outward as the cartridge is mounted on the recording apparatus. Preferably, a plurality of the projections are respectively formed on side surfaces of the lever.

According thereto, the elasticity of the retaining member can be increased, to thereby provide more positive engagement. Also, during mounting, the resulting "click" can be made more perceptible. Further, even when the retaining member is deformed out of a predetermined configuration, the projection(s) can return the retaining member to a proper position to securely engage the engagement portion of the retaining member with the part of the recording apparatus.

This invention also provides that the projecting portion can be narrower in width than the ink container.

This way, the ink cartridge can be housed in close contact with a carriage, and while the carriage can be made compact, the ink cartridge still can be securely positioned in place. Further, a distance between adjacent ink cartridges can be reduced to the minimum possible.

This invention also provides that a region serving as the upper surface of the pressed portion when the cartridge is mounted on the recording apparatus is formed as a flat surface.

According thereto, the secure contact of the pressed portion with the pressing member of the recording apparatus can be realized, and the amount of pressing toward the bottom wall surface can be precisely controlled.

This invention also provides that the electrodes are arranged in at least two rows, and the rows are perpendicular to an axis of the ink supply port.

According thereto, since the electrodes are arranged on the projecting portion in the widthwise direction in which the position of the projecting portion is restricted, the electrodes can be reliably positioned with respect to the contacts of the recording apparatus side.

Additionally, the retaining member can be formed as a lever having an engagement portion engageable with the part of the recording apparatus, and the lever can be configured to exert an elastic force for urging the ink container toward the projecting portion side.

Thereby, the electrode group on the projecting portion can be urged toward and securely contacted with the recording apparatus.

In another aspect of this invention, an elastic sealing member is housed in the ink supply port. The elastic sealing member engages the ink supply member of the recording apparatus when the ink cartridge is mounted on the recording apparatus.

Thereby, the force applied to the ink cartridge is relieved by the elastic sealing member, thereby preventing a local force from acting on the ink supply member of the recording apparatus, so that damage of the ink supply member can be avoided.

Additionally, the second side wall can have at least one of a recess and a protrusion for pinching the ink cartridge.

According thereto, even if several ink cartridges, each having a narrow width, are disposed close to each other, a desired ink cartridge can be removed and replaced using the retaining member and the pinching recess or protrusion.

In another aspect of this invention, the second side wall is elongated in the cartridge insertion direction.

According thereto, since the projecting portion and the pressed portion can be disposed on the surface of the side wall elongated in the cartridge insertion direction, the surface of the side wall can be utilized efficiently. Further, the surface on which the projecting portion is disposed is elongated vertically, the width of the carriage (the width of the carriage in the carriage moving direction) for mounting a plurality of cartridges adjacent to each other can be made small.

In another aspect of this invention, the electrodes and the memory unit are disposed on a circuit board mounted on a surface of the projecting portion. The surface of the projecting portion is parallel to the cartridge insertion direction, and electrodes are formed on an exposed surface side of the circuit board.

According thereto, the electrodes can be appropriately disposed on the projecting portion without inclination. Further, the electrodes can be formed by circuit printing technology, while effectively utilizing the flatness of the circuit board. Therefore, the contact reliability can be enhanced. Moreover, a recess can be formed in the projecting portion to house therein the memory unit on the back surface of the circuit board. The entire exposed surface side can be used as a region on which the electrodes can be disposed.

Preferably, each of the electrodes has a vertically elongated shape.

According thereto, the electrodes can be concentrically disposed at a region that is in the vicinity of the projecting portion for laterally positioning the ink cartridge and that is high in positioning precision, and therefore the contact can be established with high reliability.

Another aspect of this invention provides that the electrodes and the memory unit are formed on a circuit board, and the electrodes are disposed on the circuit board at an offset position closer to the bottom wall surface.

According thereto, the electrodes can be disposed on a region of the ink cartridge where shifting is reduced to the minimum possible by engagement of the ink supply port with the ink supply needle.

In another aspect of this invention, the second projecting portion is located within a region defined by and between the outermost electrodes in a direction that is perpendicular to the cartridge insertion direction and that is parallel to the second side wall.

According thereto, when the second projecting portion is pressed by the member of the recording apparatus, the electrodes is not subjected to a rotational force and is precisely positioned.

In another aspect of this invention, a height of the second projecting portion from the second side wall is smaller than a height of the first projecting portion from the second side wall.

According thereto, a portion of the cartridge holder to be located in the vicinity of the second projecting portion can be arranged close to the ink cartridge, thereby preventing size increase of the cartridge holder. Further, the rigidity of the second projecting portion can be readily increased to such a degree that the second projecting portion can bear against the pressing of the mounting lever.

Another aspect of this invention provides an erroneous insertion preventive identification piece which is disposed between the first projecting portion and the second projecting portion.

According thereto, the cartridge holding mounting lever for pressing the second projecting portion can be made simple in structure, otherwise the structure of the mounting lever will be complicated in order to escape the identification piece. Further, the identification piece can be used as a guide, and in this case the identification piece also contributes to effective positioning of the electrodes formed on the first projecting portion.

Additionally, the identification piece can be constructed as a block, which is fixed to the ink container by a fixing member.

According thereto, the electrodes can be formed on the block which is small and can be easily handled in comparison to the ink container. Further, since the container can be commonly used regardless of kinds of liquid contained in the container, product fluctuation of the container can be reduced in comparison with a case in which containers are prepared depending on kinds of liquid.

Also, the identification piece and the first projecting portion can be constructed as a unitary block, which is fixed to the container by a fixing member.

According thereto, the identification piece and the projecting portion can be fixed to the ink cartridge simultaneously by a single assembly operation. Further, the manufacture can be conducted while confirming the conformity between the identification piece and the memory unit mounted on the circuit board of the projecting portion.

Another aspect of this invention provides a positioning system that is disposed on a back surface of the block and the second side wall of the ink container.

According thereto, the block can be assembled into the ink container with high precision even by an automated assembly device.

In another aspect of the invention, the pressed portion of the second projecting portion has a surface that extends perpendicular to a surface on which the electrodes are formed.

According thereto, the electrodes can be pressed in parallel to the electrode forming surface, the electrodes can be positioned precisely.

In another aspect of this invention, the side surfaces of the projecting portion are parallel to the cartridge insertion direction.

As a further aspect of this invention, one or both of the side portions of the first projecting portion can be provided with at least one of a projection, a ridge and a groove. The projection(s), ridge(s) and/or groove(s) can engage with corresponding structure in the printing apparatus to help hold the ink cartridge more securely.

According thereto, the position of the projecting portion can be securely restricted, and therefore the electrodes can be positioned precisely.

In another aspect of this invention, the lever receptacle portion is integral with the projecting portion on which the electrodes are formed.

According thereto, the lever receptacle portion and the projecting portion can be formed as a unitary member, resulting in a simple structure. Further, the rotational motion of the mounting lever can be entirely converted into the linear motion and therefore the electrodes can be positioned to a predetermined portion precisely without being subjected to a rotational force.

In another aspect of this invention, a distal end of the identification piece is protruded outward beyond a surface on which the electrodes are formed According thereto, the electrode forming surface can be protected by the identification piece. In a case where the electrodes are formed on a circuit board, and the circuit board further has a semiconductor memory element, these components can also be protected by the identification piece.

Preferably, a plurality of the identification pieces are provided.

According thereto, by selecting the number, position or the like of the identification pieces depending on kinds of cartridges, plural kinds of cartridges can be identified using a limited space.

The present invention also concerns an ink jet recording apparatus mounting an ink cartridge including: an ink supply port formed at a position, offset to one side, of a bottom wall defining in part an ink container; a projecting portion, formed on a lower portion of one wall out of two opposing walls adjacent to the bottom wall, the projecting portion having an upper surface and side portions that have specific and predetermined positions when the cartridge is mounted on the recording apparatus, wherein the one wall is located further from the ink supply port than another wall, out of the two walls, is located; an elastically deformable lever formed on the other wall, the lever extending upwardly from the other wall to be spaced from the other wall, and having an engaging portion at an intermediate position, which engages a corresponding part of the recording apparatus; and a plurality of electrodes formed on the projecting portion and which are electrically connected to a memory unit disposed on the ink container. The ink jet recording apparatus has: a flow path forming member communicating with a recording head and formed at the opposite position to the ink supply port in the state where the ink cartridge is mounted; a width direction regulating projecting portion for abutting the side portions of the projecting portion; and a position regulating elastic piece for abutting the upper surface of the projecting portion.

According thereto, both sides of the projecting portion are regulated by the width direction regulating projecting portion, and the upper surface thereof is regulated by the elastic piece. Therefore, the position of the electrode group can be held at a predetermined position.

In this invention, when the ink cartridge is loaded, the position regulating elastic piece can be pressed by the lower portion of the ink cartridge's projecting portion and is elastically deformed, while thereafter, when mounting of the ink cartridge is completed, the elastic piece returns to its original position and abuts the upper surface of the projecting portion.

According thereto, the ink cartridge can also be mounted by pressing the ink cartridge inward in a direction parallel to the flow path forming member of the recording apparatus. Thus, an undesirably high level of force will not be applied to the flow path forming member or the ink supply port. This way, the elastic piece retreats in correspondence with the movement of the cartridge without hindering the mounting operation of the cartridge. Also, at the time mounting is completed, the cartridge is held at the position where contact with the electrode group can be securely maintained.

In this invention, a projecting portion is formed at the position of the width direction regulating projecting portion corresponding to a rotation assisting recessed portion formed in the ink cartridge.

According thereto, when the cartridge is removed, the rotation can be guided into a predetermined locus by the projecting portion, and the external force applied to the flow path forming member can be kept as low as is possible.

The recording apparatus according to the present invention can be configured to satisfy the equation: $L \geqq H/\tan\theta + \Delta L$, where L is the distance from the upper surface of the projecting portion to a center of the ink supply port, wherein the upper surface of the projecting portion serves as a rotation center when the ink cartridge is removed from the recording apparatus, $\theta$ is a rotation angle required when the ink cartridge is removed from the recording apparatus, H is an entering length of the flow path forming member and $\Delta L$ is a positional displacement allowable range of the elastic sealing material According thereto, the ink cartridge can be removed by rotating the ink cartridge without applying excessive force to the flow path forming member.

The present invention also provides a recording apparatus, which receive an ink cartridge including: an ink container having first, second and third wall surfaces, the second and third wall surfaces being adjacent to the first wall surface and opposing each other; an ink supply port disposed on the first wall surface; a retaining member disposed on the second wall surface, the retaining member having an engagement portion elastically engageable with a part of a recording apparatus; a lever-pressed portion disposed on the third wall surface, and which can be pressed by a cartridge holding mounting lever of the recording apparatus; a projecting portion, which is disposed closer to the ink supply port than the lever-pressed portion, the projecting portion having side portions that are to be restricted by the recording apparatus; and a plurality of electrodes disposed on the projecting portion, and electrically connected to a memory unit disposed on the ink container. The ink jet recording apparatus has a flow path forming member communicating with a recording head, and formed at a position which opposes the ink supply port of the ink cartridge which is received the recording apparatus; and the mounting lever has a rotation fulcrum on a side of the lever-pressed portion, wherein when the engagement portion of the retaining member is properly engaged with the part of the recording apparatus, the mounting lever rotates about the rotation fulcrum and presses the lever-pressed portion to a lever-pressed portion's predetermined position and is retained in a mounting lever's predetermined position.

According to this arrangement, the surface opposite to the surface fixed by the retaining member can be securely retained by the mounting lever. Further, since the lever-pressed portion is pressed by a rotation fulcrum side of the mounting lever, the position of the lever-pressed portion in the mounting direction can be held with a small force when the mounting lever is retained.

Additionally, when the ink cartridge is not mounted properly, the mounting lever is prevented from moving to the mounting lever's predetermined position.

In this fashion, errors in mounting the ink cartridge can be prevented with assurance.

The present disclosure relates to the subject matter contained in Japanese patent application Nos. 2002-341826 (filed on Nov. 26, 2002), 2003-76890 (filed on Mar. 20, 2003), 2003-76891 (filed on Mar. 20, 2003), 2003-128049 (filed on May 6, 2003) and 2003-204804 (filed on Jul. 31, 2003), each of which is expressly incorporated herein by reference in its entirety.

DESCRIPTION OF THE PREFERRED EMBODIMENTS

Now, the details of the invention will be described below based on illustrated embodiments.

Figure 1A:
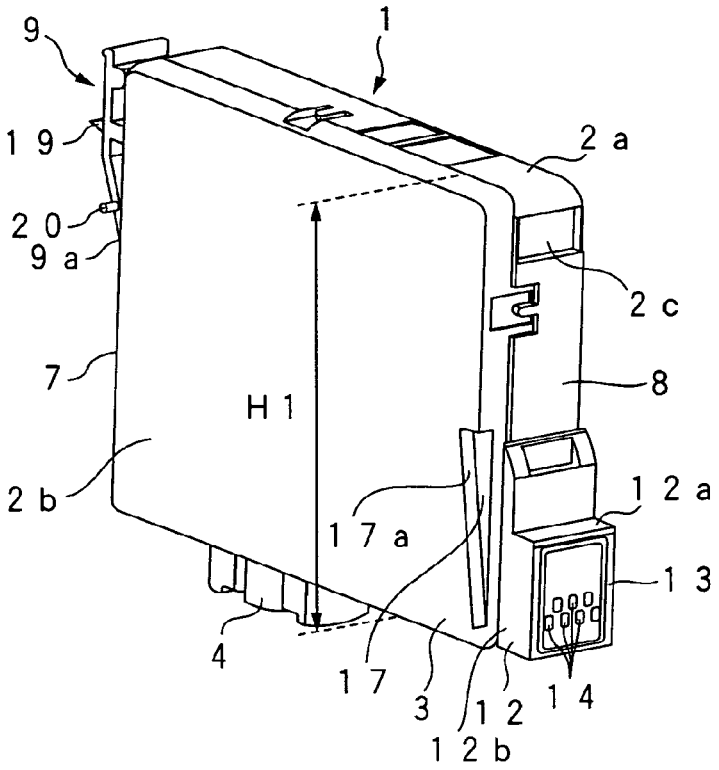
FIGS. 1A and 1B are perspective views, each showing different portions of a first embodiment of an ink cartridge in accordance with the present invention.
Figure 1B:
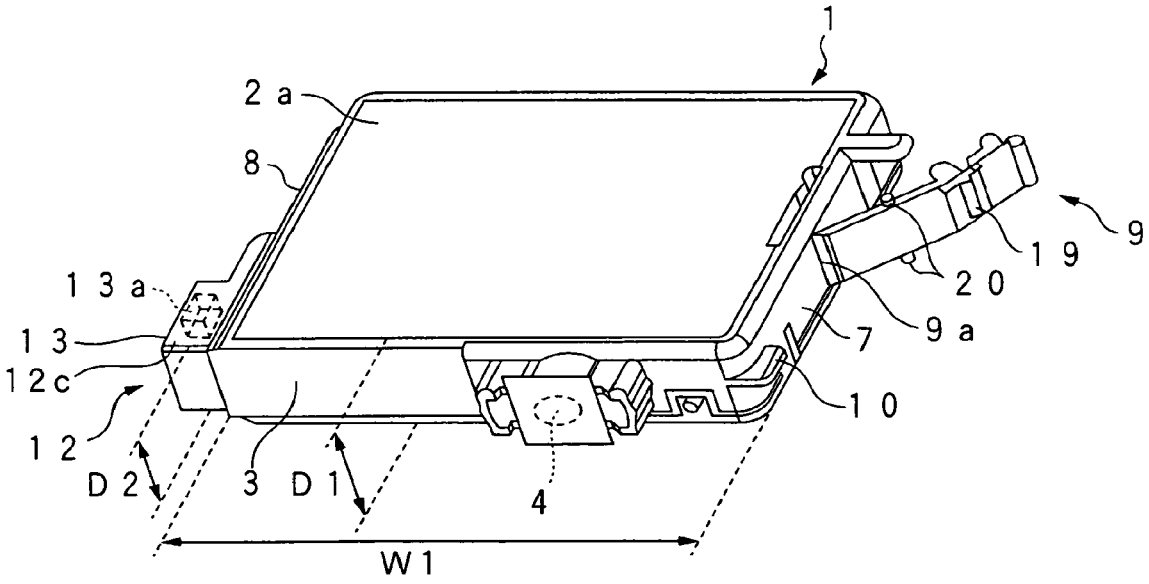

FIGS. 1A and 1B each show an embodiment of an ink cartridge according to this invention. In this embodiment, an ink cartridge 1 includes a flat container including a container body 2*a* and a lid body 2*b* (which also could be referred to as first and second sides), and an ink supply port 4 that is provided on a wall surface (the bottom wall) 3 of the container body 2*a* and that engages an ink supply needle, which is part of a flow path forming member of a recording head, for supplying ink to the recording head. In addition, the ink supply port 4 is disposed at a position offset from the central plane of the cartridge toward one side, in the longitudinal direction, (i.e. on the side of a wall surface ("side wall") formed with a lever 9 serving as a retaining member). The ink cartridge 1 also has a top surface (top wall). The ink supply port 4 is configured to define an ink flow path passing through the bottom wall 3 and to engage the ink supply needle for fluid communication via the ink flow path between the ink supply needle and an ink chamber of the ink cartridge 1. In this embodiment, a part of the ink supply port 4 is protruded outward from the wall surface 3 of the container body 2*a* as illustrated, but the ink supply port according to the present invention is not limited to this design.

Figure 2:
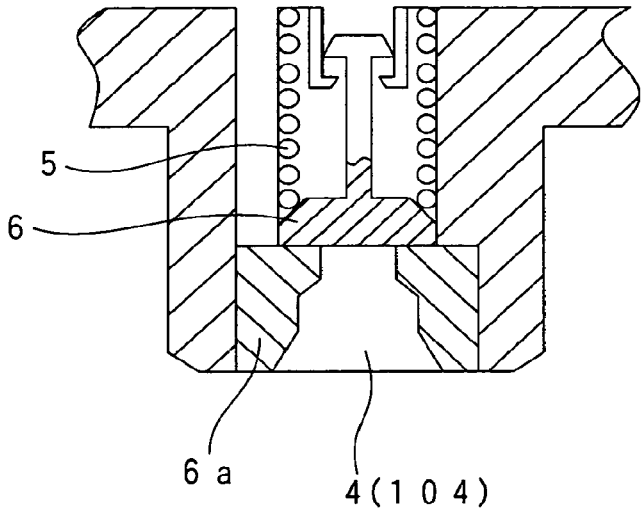
FIG. 2 is a cross-sectional view showing an embodiment of an ink supply port from the ink cartridge depicted in FIGS. 1A and 1B.

As shown in FIG. 2, the ink cartridge 1 includes a valve body 6 normally kept closed by a spring 5, which exerts a biasing force on the valve body. The valve body 6 and spring 5 are arranged at the leading end side of the ink supply port 4. An annular elastic seal member 6*a* for sealingly engaging the flow path forming member (not shown) is loaded on the outer side, i.e. the leading end side, of the valve body 6.

With reference again to FIGS. 1A and 1B, the lever 9 serving as the elastically deformable retaining member is formed on a wall surface 7 on the side closer to the ink supply port 4 out of the two opposing wall surfaces 7, 8 that are substantially orthogonal to the wall surface 3 having the ink supply port 4. The wall surface 7 can be considered the front wall, and the wall surface 8 can be considered the rear wall (those skilled in the art will appreciate that this terminology also could be reversed). The lever 9 extends upwardly such that its lower end is located at the wall surface 7, and its upper portion is spaced apart from the wall surface 7. A guide projecting portion 10 is formed on the lower portion of the wall surface 7.

Figure 5:
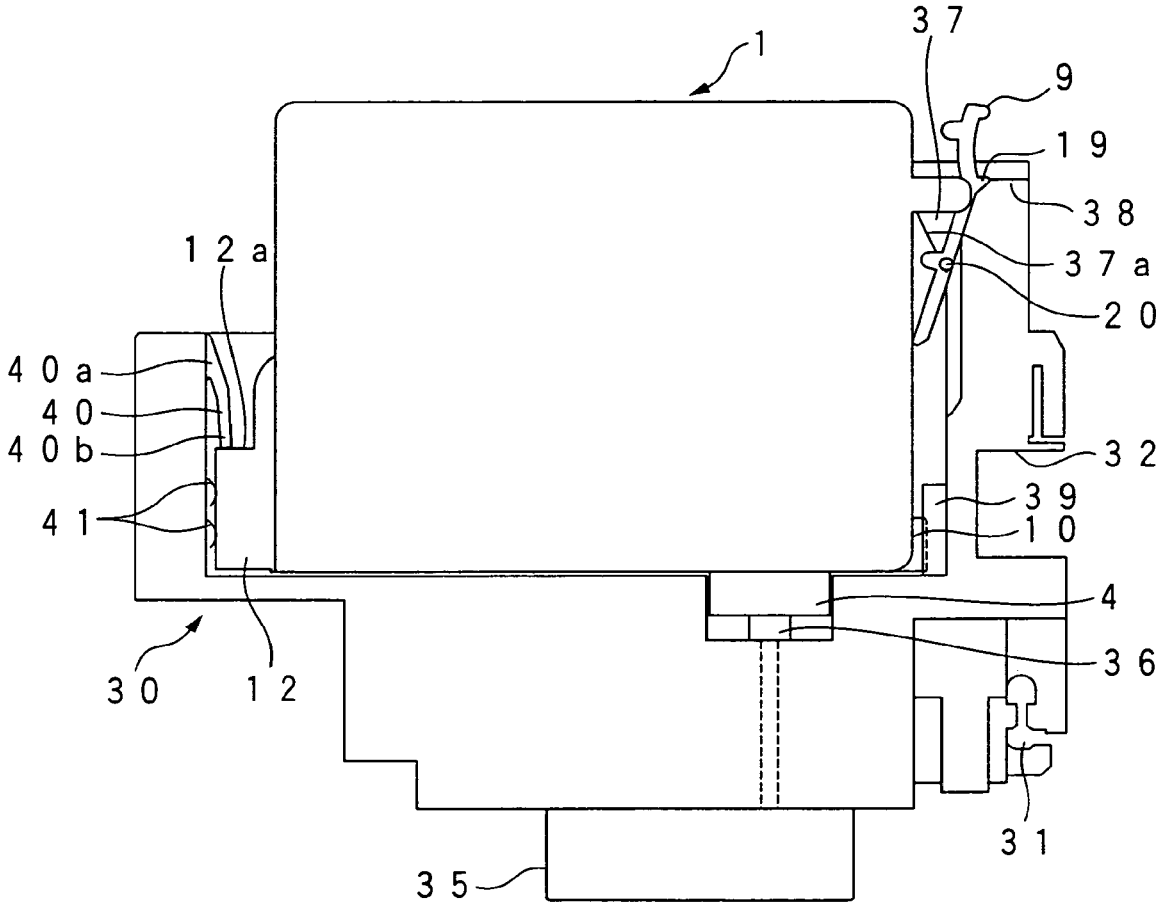
FIG. 5 is a side elevational view showing a state in which the ink cartridge is mounted on the carriage.

Also, a projecting portion 12 having a surface 12*a*, e.g. a flat surface, that can support an elastic piece or pressing member of the recording apparatus (discussed in detail below) is formed on a lower end portion of the other wall surface 8 so as to be narrower in width than the width of the ink container including the container body 2*a* and lid body 2*b*. As depicted in FIG. 5, the surface 12*a* of the projecting portion 12 acts as an upper surface of a pressed portion in this embodiment to be pressed by an elastic piece or pressing member 40 of the recording apparatus. Turning back to FIGS. 1A and 1*b*, a recessed portion 2*c* having a size suitable for receiving a user's thumb is formed in the upper portion of the wall surface 8. A plurality of electrodes 14 for making electrical contact with elastic contacts 41 of a recording apparatus (shown in FIG. 5) are formed on a surface 13 of the projecting portion 12 parallel to the wall surface 8. In this embodiment, the electrodes 14 are formed in two staggered row (three electrodes in the upper row and four electrodes in the lower row) such that a plurality of the electrodes 14 are horizontally arranged in each row. It will be appreciated that this invention encompasses the use of any other suitable electrode configuration.

The electrode disposed at the center of the upper row is located on a plane that intersects the central axis of the ink supply port 4 and is also perpendicular to the surface where the electrodes 14 are formed. Other electrodes are arranged with reference to this centrally-disposed electrode. By this arrangement of the electrodes in this embodiment, the positional offset of the electrodes can be reduced even when the ink cartridge shifts about the ink supply port during the mounting of the ink cartridge.

Figure 3A:
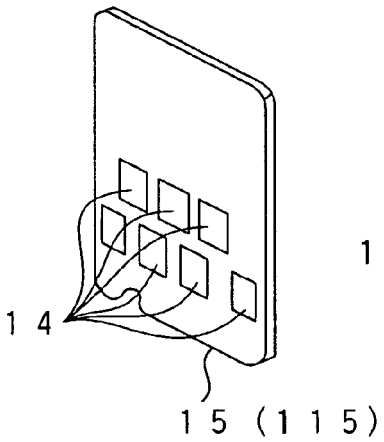
FIGS. 3A and 3B are perspective views showing, respectively, the structure of the front and rear of a circuit board having electrodes and which can be mounted on a projecting portion of the ink cartridge depicted in FIGS. 1A and 1B.
Figure 3B:
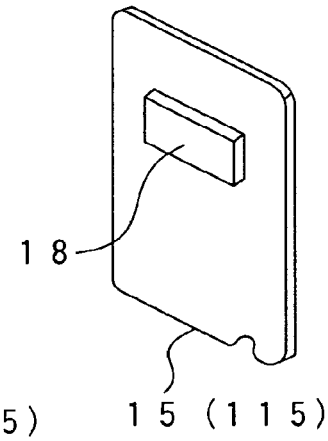

As shown in FIG. 3A, these electrodes 14 are formed on the front surface of a circuit board 15 and are disposed by fixing the circuit board 15 to the surface 13 of the projecting portion 12. In addition, as shown in FIG. 3B, a memory unit 18 such as a readable-writable semiconductor memory element, such as an EEPROM, storing information about the ink contained in the ink container, is mounted on the rear surface of the circuit board 15, and is electrically connected to at least some of the electrodes 14.

Since the memory unit 18 is mounted on the rear surface of the circuit board 15 in this fashion, a recess 13*a* (see FIG. 1B) can be preliminarily formed in the surface 13 of the projecting portion 12 by utilizing the thickness of the projecting portion 12 to store the memory unit 18 therein. This arrangement also makes it possible to fully use the entire surface side of the circuit board 15 as an area over which the electrodes 14 can be disposed. Moreover, the electrodes 14 can be formed by a circuit printing technology, while effectively utilizing the flatness of the circuit board 15, to thereby provide an enhanced contact reliability.

With reference now to FIG. 1A, a rotation assisting recessed portion 17 is provided for assisting in the removal of the ink cartridge from the carriage, as discussed below. The recessed portion 17 cooperates with a positioning member of the carriage, and is formed at the side of the portion where the projection portion 12 is formed. This rotation supporting recessed portion 17 has an inclined surface 17*a*, the lower portion of which is positioned on the wall surface 8 side, and the upper portion of which tapers inward toward the facing wall surface 7 side of the ink cartridge 1.

The lever 9 is provided on the wall surface 7 of the container body 2*a* with a fulcrum, or pivot point, 9*a* on the lower portion of the lever 9 and is elastically deformable. A claw portion, or projection, 19 serving as an engaging portion engageable with and disengageable from a suitably-shaped engaging portion 38 of the carriage projects outward above the fulcrum 9*a*. Another projection 20 is formed between the fulcrum 9*a* and the claw portion 19, so as to project laterally outward from the lever body, and preferably one such projection is formed on each side of the lever body.

Figure 4:
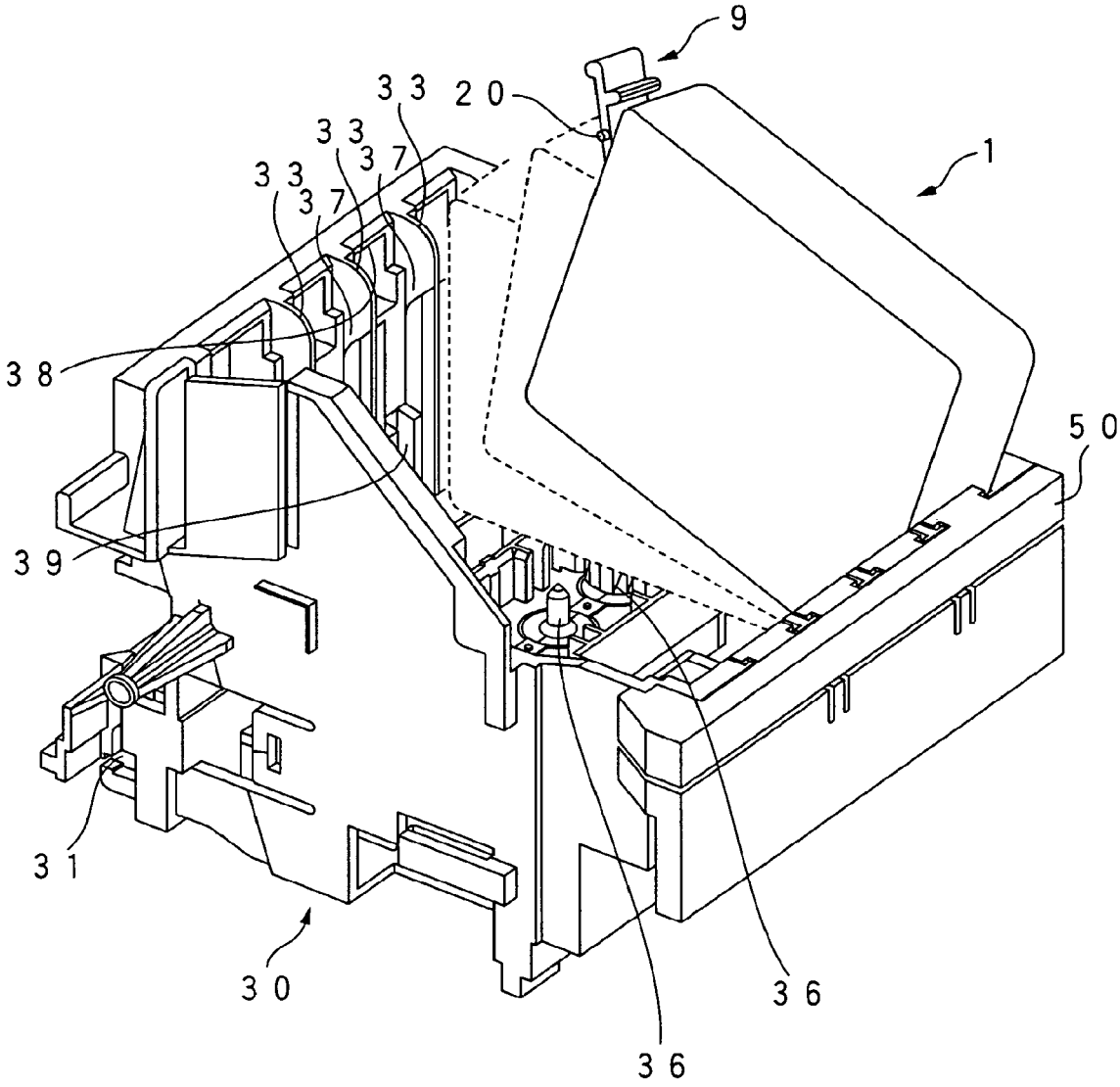
FIG. 4 is a perspective view showing an embodiment of a carriage of a recording apparatus suitable for receiving the ink cartridge shown in the preceding Figures.

FIGS. 4 and 5 show the carriage structure of an embodiment of a recording apparatus suitable for receiving the aforesaid ink cartridge. A carriage 30 is configured as a cartridge holder and is designed with substantially a box shape such that a plurality of ink cartridges can be inserted therein from above. The side surface in the vicinity of the bottom portion of the carriage 30 is formed with a recessed portion 31 that engages a guide member formed by plate-processing a frame of the recording apparatus or the like and that regulates the moving path of the carriage 30, and a guide surface 32 that slides on the flat surface of a second guide member (not shown).

As shown in FIG. 6, an ink cartridge storage portion of the carriage 30 is partitioned by ribs 33 (seen in FIG. 4), and ribs 34 for separating one cartridge from another, each of the ribs serving as both a width direction regulating member and a rotation assisting member, so as to store a plurality of ink cartridges. In this embodiment, the carriage receives three color ink cartridges all formed in the same shape and one black ink cartridge which is wider than the other ink cartridges, but which is otherwise of the same shape. Particularly, while the lower portions of the ribs 34 are of the same width, the central portion side of the upper portion of each rib 34 is formed with an inclined surface portion 34*a* for cooperating with the rotation assisting recessed portion 17 of the cartridge 1 (this also can be seen in FIG. 7B). Since the rib 34 has such a structure, the side surface in the lower portion of the rib 34 abuts the side surface of the positioning projecting portion 12 of the cartridge to regulate the widthwise position of the cartridge. Also, when the time comes to remove an ink cartridge, the point around which the cartridge rotates can be controlled by the shape and position of the inclined surface portion 34*a* and the rotation assisting recessed portion 17.

As shown in FIG. 4, a flow path forming member 36 (in this embodiment, a hollow needle having a conical leading end portion and a continuous cylindrical portion extending there-from) for engaging the ink supply port for supplying ink to a recording head 35 provided on the under surface of the carriage is located in each ink cartridge storage region. A plurality of fine through-holes, each of which can maintain a meniscus, are formed through a conical surface of the conical portion of the hollow needle 36, so that ink can be supplied from these through-holes to the recording head via the cylindrical portion of the hollow needle.

As shown in FIG. 5, the carriage 30 has a wall surface opposite the lever 9 of the ink cartridge 1 that is formed with a groove 37 for engaging the projection 20, and also an engaging portion 38 (a recessed portion in this embodiment) for engaging the claw portion 19. The groove 37, which can be thought of as a retaining member, is formed with an inclined surface 37*a*, the upper portion of which widens toward the cartridge side. During ink cartridge loading into the carriage 30, the inclined surface 37*a* cooperates with the ink cartridge as follows. At the initial stage of loading the ink cartridge, the projection 20 at each side assuredly contacts this inclined surface 37*a* by virtue of the inclined surface's wide mouth, regardless how far open the lever 9 is. Also, once the ink cartridge has been mounted, the inclined surface 37*a* forces the lever 9 to pivot open toward the wall surface side of the carriage i.e. toward the outside. Particularly when the projection 20 is formed on each side, the lever can be securely guided to a preferred position, even when the lever is twisted.

Also, a second groove 39 is formed below the groove 37. This second groove 39, which can be thought of as a retaining member, engages the guide projecting portion 10 of the ink cartridge just before the end of loading, and prevents the ink cartridge from shifting in the widthwise direction as mounting concludes. In addition, in this embodiment, the guide projecting portion 10 and the groove 37 are provided on the ink cartridge and in the ink cartridge storage portion, respectively, in order to increase the volume of the ink cartridge as much as possible. It will be appreciated that the same benefits in guiding the ink cartridge can be obtained if the groove 37 is formed in the ink cartridge and the projecting portion 10 is formed on the ink cartridge storage portion, although the storage capacity of the ink cartridge may be reduced.

As shown in FIG. 5, each cartridge storage region on the opposite surface of the carriage 30 is formed with a positioning elastic piece 40, which also can be thought of as a pressing member, an upper end 40*a* of which serves as a rotation fulcrum, and a lower end 40*b* of which abuts the flat surface 12*a* of the ink cartridge's projecting portion 12. The elastic contact 41 (which may include plural electrical contacts) for electrically contacting the electrodes 14 formed on the projecting portion 12 is disposed below this elastic piece 40.

Figure 9:
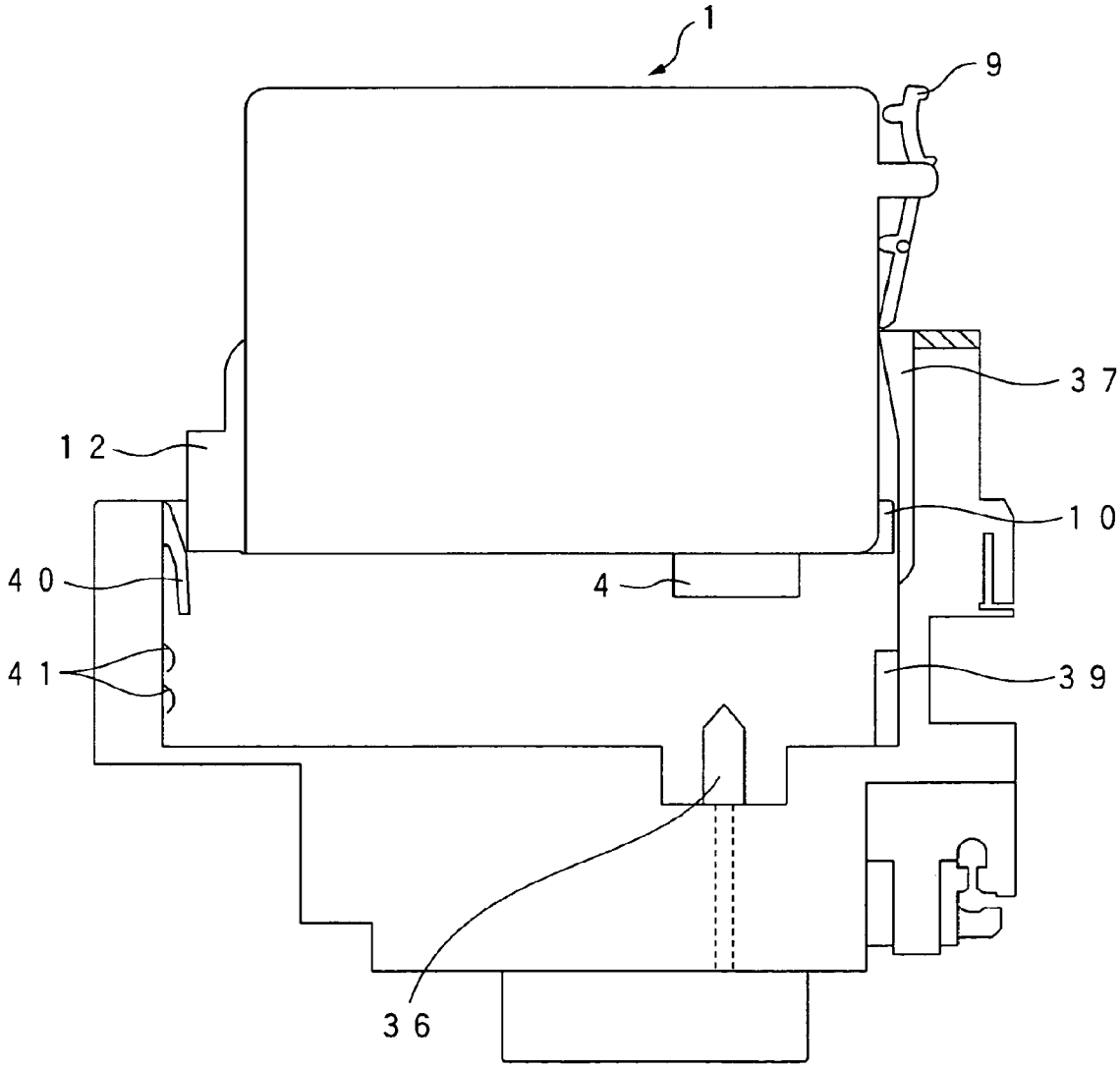
FIG. 9 is a side elevational view showing a state in which the ink cartridge is aligned with a predetermined position of the carriage.
Figure 10:
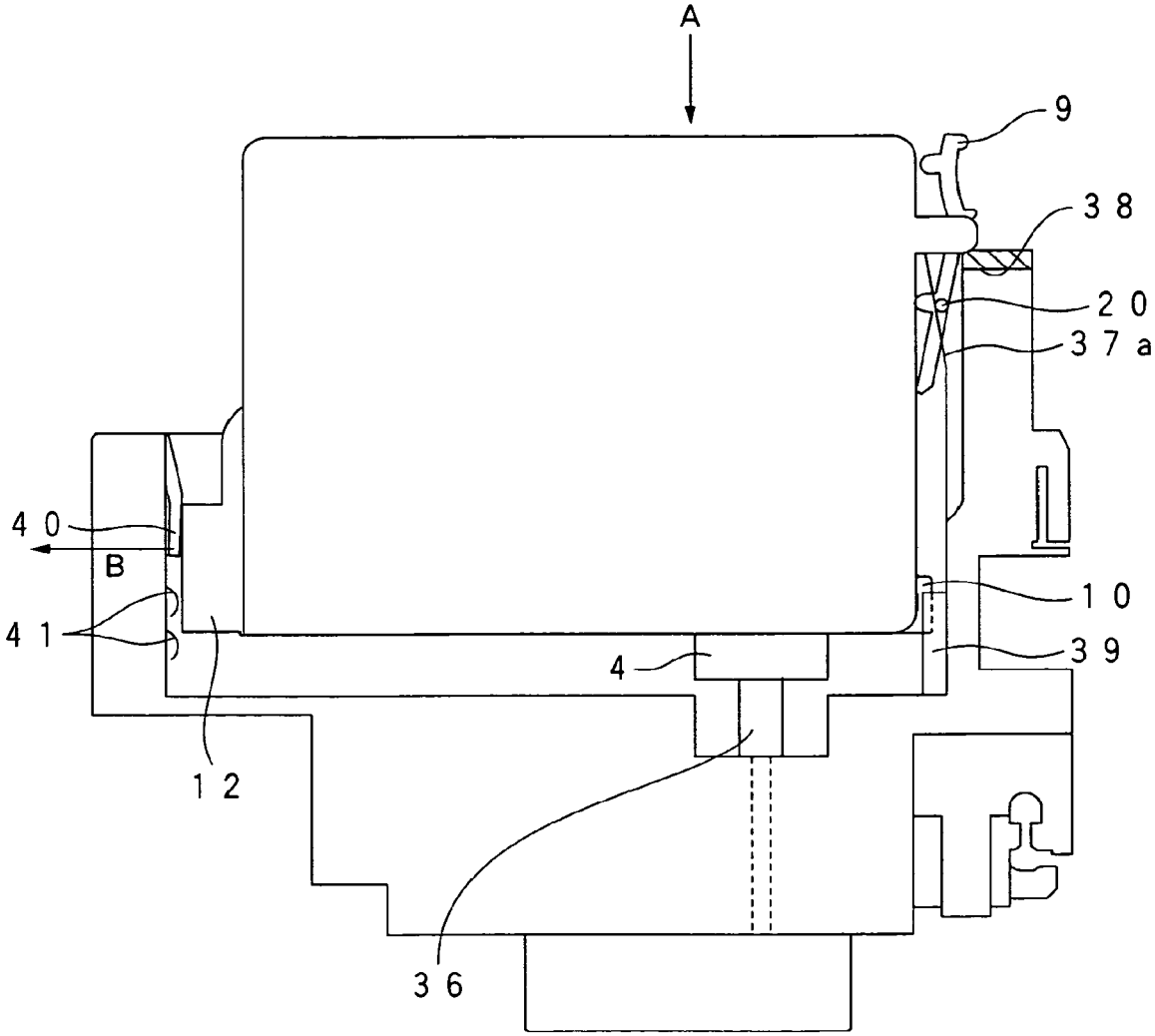
FIG. 10 is a side elevational view showing a state in which an ink cartridge is pushed in by its projecting portion until an elastic piece is deformed.

It should be understood that it is preferable for the ink cartridge to be mounted to the carriage 30 with only a small amount of rotation, as shown in FIGS. 5, 9 and 10, since this will limit the forces being applied to any one portion of the ink cartridge and recording apparatus.

Figure 7A:
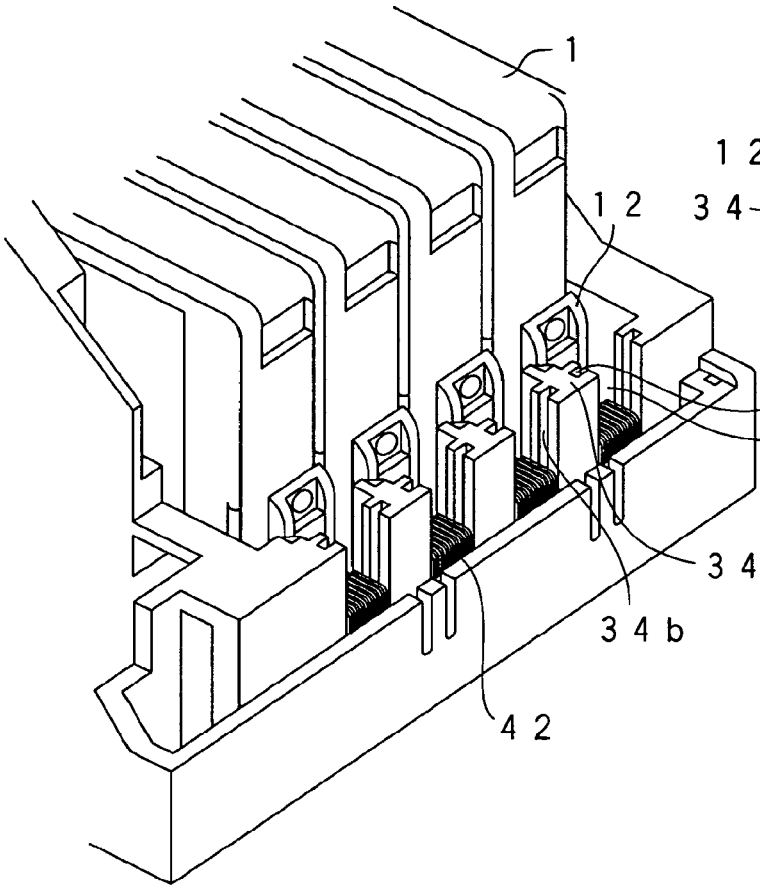
FIG. 7A is a perspective view showing an embodiment of a built-in portion for a contact forming member and a elastic piece unit.
Figure 7B:
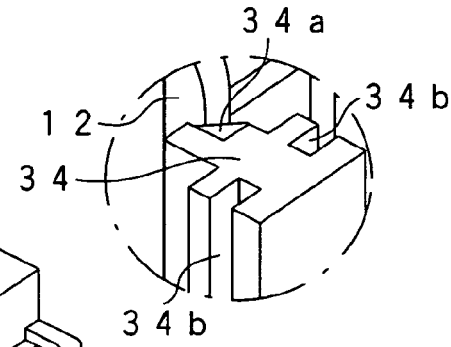
FIG. 7B is an enlarged perspective view showing a upper end portion of a rib from FIG. 7A.
Figure 8A:
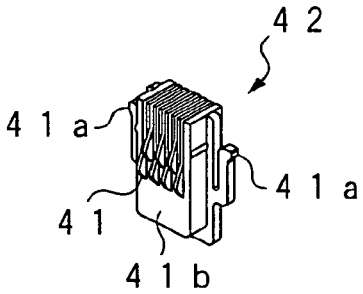
FIGS. 8A and 8B are perspective views showing embodiments of the contact forming member and the elastic piece unit, respectively.
Figure 8B:
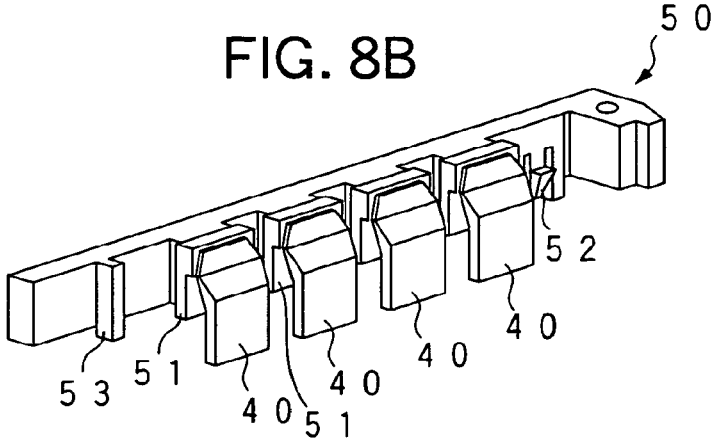

FIG. 7A shows an embodiment of the structure in the region of the carriage 30 having the elastic piece 40 and elastic contacts 41. As shown in the enlarged view of FIG. 7B, the region opposite the ink cartridge 1 is formed with an open-topped opening or slot 34*c* that is defined between the adjacent ribs 34, and each rib has a groove 34*b* on both of its sides. A contact forming member 42 has an elastically deformable claw (projection) 41*a* on each side as shown in FIG. 8A. The contact forming member 42 includes a substrate 41*b* mounting the elastic contacts 41 and the contact forming member is inserted into the lower side of each slot 34*c*. A plurality of elastic pieces 40, as shown in FIG. 8B, are respectively mounted on the upper slots of the openings 34*c*. In this embodiment, an elastic piece unit 50 formed with four elastic pieces 40 is mounted thereon. In the elastic piece unit 50, a projecting portion 51 for engaging the groove 34*b* is formed on each side of each elastic piece 40, and a claw (projection) 52 limits the vertical movement of the elastic piece 40. Since these elastic pieces 40 are disposed to respectively cover the contact forming members 42, each elastic piece 40 also has a function of protecting the contact forming member 42. In addition, reference numeral 53 depicts a guide projecting portion.

In this embodiment, when the ink cartridge 1 is aligned in position with a predetermined region of the carriage 30, as shown in FIG. 9, the projecting portion 12 abuts the elastic piece 40. When the ink cartridge 1 is pushed downward in this orientation, as shown in FIG. 10, the elastic piece 40 is compressed by the projecting portion 12 and deformed in the direction shown by arrow B. Thus, the ink cartridge 1 moves past the elastic piece 40 and continues downward.

In this process, the projection 20 on each side of the lever 9 of the ink cartridge 1 contacts the inclined surface 37*a* forming the widening portion. Also, the guide projecting portion 10 enters the groove 39. When the cartridge 1 is further advanced, both sides of the positioning projecting portion 12 are guided by the ribs 34, and the ink supply needle 36 enters the ink supply port 4 to raise the valve body 6 against the force of the spring 5.

It is preferable that the width of the projection(s) 20, taken together with the width of the lever 9, be no greater than the distance in the widthwise direction between the container body 2*a* and the lid body 2*b*. This way, since this positioning structure is no wider than the ink cartridge itself, adjacent ink cartridges can be closely arranged, as the projections of the adjacent ink cartridges will not interfere with one another.

The ink cartridge 1 is thus pushed into a predetermined position. Then, as shown in FIG. 5, the lever 9 is rotated about a region which serves as a pivot point to a predetermined outward position by the action of the inclined surface 37*a* of the carriage, and the claw 19 is moved against the engaging portion 38 under a strong applied elastic force, thus generating a perceptible "click", which can be heard and/or felt by the user. Thereby, a user can easily determine that the cartridge has been securely mounted on the carriage.

As depicted in FIGS. 1A and 1B, lever 9 is an elongated member attached to the wall surface 7 by a "living hinge". It will be understood by those skilled in the art that this structure is shown by way of example only, and not limitation, and that other attachment schemes also could be used without departing from this invention.

Also, almost concurrently, the elastic piece 40 is no longer subjected to the force that had been exerted by the projecting portion 12 and is therefore restored to its previous state by its own elasticity. Thus, the lower end 40*b* of the elastic piece 40 abuts the flat surface 12*a* in the upper portion of the projecting portion 12. At this time, the ink cartridge 1 is urged against the elastic contacts 41. Accordingly, the electrodes 14 can be brought into electrical communication with the elastic contacts 41 without substantial rubbing between the electrodes 14 and the elastic contacts 41. This eliminates not only wear of and damage to the electrodes 14 and the elastic contacts 12, but also prevents damage of data stored in an EEPROM (memory device), which may otherwise result from inappropriate contact.

In this state, in the vertical direction, the near side of the ink cartridge 1 is regulated by the projecting portion 12 and the lower end of the elastic piece 40, and the back side of the ink cartridge 1 is regulated by the claw 19 and the engaging portion 38. Also, in the horizontal direction (width direction), the location of the near side of the ink cartridge 1 is regulated by both sides of the projecting portion 12 and the width direction regulating projecting portion 34, and the position of the back side of the ink cartridge 1 is regulated by the guide groove 39 and the guide projecting portion 10. Because the position of the ink cartridge can be precisely controlled, the electrodes 14 are properly positioned to establish electric contact with each elastic contact 41.

By virtue of this arrangement, the mounted ink cartridge is held diagonally by the lower portion on the near side and the upper portion on the back side. Therefore, the mounted ink cartridge can be held securely at a predetermined position without reducing operationality.

Also, since the strong elastic force acting on the lever 9 urges the ink cartridge toward the elastic contacts 41, the electrodes 14 firmly press against the elastic contacts to maintain the electrically conductive relationship therewith. In addition, since the elastic member 6*a* of the ink supply port 4 has an opening smaller in diameter than the ink supply needle 36, owing to its elasticity, the elastic seal member 6*a* of the ink supply port 4 is elastically deformed to some extent while maintaining an airtight relationship with the ink supply needle 36 inserted therein, so as to relieve local contact with the ink supply needle 36, thus preventing damage which could otherwise be caused by the action of a local force applied to the ink supply needle 36. In addition, it is preferable to use the elastic member 6*a* having such an automatic alignment ability that a portion of the elastic member 6*a*, which is elastically contacted with the ink supply needle 36, is movable relative to a portion of the elastic member 6*a*, which is fixed to the cartridge.

Also, the projecting portion 12 is formed with a width no greater than that of the container body 2*a*. Therefore, even when each gap in the array direction between adjacent ink cartridges is reduced to the minimum possible, i.e., even when the plurality of ink cartridges are stored in a substantially contacting arrangement against each other, the position of the ink cartridges in the array direction can be accurately regulated. In other words, because the projecting portion 12 is narrower than the ink cartridge itself, adjacent ink cartridges can be closely arranged, since these positioning projecting portions will not interfere with one another.

Incidentally, the term "array direction" refers to a line along which successive ink cartridges mounted in the carriage are arranged. As shown in FIG. 6, this line is parallel to the scanning direction along which the carriage is reciprocated during printing.

On the other hand, when the ink cartridge 1 is to be removed from the carriage 30, the ink cartridge 1 is held, for example, with the operator's forefinger on the lever 9 and thumb on the pinching recessed portion 2*c*, and the lever 9 is squeezed and deformed so as to be moved toward the near side i.e. the container main body side (it should be understood that other fingers also could be used). As the lever 9 is elastically deformed, the claw 19 disengages from the engaging portion 38. The ink cartridge, having lost the support formerly provided by the engaging portion 38, moves slightly upward in response to the biasing force exerted by the spring 5 in the ink supply port, and the claw 19 on the lever 9 is displaced to a position outside the region of the engaging portion 38.

Figure 12:
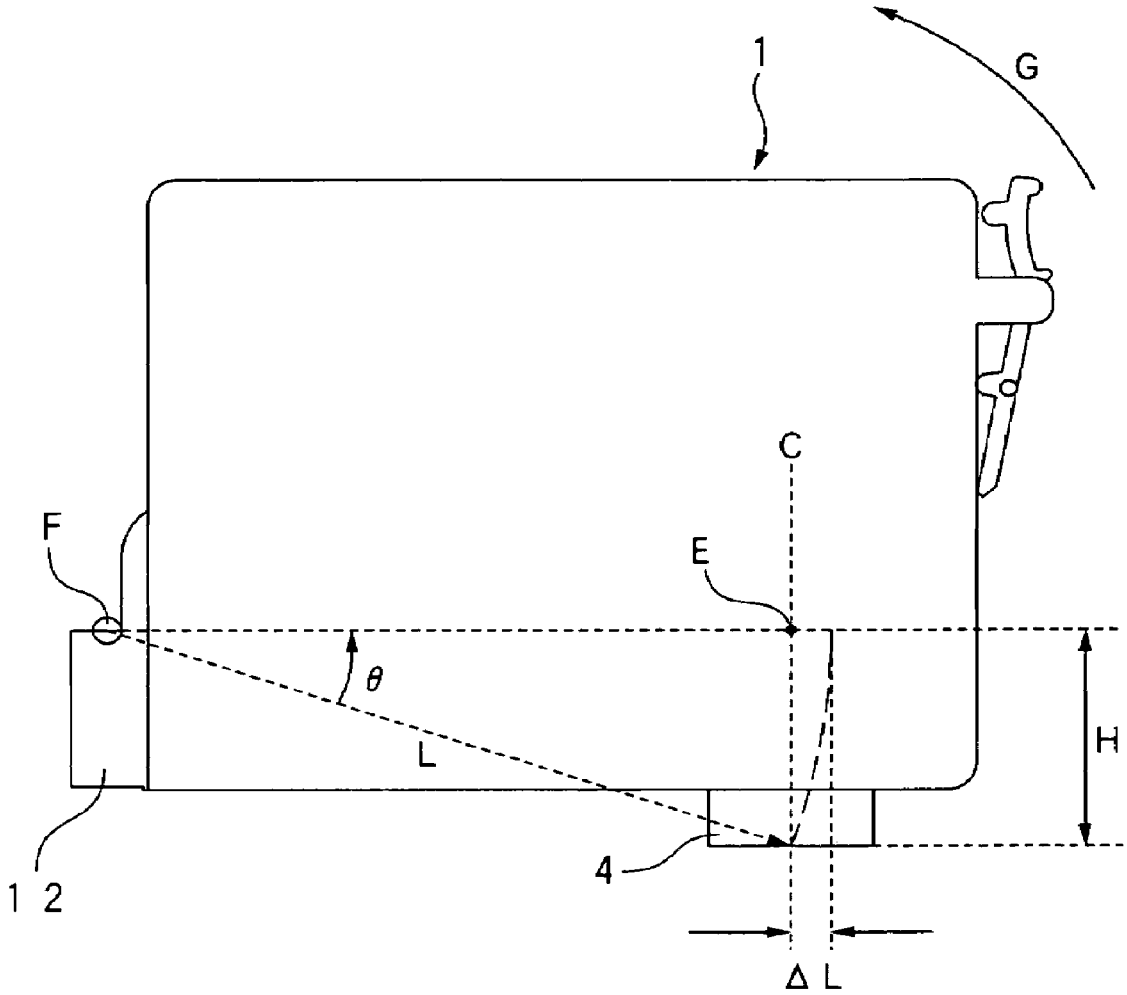
FIG. 12 is a schematic view showing a locus of rotation during removal of the ink cartridge.

The ink supply port 4 is disposed at a location offset toward the wall surface 7 where the lever 9 is disposed. Therefore, during cartridge removal, the ink supply port 4 can be disengaged from the flow path forming member, i.e. ink supply needle 36 by turning the cartridge about a large rotation radius L in the direction shown by arrow G direction about an abutment point F of the ink cartridge with the lower end of the elastic piece 40, as schematically shown in FIG. 12. This arrangement can reduce the adverse effects of any bending force (torque) applied to the ink supply needle 36 in cooperation with a cushioning function of the elastic seal member 6*a* that elastically contacts the cylindrical portion of the ink supply needle 36.

When the ink cartridge is turned during the cartridge removal, the rib 34, in particular, the inclined surface portion 34*a*, attempts to interfere with the side surface of the container main body 2*a* of the ink cartridge, but the presence of the recessed portion 17 at this portion can avoid the interference of the rib 34 to enable the easy and smooth removal of the ink cartridge.

The amount of displacement between the center of the ink supply needle 36 and the center of the ink supply port 4 can be expressed by $\Delta L = L - (H/\tan\theta)$, where L is the distance between the abutment point F which the elastic piece 40 contacts to restrict a rotation center, and the lower end of the central axis C of the ink supply port 4, H is the maximum value of the entering length of the ink supply needle 36, and $\theta$ is the rotation angle required during removal of the ink cartridge.

The rotation angle $\theta$ is the rotation angle of the ink cartridge required from the state in which the ink supply needle 36 is engaged with the ink supply port 4 to the state in which the center point of the leading end of the ink supply needle 36 is positioned outside the end face of the ink supply port 4.

The maximum value for H is defined as approximately the length from the lower end of the ink supply port 4 to the intersecting point E at which the central axis C of the ink supply port 4 intersects a line drawn to extend from the abutment point F (shown as reference numeral F in FIG. 12) and to be parallel to the bottom surface of the ink cartridge (to be perpendicular to the central axis C).

Since the ink cartridge has an ink supply needle (36) mounting length H of about 5 mm, the rotation radius L is about 28.8 mm and the rotation angle $\theta$ is about 10 degrees, the displacement amount $\Delta L$ between the center of the ink supply needle 36 and the center of the ink supply port 4 can be calculated to be about 0.4 mm.

In other words, a deformation amount by which the elastic seal member 6*a* installed in the ink supply port 4 can be deformed by a force that does not cause damage to the ink supply needle 36 is defined as $\Delta L$, and the rotation radius L can be set as $L \geqq H/\tan\theta + \Delta L$.

Further, since the rotation force is applied to the distal end of the lever 9, which is the furthest from the projecting portion 12 diagonally, the ink cartridge can be removed easily.

Moreover, by rotation in this manner, the electrodes 14 can be brought into electrical communication with the elastic contacts 41 without substantial rubbing between the electrodes 14 and those elastic contacts 41. This eliminates not only wear of and damage to the electrodes 14 and the elastic contacts 12, but also damage to data stored in an EEPROM (the memory device), which could otherwise be caused by improper contact.

In addition, a projecting portion that can easily conform to a user's thumb may be provided in place of the pinching recessed portion 2*c* in order to provide the same effect.

Figure 11:
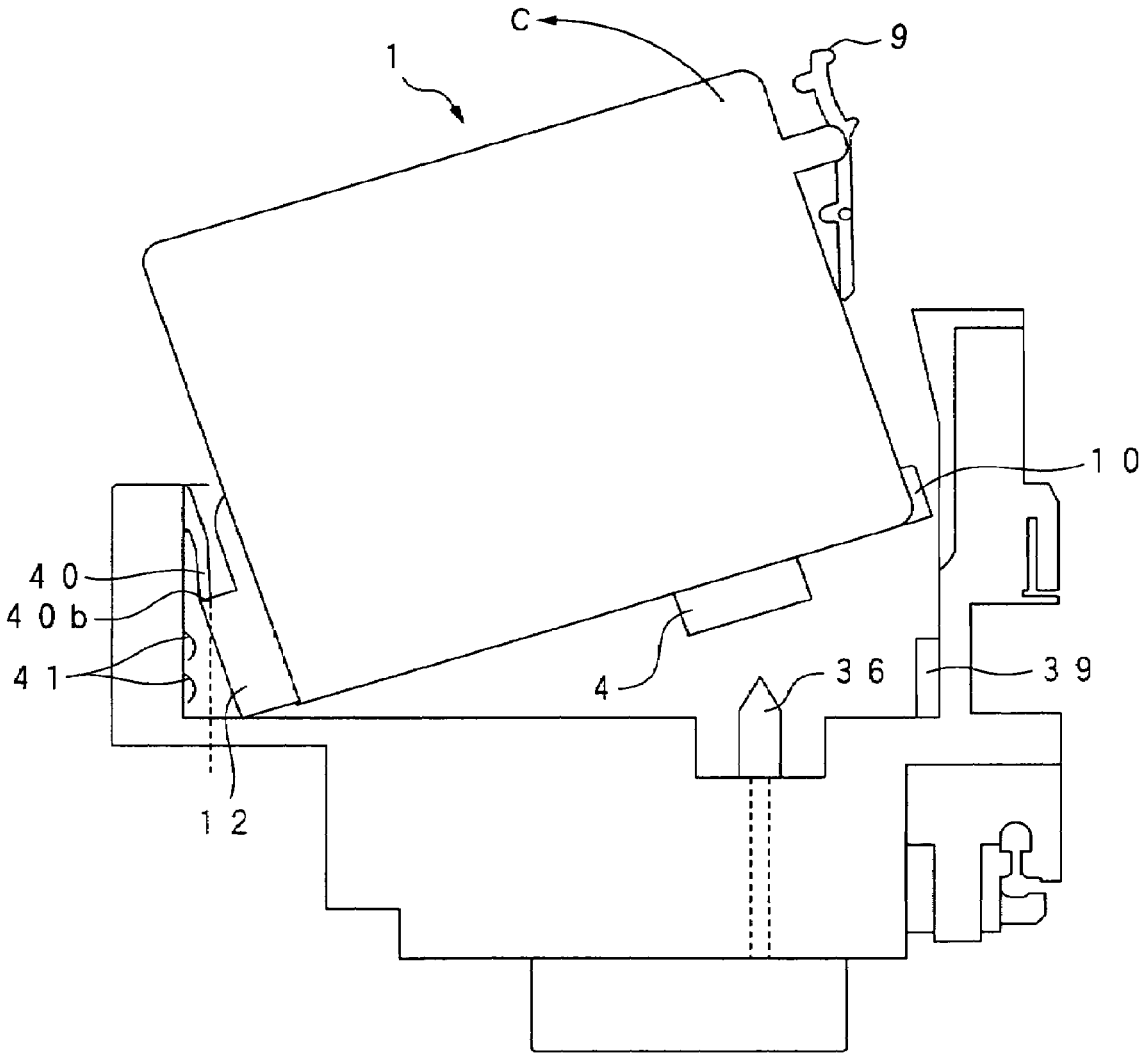
FIG. 11 is a side elevational view showing a procedure for removing the ink cartridge.

On the other hand, the opposite side of the ink cartridge 1 is constructed so that the projecting portion 12 is restricted from moving by the lower end 40*b* of the elastic piece 40. Thus, when the lever 9 side is lifted, as shown in FIG. 4, the cartridge is rotated in the direction of arrow C, as shown in FIG. 11, about the upper surface of the projecting portion 12, which serves as a rotation fulcrum, while at the same time being guided by the rib 34 serving as the width direction regulating projecting portion. At this time, the rib 34 partitioning the cartridge storage region enters the rotation assisting recessed portion 17 formed in the side surface of the ink cartridge 1 so that the ink cartridge 1 is rotated to a predetermined angle, i.e., the position where the flat surface 12*a* of the projecting portion 12 is disengaged from the lower end 40*b* of the elastic piece 40. Thus, at this stage, the ink cartridge 1 has disengaged from the carriage 30 and can be lifted obliquely for removal from the carriage 30.

Figure 13:
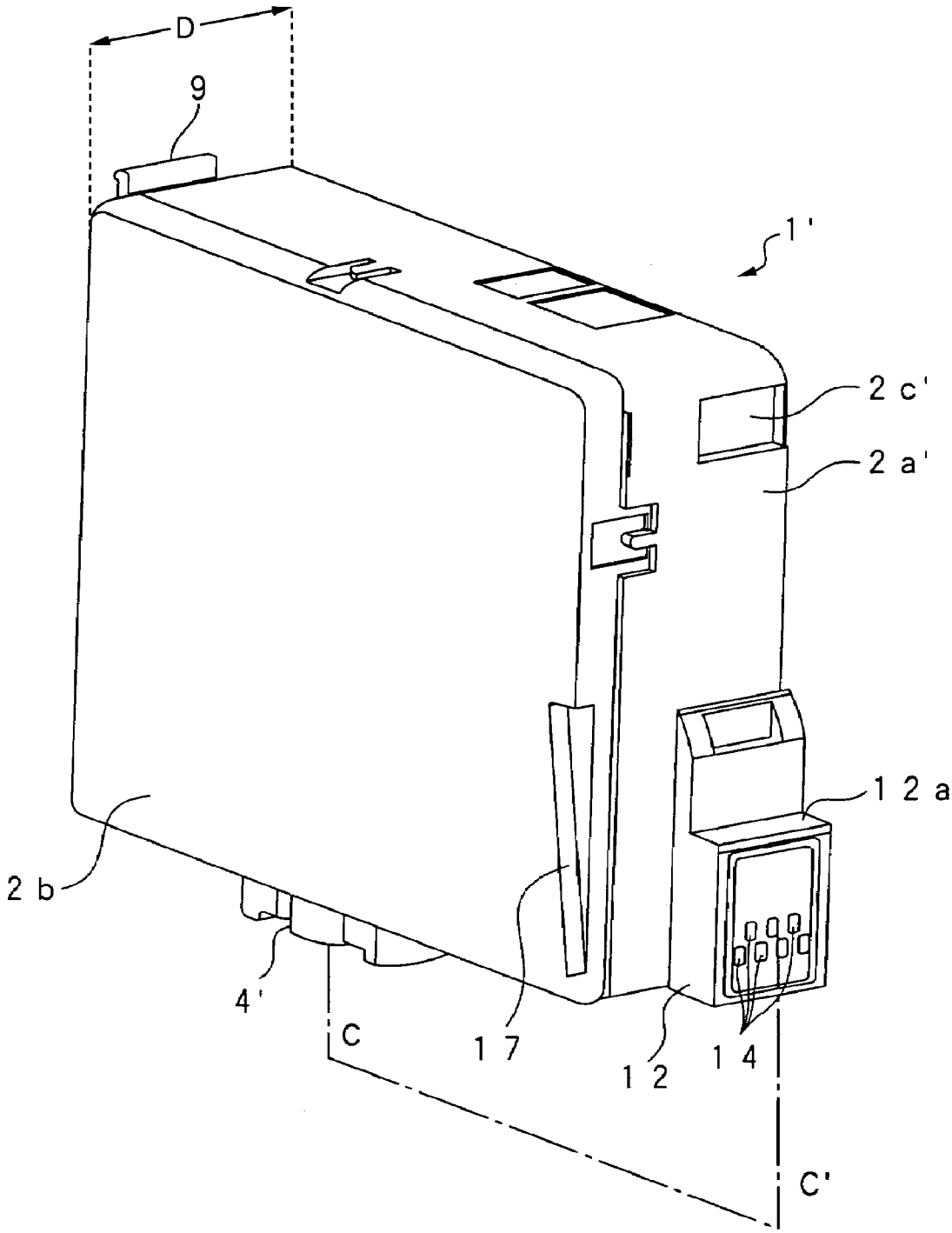
FIG. 13 is a perspective view showing a modification of the ink cartridge in accordance with one embodiment of this invention.

FIG. 13 shows another embodiment of an ink cartridge according to this invention. Although the container body 2*a* of this ink cartridge 1' differs in depth D and therefore in storage capacity from that of the aforesaid ink cartridge 1, the other structures such as the lid body 2*b* of the ink cartridge 1' have the same configuration as those corresponding structures of the aforesaid ink cartridge 1. Taking this difference in ink cartridge width into account, the projecting portion 12 is formed at a position offset in the direction of width to one side of a container body 2*a*'. The widthwise center of the electrode group 14 is suitably disposed so as to be positioned on a line C' parallel to a central axis C of an ink supply port 4' as in the aforesaid ink cartridge 1 (the line C' corresponding to a line obtained by projecting the central axis C perpendicularly onto the surface on which the electrodes 14 are formed).

Again, it will be appreciated that in the aforesaid embodiment, the mounting operation is effective because it employs linear movement of the ink cartridge. When the projecting portion 12 is positioned first, and then the ink cartridge is mounted by rotating the lever 9 with the projecting portion 12 serving as a fulcrum, the lower end 40*b* of the elastic piece 40 still abuts the flat surface 12*a* of the projecting portion 12. Then, with this abutment region serving as a rotation center, in the widthwise direction, the near side is regulated by the width direction regulating projecting portion 34, and the back side is regulated by the guide groove 39. By virtue of the precise control of the position of the ink cartridge, the electrodes 14 establish a proper electrically conductive relationship with the elastic contacts 41 without substantial rubbing.

A further benefit of this invention is that the ink supply port 4 is located on the lever 9 side at a position spaced apart from the projecting portion 12, which serves as a rotation fulcrum. Owing to this arrangement, during cartridge mounting and removal the ink supply port 4 moves as parallel as possible to the axis of the ink supply needle 36, thus preventing the generation of undesirable forces that would tend to deform undesirably the elastic seal member 6*a* disposed in the ink supply port 4.

Next, the structures of an ink cartridge according to a second embodiment of the present invention, and a carriage adapted for use with the ink cartridge of the second embodiment will be discussed.

Figure 14A:
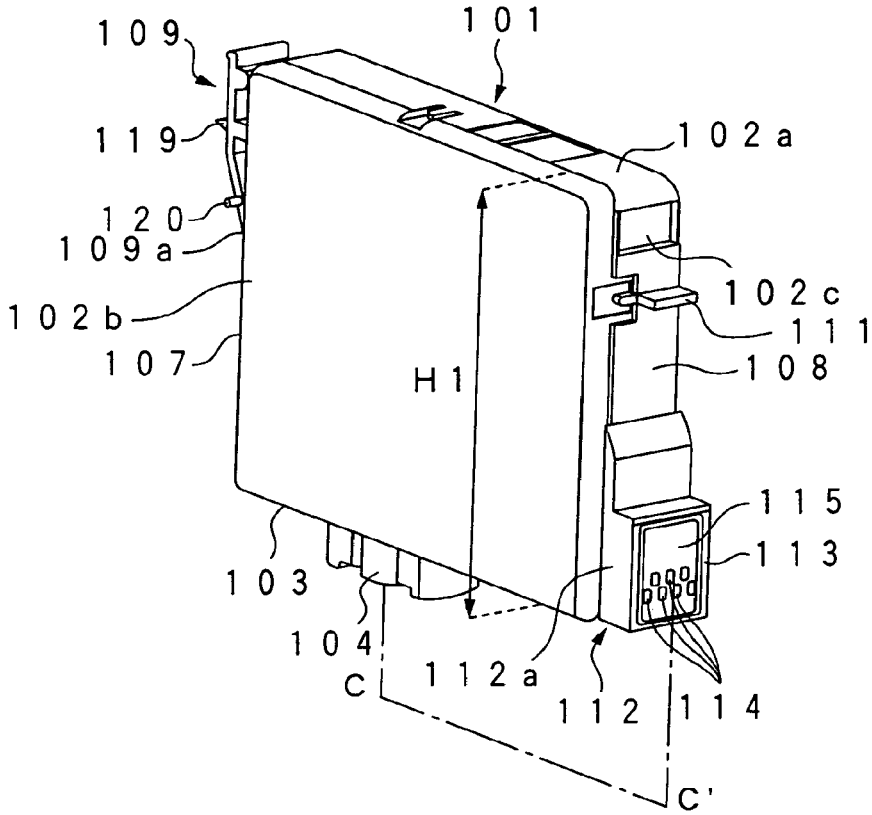
FIGS. 14A-14H are perspective views showing an ink cartridge in accordance with a second embodiment of this invention.
Figure 14B:
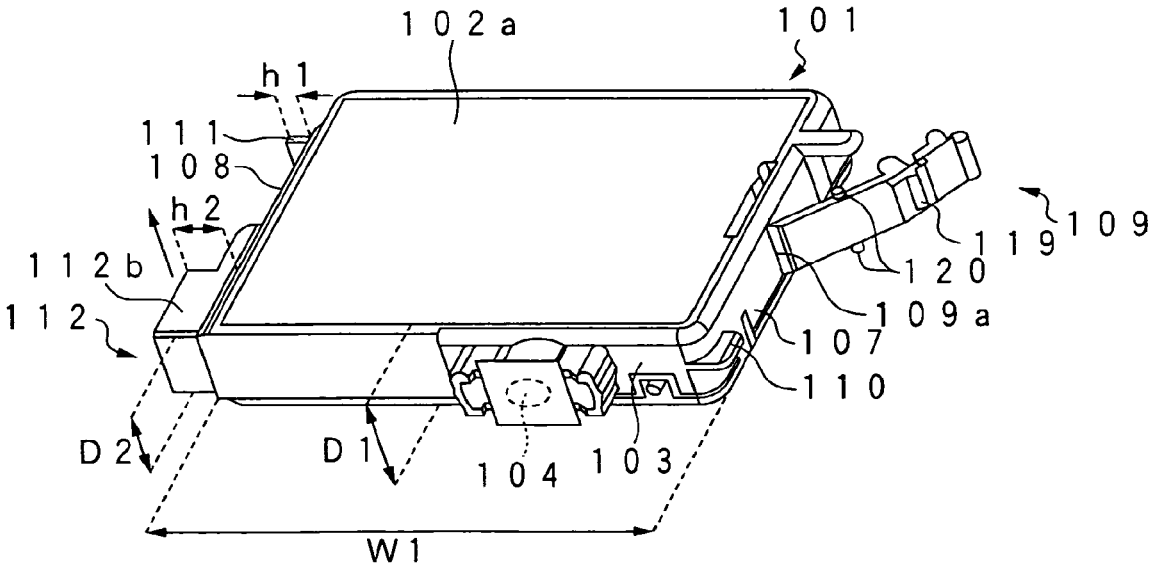

FIGS. 14A and 14B each show a second embodiment of an ink cartridge according to this invention. The ink cartridge 101 is constructed in a manner substantially similar to the first embodiment. That is, the ink cartridge 101 includes a flat container including a container body 102*a* and a lid body 102*b* (which also could be referred to as first and second sides), and an ink supply port 104 that is provided on a wall surface (the bottom wall) 103 of the container body 102*a* and that engages an ink supply needle, configuring a flow path forming member of a recording head, for supplying ink to the recording head.

In more detail, the ink cartridge 101 is dimensioned such that the width W1 in the direction perpendicular to the direction in which a plurality of cartridges are arrayed is the longest, the cartridge height H1 is slightly shorter than the width W1, and the thickness (depth) D1 in the direction parallel to the arraying direction of the cartridges is set at about ⅕ of the height H1. This dimensioning of the ink cartridge 101 is meant to make the entire length in the arraying direction as minimal as possible when a plurality of ink cartridges are arrayed.

In addition, the ink supply port 104 is disposed at a position offset from the central plane of the cartridge toward one side, in the longitudinal direction, (i.e. on the side of a wall surface (side wall) formed with a lever 109 serving as a retaining member). The ink cartridge 1 also has a top surface (top wall). The ink supply port 104 is configured to define an ink flow path passing through the bottom wall 103 and to engage the ink supply needle for fluid communication via the ink flow path between the ink supply needle and an ink chamber of the ink cartridge 101. In this embodiment, a part of the ink supply port 104 is protruded outward from the wall surface 103 of the container body 102*a* as illustrated, but the ink supply port according to the present invention is not limited to this design.

As discussed with reference to FIG. 2 in the first embodiment, the ink cartridge 101 includes a valve body 6 normally kept closed by a spring 5, which exerts a biasing force on the valve body. The valve body 6 and spring 5 are arranged at the leading end side of the ink supply port 104. An annular elastic seal member 6*a* for sealingly engaging the flow path forming member (not shown) is loaded on the outer side, i.e. the leading end side, of the valve body 6.

With continued reference to FIGS. 14A and 14B, the lever 109 serving as the elastically deformable retaining member is formed on a wall surface 107 on the side closer to the ink supply port 104 of the two opposing wall surfaces 107, 108 that are substantially orthogonal to the wall surface 103 having the ink supply port 104. The lever 109 is provided on the wall surface 107 of the container body 2*a* so as to have a fulcrum, or pivot point, 109*a* on the lower portion of the lever 109 and to be elastically deformable. A claw portion, or projection, 119 serving as an engaging portion engageable with and disengageable from a suitably-shaped engaging portion 136 of the carriage projects outward above the fulcrum 109*a*. A pair of projections 120 is formed between the fulcrum 109*a* and the claw portion 119, so as to laterally project out from a lever body, and preferably one such projection is formed on each side of the lever body. A projecting portion 110 having a guide function and which prevents widthwise shifting of the cartridge is formed on the lower portion of the wall surface 107 below the lever 109.

A lever receptacle portion, a projecting portion 111 in this embodiment, is formed on the other wall surface 108 at a location where a mounting lever of the carriage (discussed in detail below) can depress the lever receptacle portion. A projecting portion 112 having surfaces, e.g. flat face surface 113 and flat side surfaces 112*a* and 112*b*, is formed on a lower end portion of the other wall surface 108 below the projecting portion 111. The projecting portion 112 is arranged to protrude from the wall surface 108 of the cartridge, and to be restricted at its both sides by the recording apparatus when mounted thereon. The surfaces 113, 112*a* and 112*b* of the projecting portion 112 are parallel to the insertion direction of the ink cartridge into the recording apparatus (the axial direction of the ink supply port). A plurality of electrodes 114 for making electrical contact with an elastic contact member 140 of the recording apparatus are formed on this surface 113 of the projecting portion 112. In this embodiment, the electrodes 114 are formed in two staggered row, an upper row and a lower row, such that a plurality of the electrodes 114 are horizontally arranged in each row along a line.

The flat side surfaces 112*a*, 112*b* of the first projecting portion 112 and the receiving structure of the printing apparatus can be dimensioned so that there is a clearance space between these structures, since this may help facilitate mounting of the ink cartridge 101 in the carriage of the recording apparatus. This clearance can be made of any suitable size, as long as it is not so great that the ink cartridge 101 can shift in position to an extent such that electrical contact between the electrodes on the ink cartridge and the contacts on the printing apparatus is lost (that is, too large a clearance will lead to misalignment).

Figure 14C:
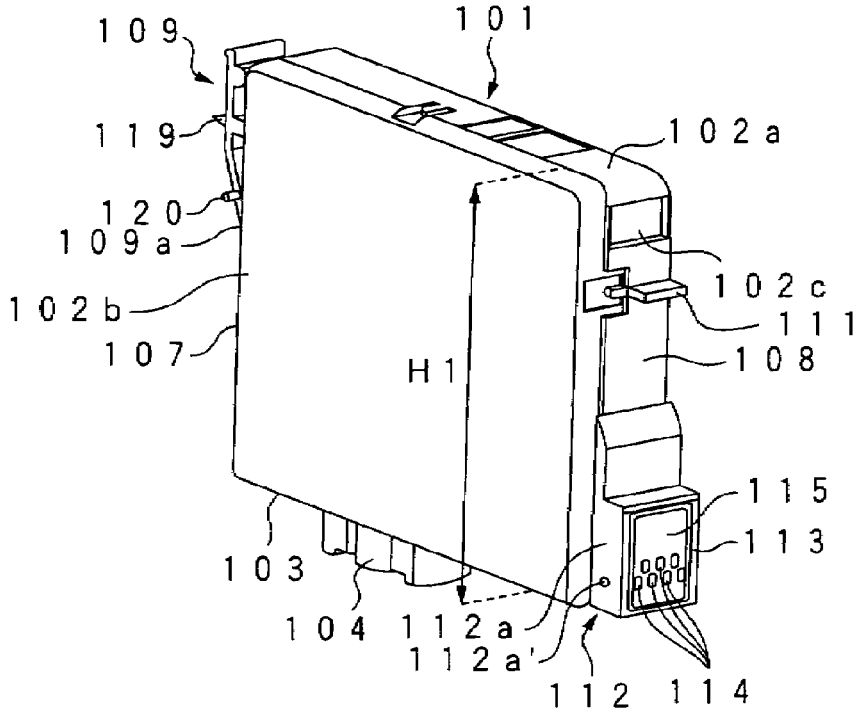
Figure 14D:
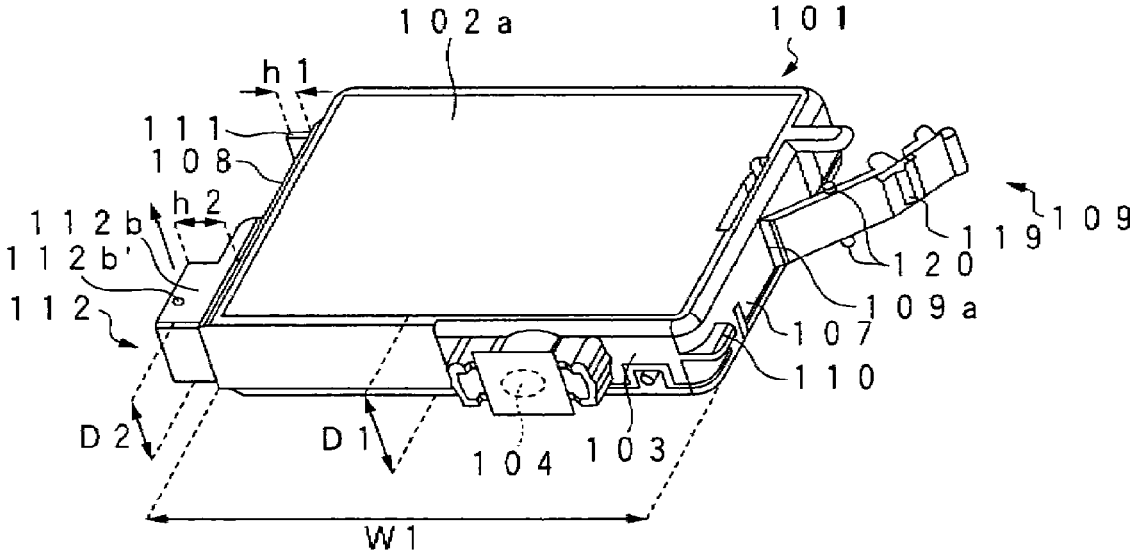
Figure 14E:
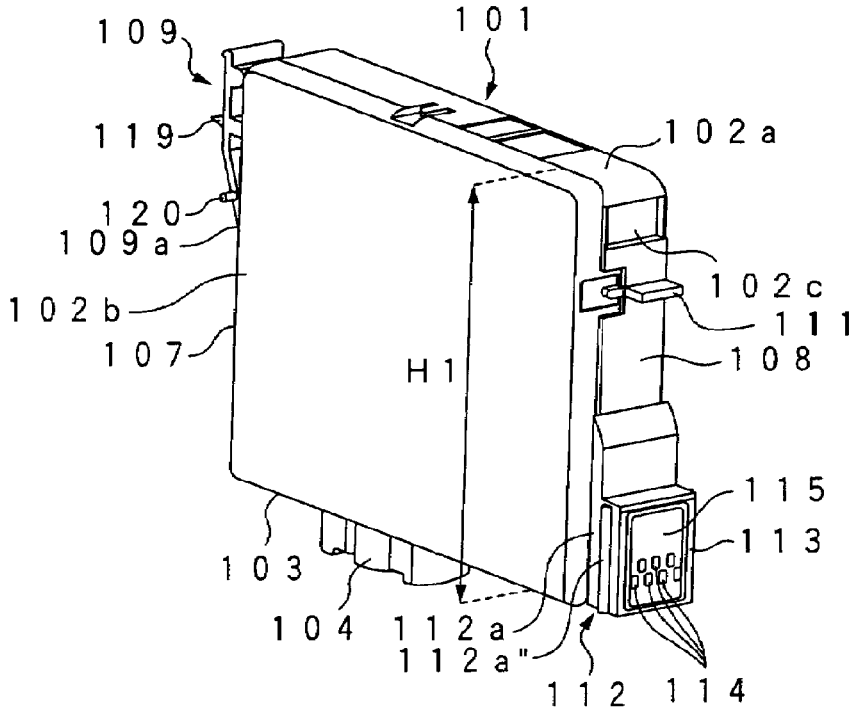
Figure 14F:
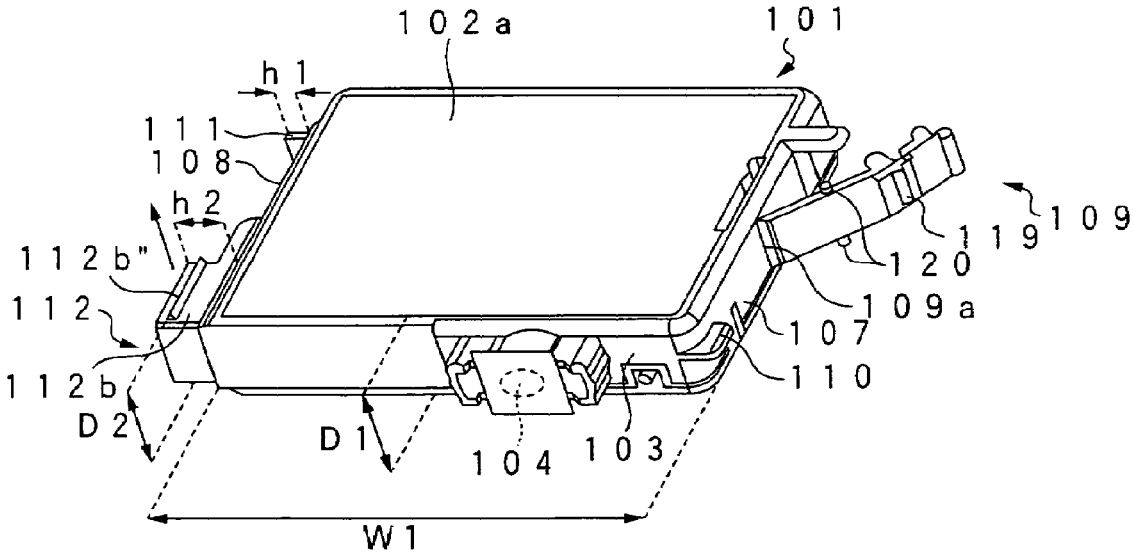
Figure 14G:
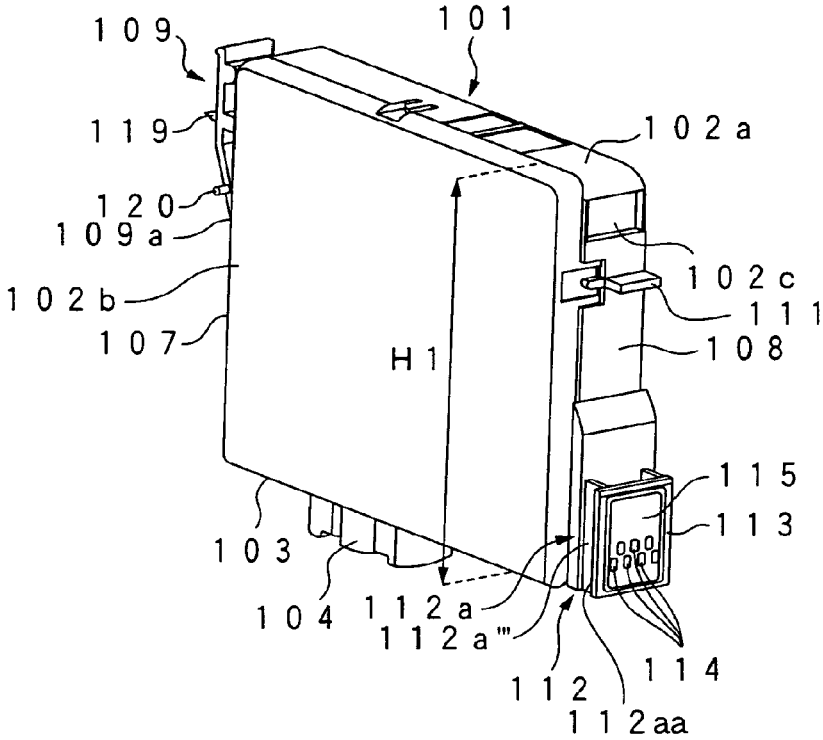
Figure 14H:
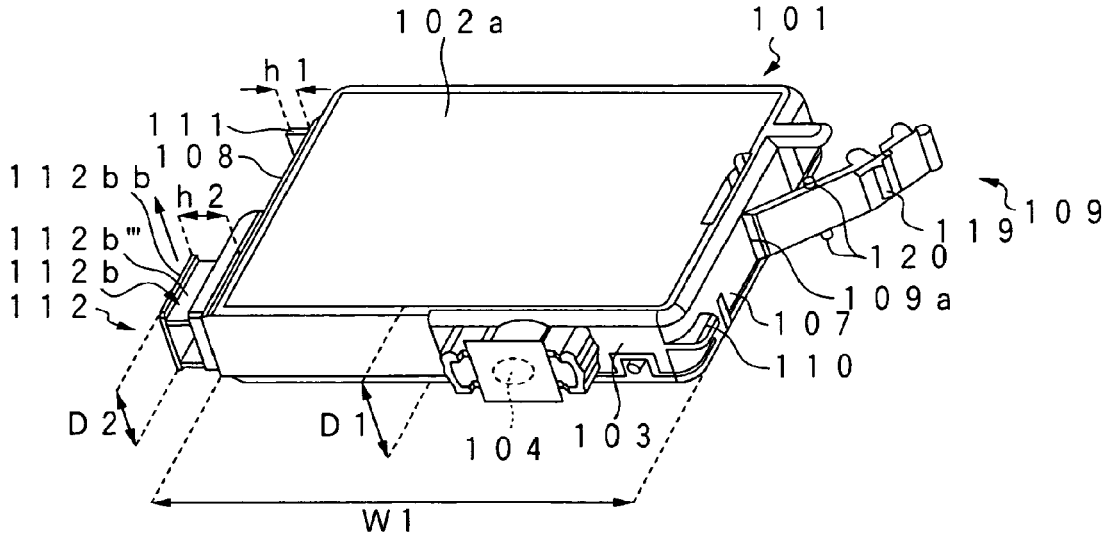

Optionally, as shown in FIGS. 14C-D, the flat side surfaces 112*a*, 112*b* of projecting portion 112 can be provided with surface structure shaped in a manner which further facilitates accurate and secure mounting of the ink cartridge 101. By way of non-limiting example, sides 112*a* and 112*b* can have, respectively, suitably-shaped projections 112*a*', 112*b*' formed thereon. As shown in FIGS. 14C-D, each of these projections 112*a*', 112*b*', could be hemispherical in shape. Any other suitable shape, such as oval or rectangular, also could be used. By way of further alternative, sides 112*a*, 112*b* can have raised ribs or ridges 112*a*", 112*b*" extending alone their length, as depicted in FIG. 14E-F, those ribs or ridges can be triangular in shape. Any other suitable cross-sectional shape, such as hemispherical, oval or rectangular, also could be used. And, further, as shown in FIGS. 14G-H, the projecting portion 112 could be formed with recesses or grooves 112*a*"', 112*b*"' formed on the sides 112*a*, 112*b*. As above, any suitable recess shape, such as hemispherical, oval or rectangular, could be employed.

The carriage of the printer apparatus (not shown) may be constructed to accommodate the projections, ridges or grooves formed on the projecting portion 112 of the ink cartridge 101, as discussed above. For example, the projections 112*a*', 112*b*' and ridges 112*a*", 112*b*" can be received in suitably-dimensioned slots (not shown), and the grooves 112*a*"', 112*b*"' can engage with suitably dimensioned projections or ribs (not shown). Alternatively, a distance between the side surfaces 112*a* and 112*b* of the lower projecting portion 112 may be set slightly smaller than D2 so that a distance between apices of the projections 112*a*' and 112*b*' (the ridges 112*a*" and 112*b*") is set equal to D2. FIGS. 14D and 14F show the latter case in which a distance between apices of the projections 112*a*' and 112*b*' (the ridges 112*a*" and 112*b*") is set equal to D2.

Again, it will be appreciated that some clearance space may be provided between the printing apparatus structure and the side portions 112*a*, 112*b*, projections 112*a*', 112*b*', ridges 112*a*", 112*b*", or grooves 112*a*"', 112*b*"' of the ink cartridge 101, as long as this clearance allows for proper electrical contact between the electrodes on the ink cartridge and the contacts on the printing apparatus (too large a clearance will lead to misalignment).

Since the wall surface 108 is narrow in the widthwise (thickness) direction, the electrodes 114, each having a vertically elongated shape to ensure a required area, are disposed vertically and laterally in plural columns and rows, whereby the electrodes 114 can be disposed concentrically at a region that is in the vicinity of the surfaces 112*a* and 112*b* serving as a right-and-left-direction positioning portion of the ink cartridge 101 and that is precisely controlled in position with high accuracy. This arrangement enhances the reliable contact between the electrodes 114 and the elastic contact members 140.

Much like the circuit board 15 and the electrodes 14 formed thereon as discussed with reference to FIG. 3A, electrodes 114 are formed on the front surface of a circuit board 115 and are disposed by fixing the circuit board 115 to the surface 113 of the projecting portion 112. In addition, as shown in FIG. 3B, a memory unit 18 such as a readable-writable semiconductor memory element, such as an EEPROM, storing information about the ink contained in the ink container, is mounted on the rear surface of the circuit board 115, and is electrically connected to at least some of the electrodes 114.

The projecting portion 111 is arranged to receive an applied downward positioning exerted on the ink cartridge 101 at a location that is not largely offset from (that is substantially located on) an imaginary surface extending upward from the surface of the circuit board 115 on which the plurality of electrodes 114 are disposed. This arrangement eliminates the positioning error of the electrodes 114, which could otherwise because caused by torsion of the ink cartridge during mounting of the ink cartridge, and realizes the precise contact between the electrodes 114 and the elastic contact members 140.

Figure 15:
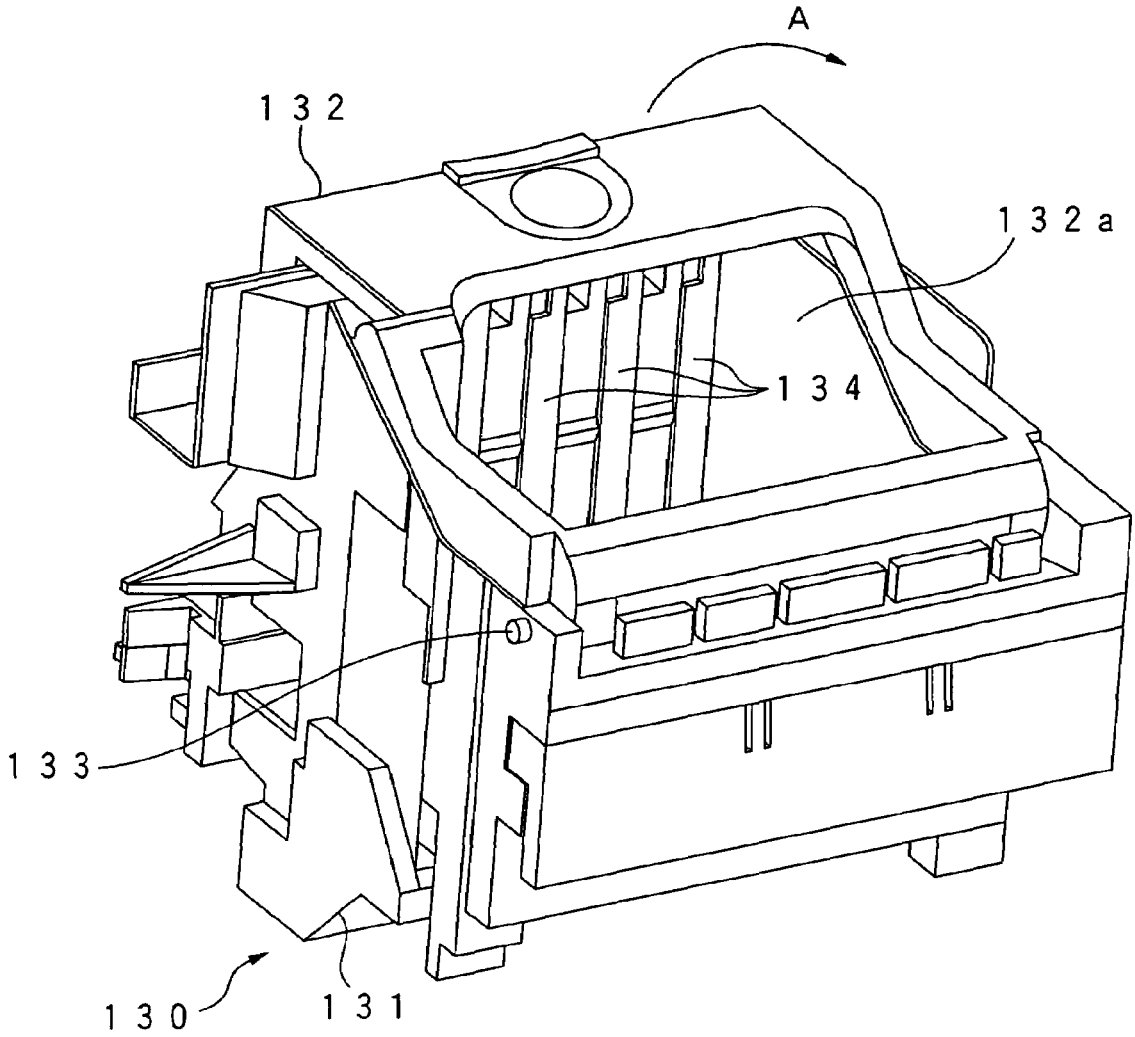
FIG. 15 is a perspective view showing the exterior of an embodiment of a carriage of a recording apparatus, which is suitable for receiving the ink cartridge of the second embodiment.
Figure 16:
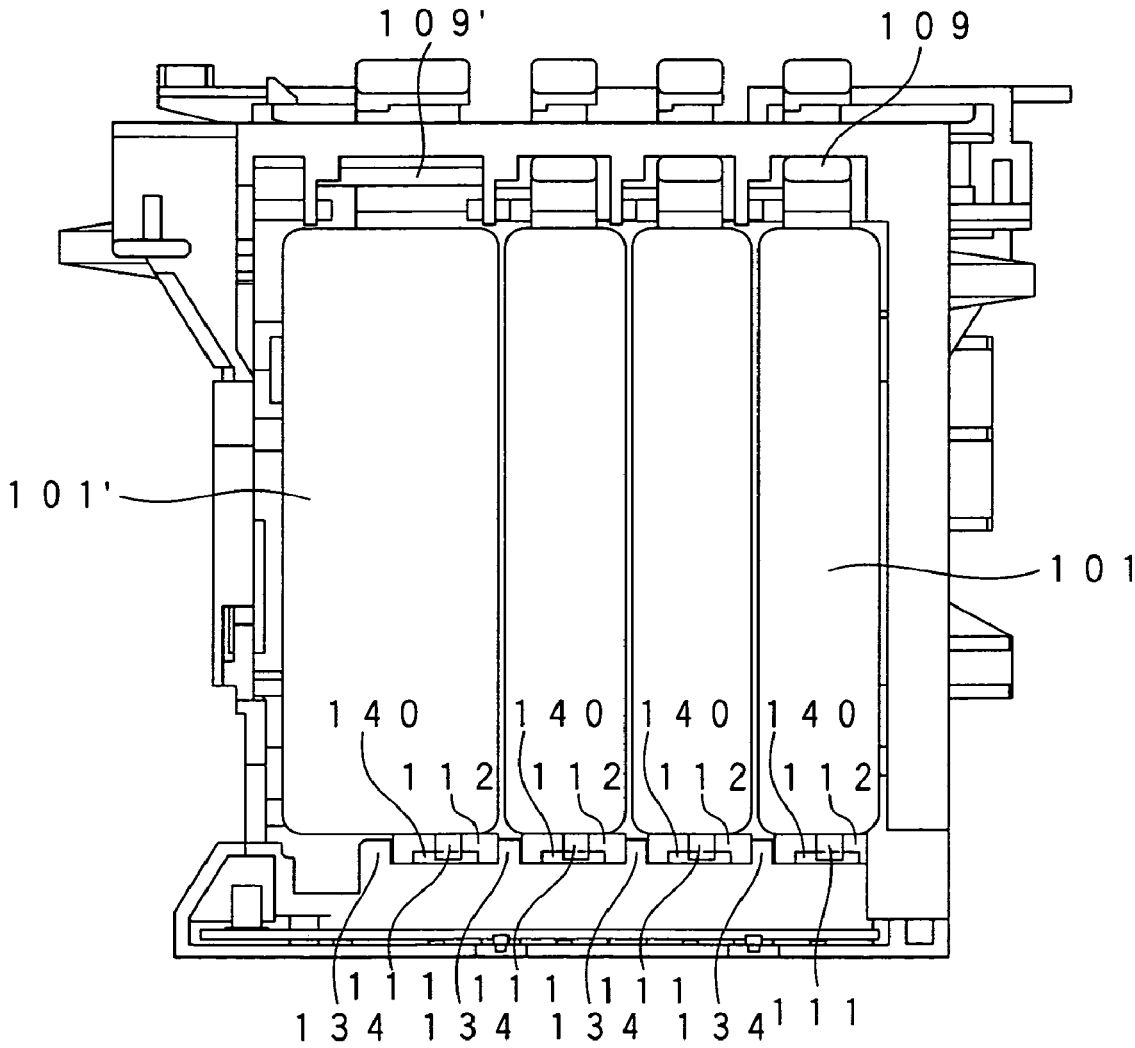
FIG. 16 is a top plan view, showing the ink cartridge of the second embodiment mounted on the carriage with a mounting lever being removed.
Figure 17:
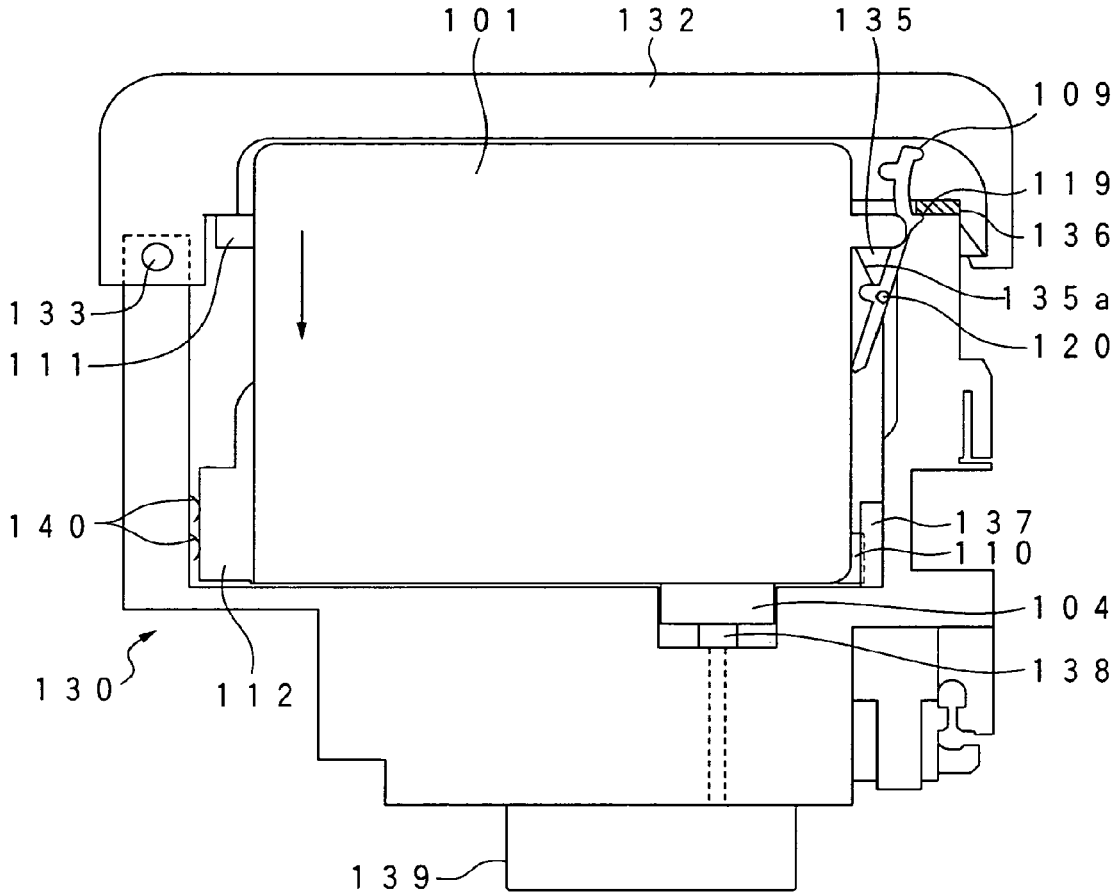
FIG. 17 is a side elevational view showing the ink cartridge of the second embodiment mounted on the carriage and fixed in place by the mounting lever.

FIGS. 15 to 17 show the carriage structure of an embodiment of a recording apparatus suitable for receiving the aforesaid ink cartridge. FIG. 15 shows the external appearance of the carriage, and FIGS. 16 and 17 show a state in which the ink cartridges are properly mounted. A carriage 130 is configured by a cartridge holder main portion 131 and a mounting lever 132. The cartridge holder main portion 131 is formed in substantially a box shape such that a plurality of ink cartridges can be inserted therein from above. The mounting lever 132 is formed substantially as a frame structure having an opening at its upper portion. The mounting lever 132 is pivotably supported by a shaft 133 (separate hinges also could be used) on the holder main body portion 131 such that one end side of the holder main body portion 131, i.e. a side facing the projecting portions 111 of the cartridges 101, is located at a lower portion.

The cartridge holder main body 131 is partitioned by ribs 134 so as to accommodate a plurality of ink cartridges. A wall surface opposite the lever 109 of the ink cartridge 101 is formed with grooves 135 for receiving and engaging the projections 120 located on both sides of the lever 109, and an engaging portion 136 (a recessed portion in this embodiment) for receiving and engaging the claw portion 119.

The groove 135 is formed with an inclined surface 135*a*, the upper portion of which widens toward the cartridge side. During ink cartridge loading, the inclined surface 135*a* cooperates with the ink cartridge as follows. At the initial stage of loading the ink cartridge, the projections 120 at each side assuredly contact this inclined surface 135*a* by virtue of the inclined surface's wide mouth, regardless how far open the lever 109 is. Also, once the ink cartridge has been mounted, the inclined surface 135*a* forces the lever 109 to pivot open toward the wall surface side of the carriage i.e. toward the outside of the ink cartridge 101. Particularly when the projections 120 are formed on both sides, the lever 109 can be securely guided to a preferred position, even when the lever 109 is twisted.

Also, a second groove 137 is formed below the groove 135. This groove 137 receives and engages the guide projecting portion 110 of the ink cartridge just before the end of loading, and prevents the ink cartridge from shifting in the width direction as mounting concludes. In addition, in this embodiment, the guide projecting portion 110 and the groove 137 are provided on the ink cartridge and on the ink cartridge storage portion, respectively, in order to increase the volume of the ink cartridge as much as possible. It will be appreciated that the same benefits in guiding the ink cartridge can be obtained if the groove 137 is formed in the ink cartridge and the projecting portion 110 is formed on the ink cartridge storage portion.

The other wall surface of the cartridge holder is formed, at each cartridge storage region, with elastic contacts 140 that electrically contact electrodes 114 formed on the circuit board 115 fixed to the projecting portion 112 when the mounting lever 132 is closed to a predetermined position.

Figure 18:
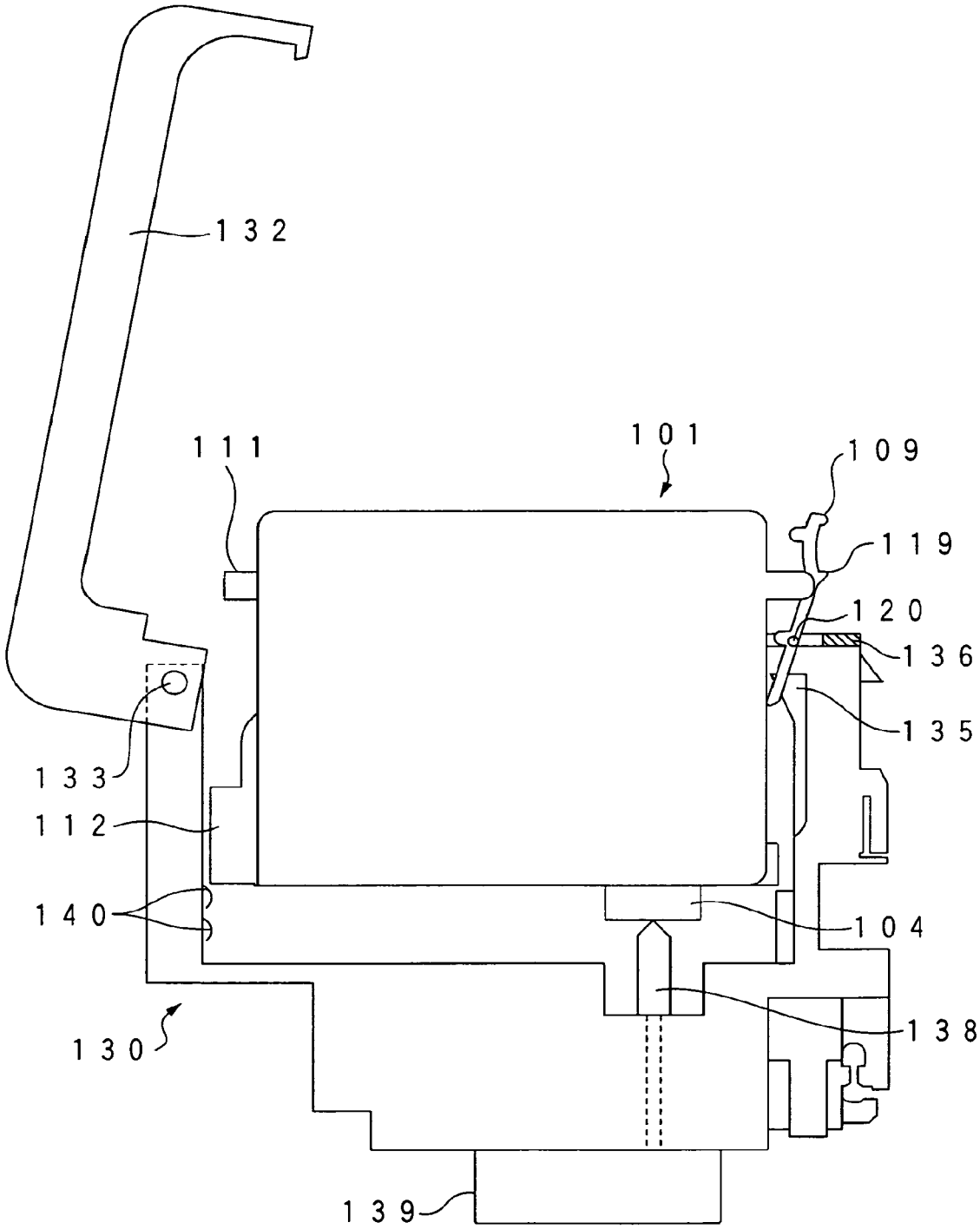
FIG. 18 is a side elevational view showing the ink cartridge of the second embodiment placed into the carriage with the ink supply port abutting the ink supply needle.
Figure 19:
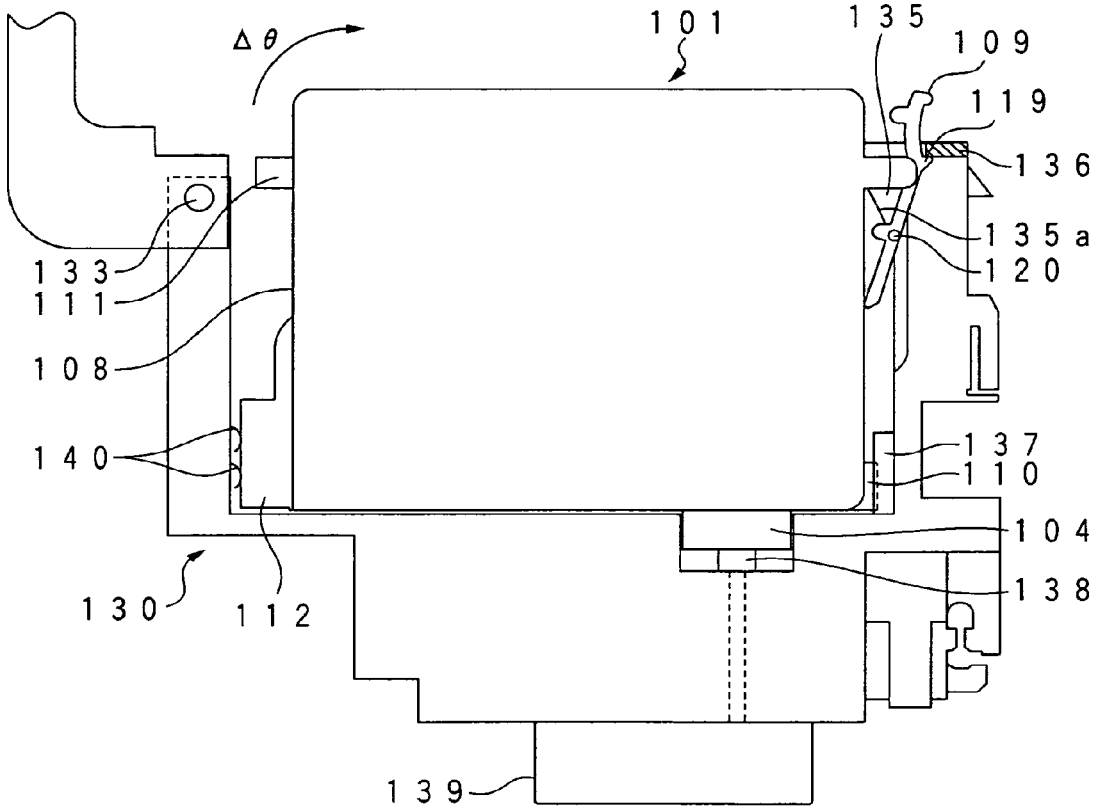
FIG. 19 is a side elevational view showing the ink cartridge of the second embodiment pushed into a position at which the ink cartridge is retained by a lever, and the ink cartridge is released from the mounting lever.

In this embodiment, when the ink cartridge 101 is aligned in position with a predetermined region of the carriage 130, as shown in FIG. 18, the ink cartridge 101 is stopped at a predetermined position at which the ink supply port 104 of the ink cartridge 101 abuts the ink supply needle 138 of the carriage 130. When the ink cartridge 101 is moved further downward in this orientation, as shown in FIG. 19, the projections 120 on each side of the lever 109 of the ink cartridge 101 contact the inclined surface 135*a* forming the widening portion. Also, the guide projecting portion 110 enters the groove 137. Also, the ink supply needle 138, serving as an ink supply member communicating with the recording head 139, enters the ink supply port 104 to raise the valve body 6 against the action of the spring 5.

When the ink cartridge 101 is thus pushed into a predetermined position (FIG. 19), the lever 109 is rotated about a region which serves as a pivot point or a fulcrum to a predetermined outward position by the action of the inclined surface 135*a* of the carriage 130, and the claw 119 is moved against the engaging portion 136 under a strong applied elastic force. In this state, since the other side of the ink cartridge 101, i.e. a side where the wall 108 exists, is free to some extent, the ink cartridge 101 pressed by the spring 5 may rotate slightly by $\Delta\theta$ about the fulcrum, i.e. a contact point of the claw 119 with the engagement portion 136.

Figure 20:
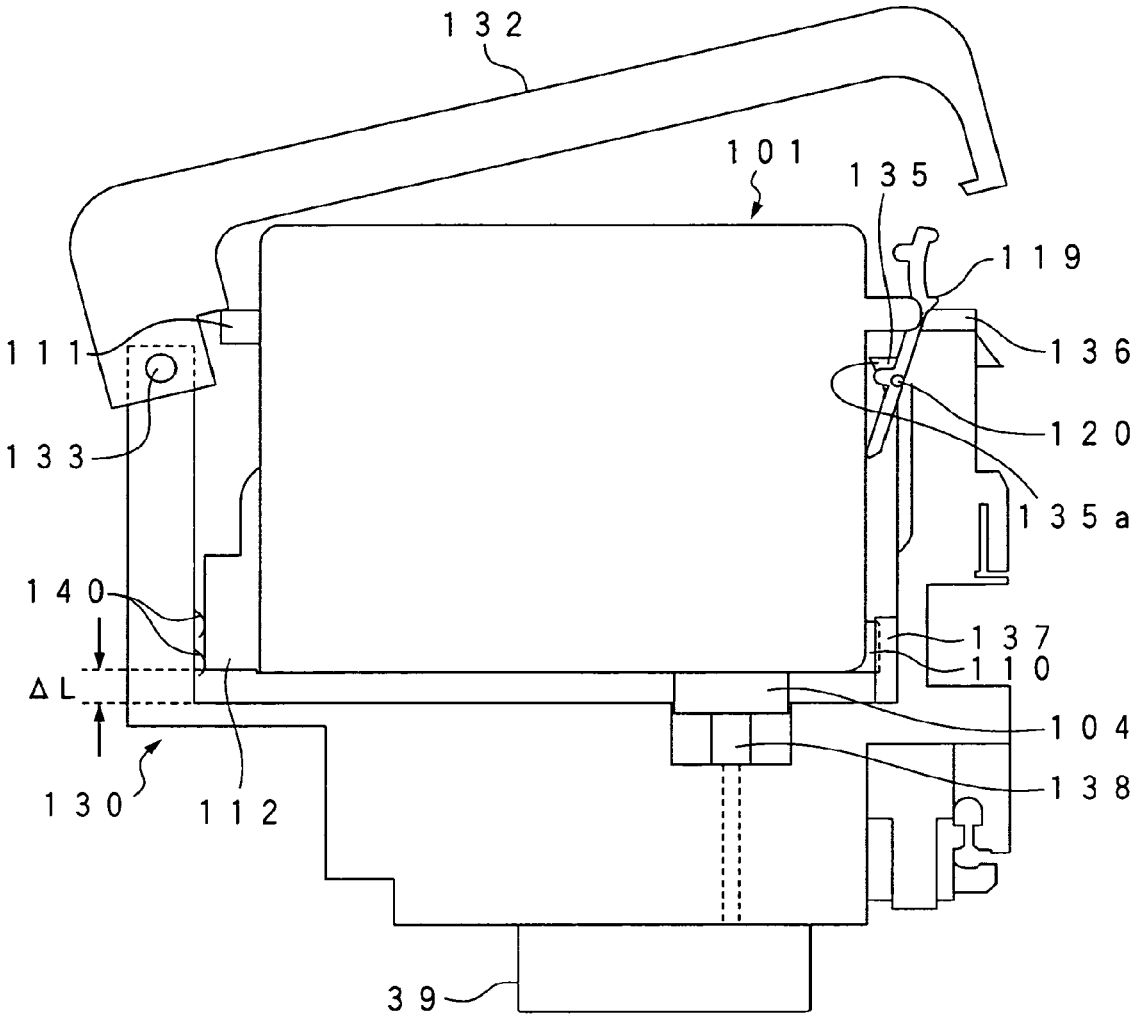
FIG. 20 is a side elevational view showing a state in which the ink cartridge of the second embodiment engages the ink supply needle and the lever is disengaged from the carriage.

In this state, when the mounting lever 132 is rotated and closed, as shown in FIG. 20, the pivotably supported side of the mounting lever 132 moves downwardly to a predetermined position and then depresses the projecting portion 111 so that the electrodes 114 and the elastic contacts 140 establish a proper electrically conductive relation as shown in FIG. 17. At the same time, in this condition, both sides (both side surfaces) of the lower projecting portion 112 are restricted by ribs 134 disposed on the carriage as shown in FIG. 16 (and, if the side surfaces have projections, ribs or grooves, by the associated structure of the carriage of the recording apparatus), and movement in the orthogonal direction, i.e. the vertical direction in this embodiment, is restricted by the mounting lever 132 via the projecting portion 111. Consequently, precise and reliable contact can be maintained between the plurality of electrodes 114 and the plurality of elastic contacts 140. In addition, in a case in which the side surfaces of the lower projecting portion 112 have projections, if a distance between apices of the projections 112*a*' and 112*b*' is set equal to D2 (that is, a distance between the side surfaces of the lower projecting portion 112 is set slightly smaller than D2) as shown in FIG. 14D, flat surfaces of the ribs 134 as shown in FIG. 16 can cooperate with and restrict the projections 112*a*' and 112*b*'. That is, the flat surfaces of the ribs 134 as shown in FIG. 16 without having suitably-dimensioned slots can serve as the associated structure of the carriage of the recording apparatus in this modification. Similarly, in a case in which the side surfaces of the lower projecting portion 112 have ribs, if a distance between apices of the ribs 112*a*" and 112*b*" is set equal to D2 (that is, a distance between the side surfaces of the lower projecting portion 112 is set slightly smaller than D2) as shown in FIG. 14F, the flat surfaces of the ribs 134 as shown in FIG. 16 can cooperate with and restrict the ribs 112*a*" and 112*b*". That is, the flat surfaces of the ribs 134 as shown in FIG. 16 without having suitably-dimensioned slots can serve as the associated structure of the carriage of the recording apparatus in this modification. In a case in which the side surfaces of the lower projecting portion 112 have grooves, the flat surfaces of the ribs 134 as shown in FIG. 16 can cooperate with and restrict parts 112*aa* and 112*bb* of the side surfaces 112*a* and 112*b*, the parts 112*aa* and 112*bb* being adjacent to the grooves 112*a*'" and 112*b*'" and having a distance D2 therebeween as shown in FIG. 14H. That is, the flat surfaces of the ribs 134 as shown in FIG. 16 without having suitably-dimensioned projections or ribs can serve as the associated structure of the carriage of the recording apparatus in this modification.

On the other hand, when the ink cartridge 101 is to be removed from the carriage 130, the mounting lever 132 is released from the main body portion 131 as shown in FIG. 19. This action puts the other side of the ink cartridge 101, i.e. the side where the wall 108 exists, into a slightly free state in the vertical direction since the projecting portion 111 on the wall 108 is released from the depression of the mounting lever 132.

In this state, the ink cartridge 101 is held, for example, with the operator's forefinger on the lever 109 and thumb on the pinching recessed portion 102*c*, and the lever 109 is squeezed and deformed so as to be moved toward the cartridge side (other fingers also could be used to grasp the ink cartridge 101). As the lever 109 is elastically deformed, the claw 119 is disengaged from the engaging portion 136 of the holder main body portion 131. The ink cartridge, having lost the support formerly provided by the engaging portion 136, moves slightly upward by a distance $\Delta L$ in response to the biasing force exerted by the spring 5 (not shown) in the ink supply port 104, and the claw 119 on the lever 109 is displaced to a position outside the region of the engaging portion 136. At this stage, the ink cartridge 101 can be lifted upwardly and removed from the carriage 130.

Therefore, during replacement of one cartridge, other cartridges are also released from the depression of the mounting lever 132. That is, each one of the ink cartridges is rotated by a slight angle $\Delta\theta$ by being pressed by the spring 5 in each one of the ink supply ports 104, and the ink cartridges are again pressed and moved in the reverse direction by the mounting lever 132 when the mounting is complete. Consequently, the plurality of electrodes 114 are moved against respective contacts 140 to prevent a contact error that otherwise could be caused by dust and rust.

In a case where the ink cartridge is not properly mounted, i.e. in a state in which the projection 119 of the lever 109 does not engage with the engagement portion 136, if the user attempts to close the mounting lever 132, the mounting lever 132 collides with the cartridge 101 as shown in FIG. 20, so that the mounting lever 132 can not be moved to a position at which the lever 132 can be retained. That is, in a case where the projection 119 of the lever 109 is engaged with the engagement portion 136, the mounting lever 132 can be brought into engagement with the carriage by rotation of slight angle $\theta$, but in a case where the lever 109 is disengaged, the ink cartridge is lifted by $\Delta L$ and therefore the mounting lever 132 attempting to rotate the ink cartridge in this state causes a large shift in position of the ink cartridge with respect to the carriage, resulting in abutment of the ink cartridge wall surfaces 107 and 108 striking against the carriage. For this reason, the mounting lever 132 can not be moved with a normal depressing force. Consequently, the user notices the fact that the ink cartridge is not mounted in the proper position, and so remounts the ink cartridge by shifting it to a position where a click is heard or felt.

Figure 21A:
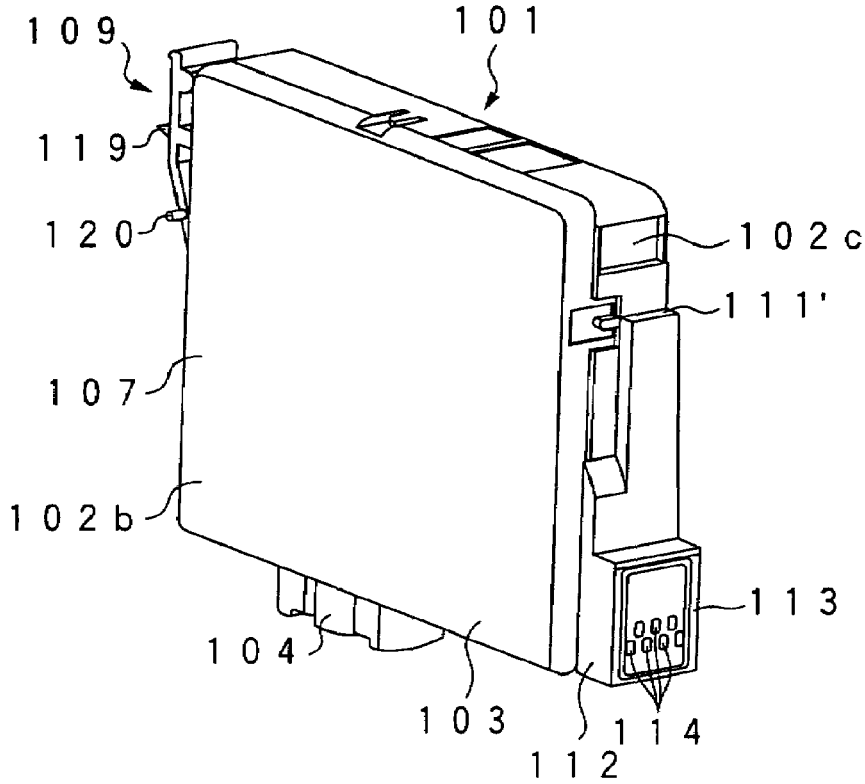
FIGS. 21A and 21B are perspective views showing modifications of the second embodiment.

In the aforementioned embodiment, the projecting portion 111, i.e. the lever receptacle portion to be pressed by the mounting lever 132 for holding the ink cartridge, is constructed as a separate member from the projecting portion 112 serving as the electrode forming portion, in order to save material and reduce the weight. However, as shown in FIG. 21A, the projecting portion 112 serving as the electrode forming portion can be constructed so that its upper surface 111' is located at a position where the upper surface 111' receives the pressure of the mounting lever 132, in order to provide the same effect.

Figure 21B:
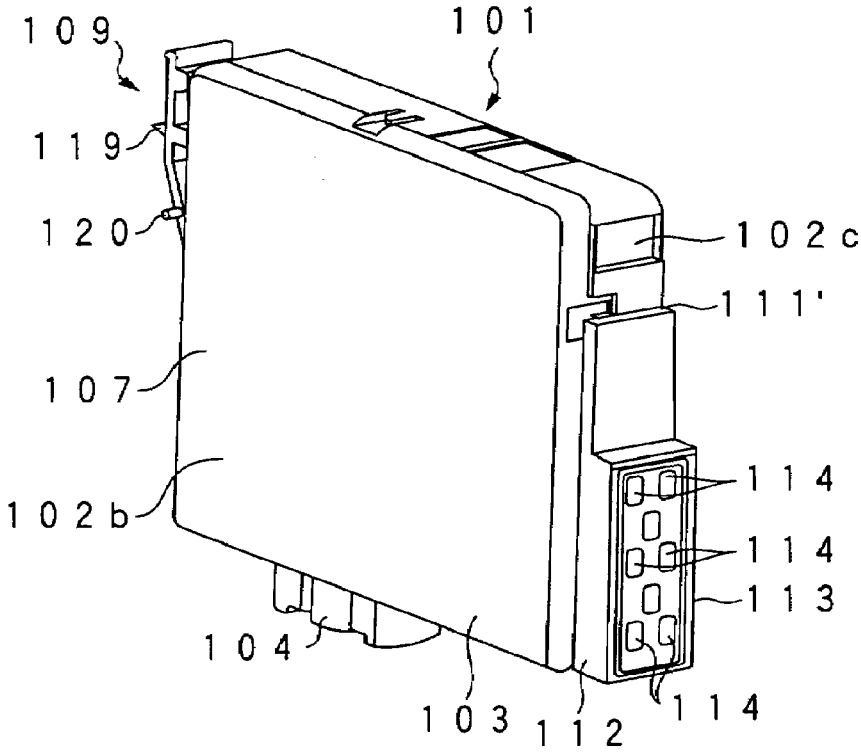
Figure 22A:
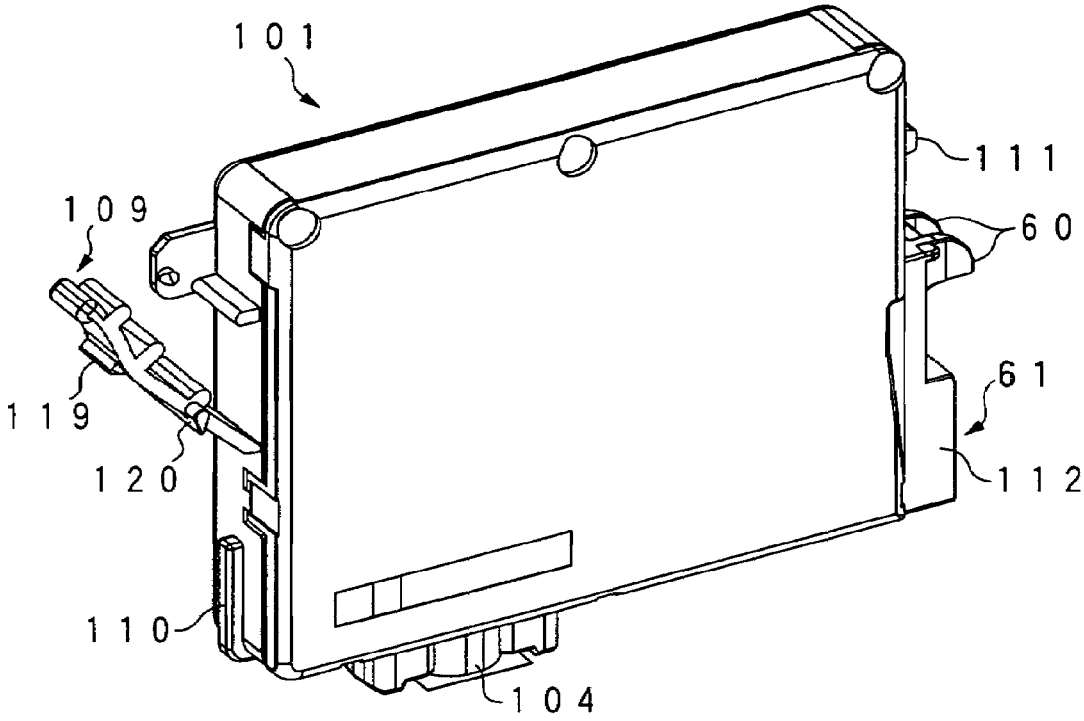
FIGS. 22A and 22B are perspective views showing a color ink cartridge in accordance with a third embodiment of this invention.
Figure 22B:
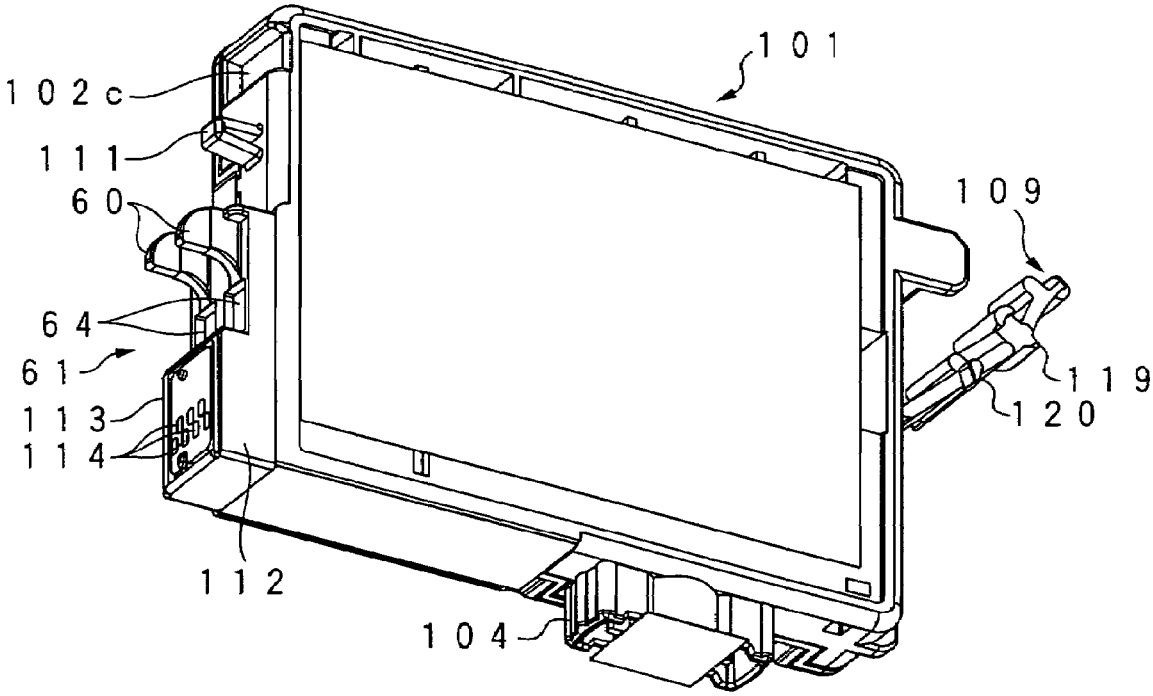
Figure 23A:
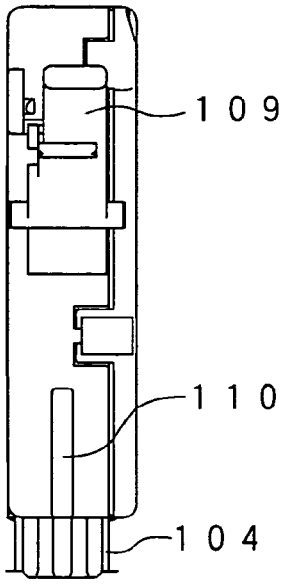
FIGS. 23A, 23B and 23C are side elevational views and a bottom plan view of the color ink cartridge of the third embodiment.
Figure 23B:
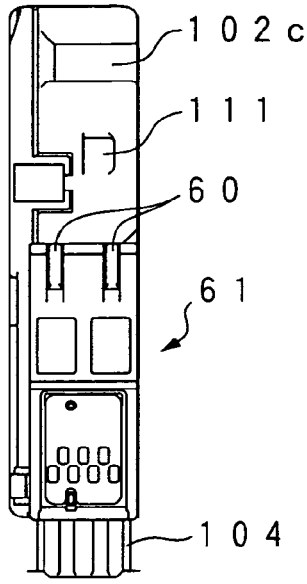
Figure 23C:
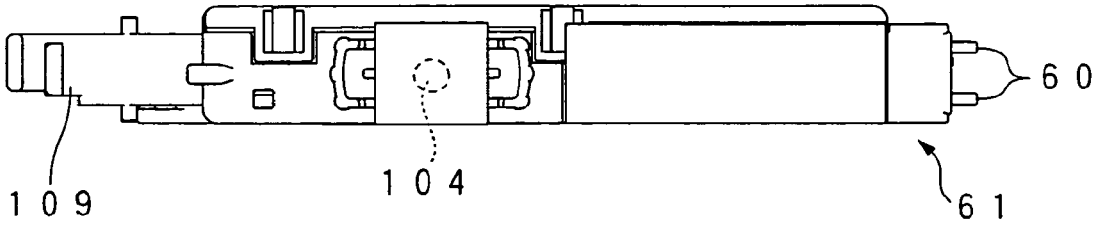
Figure 24A:
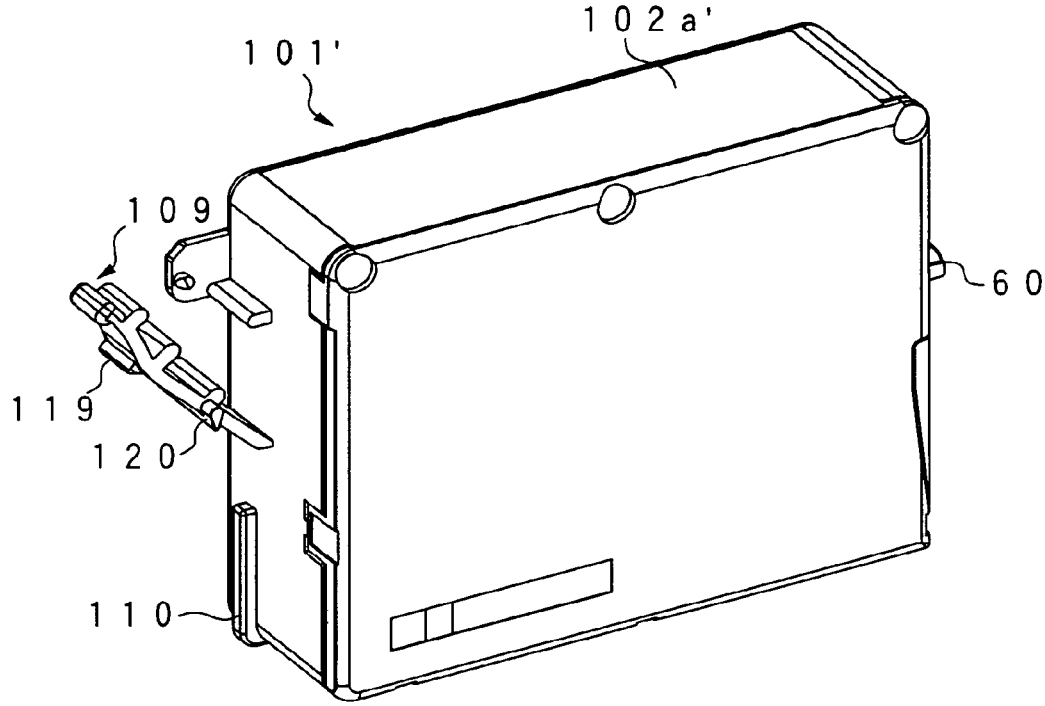
FIGS. 24A and 24B are perspective views showing a black ink cartridge in accordance with the third embodiment of this invention.
Figure 24B:
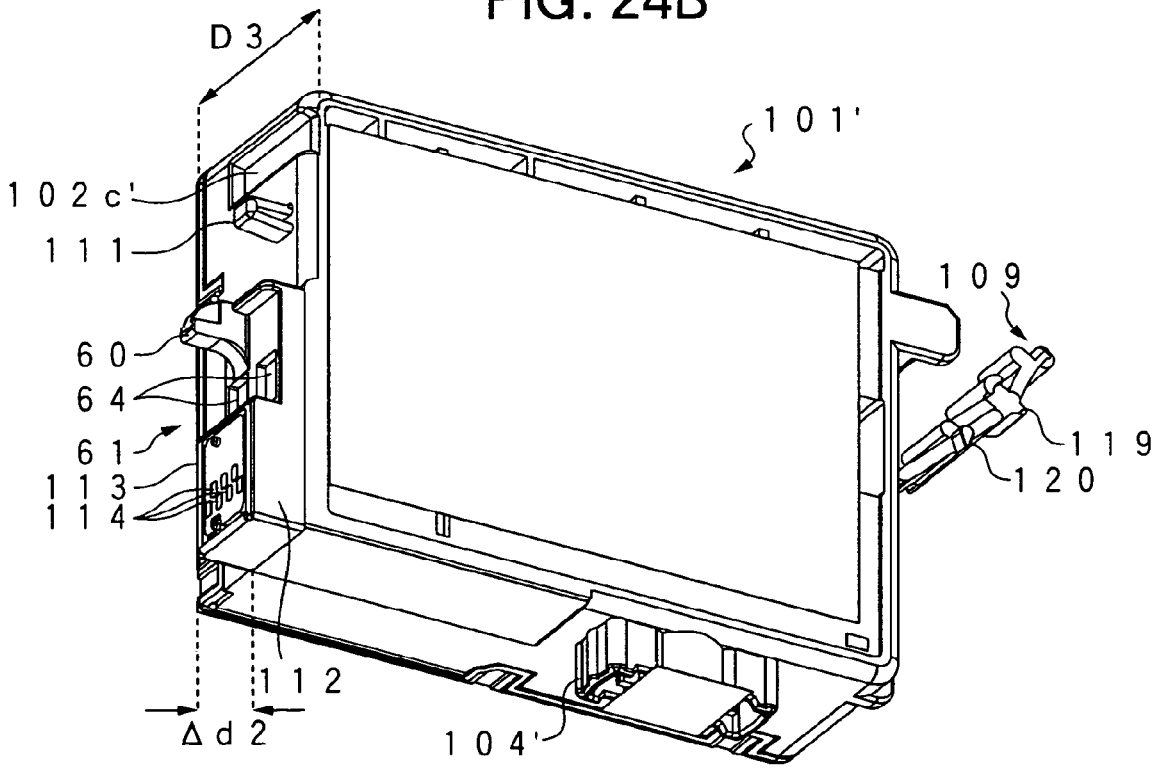
Figure 25A:
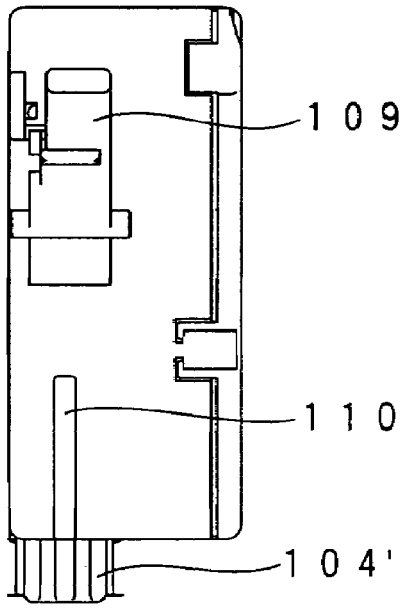
FIGS. 25A, 25B and 25C are side elevational views and a bottom plan view of the black ink cartridge of the third embodiment.
Figure 25B:
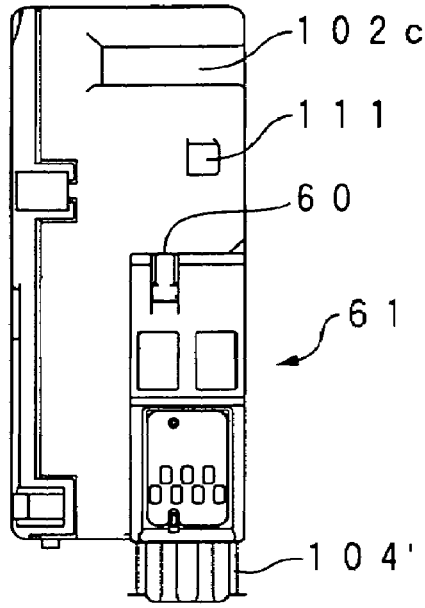
Figure 25C:
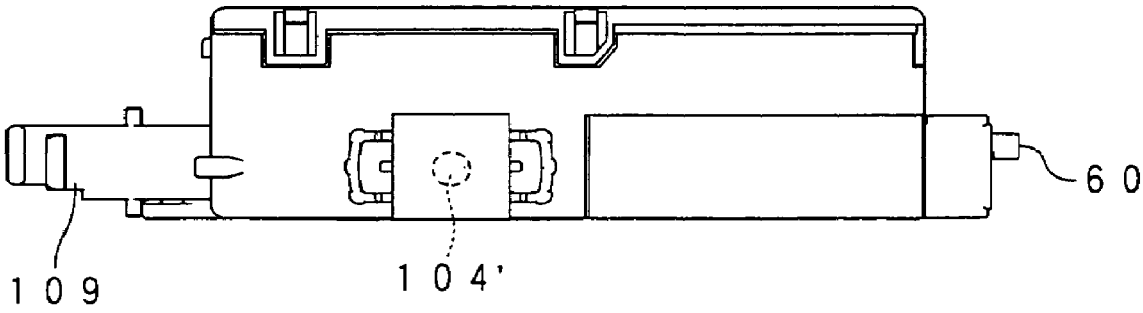
Figure 26A:
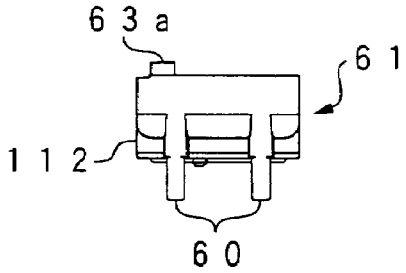
FIGS. 26A, 26B, 26C and 26D are a top plan, front, side and rear elevational views, respectively, of an embodiment of a block to be mounted onto the color ink cartridge depicted in FIGS. 22 and 23.
Figure 26B:
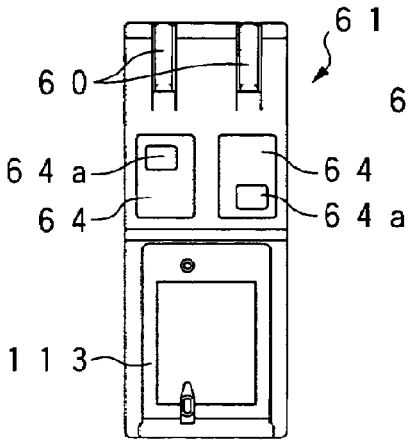
Figure 26C:
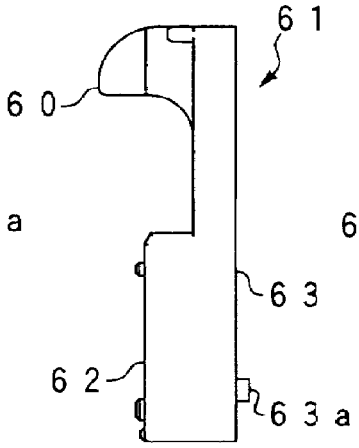
Figure 26D:
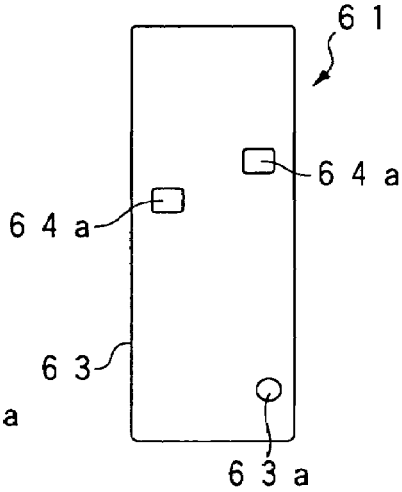
Figure 27A:
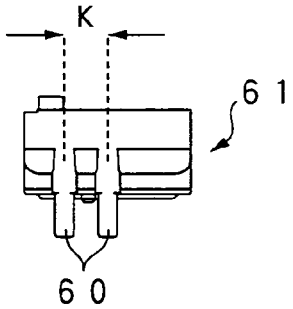
FIGS. 27A, 27B, 27C and 27D are a top plan, front, side and rear elevational views, respectively, of another embodiment of the block to be mounted onto another one of the color ink cartridge.
Figure 27B:
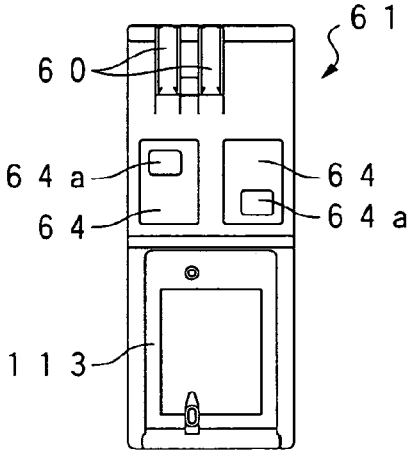
Figure 27C:
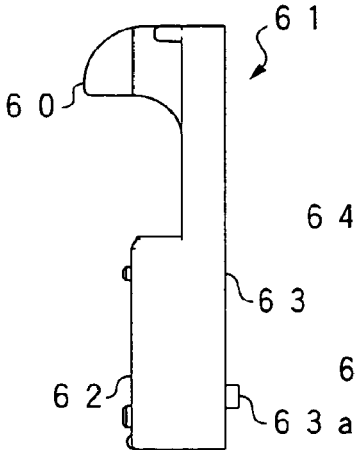
Figure 27D:
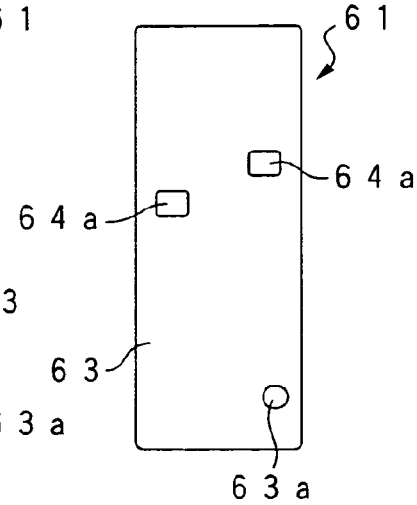
Figure 28A:
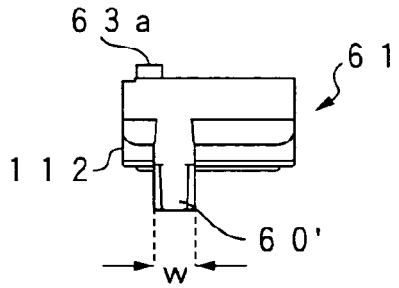
FIGS. 28A, 28B, 28C and 28D are a top plan, front, side and rear elevational views, respectively, showing an embodiment of a block to be mounted onto the black ink cartridge of the third embodiment.
Figure 28B:
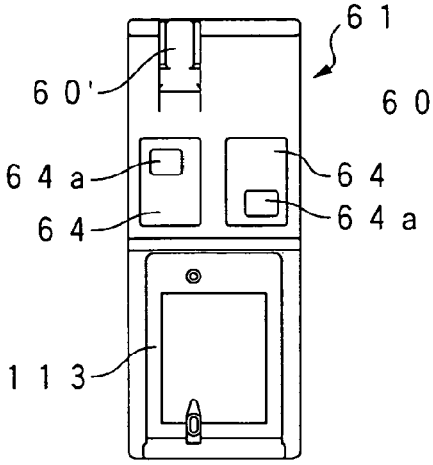
Figure 28C:
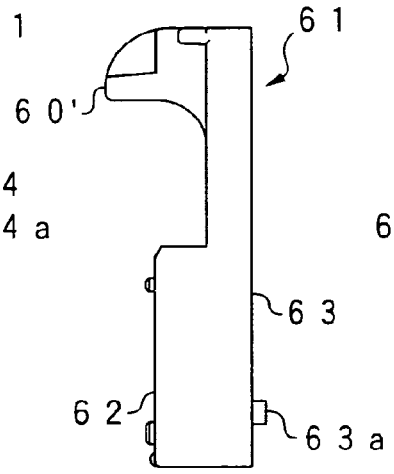
Figure 28D:
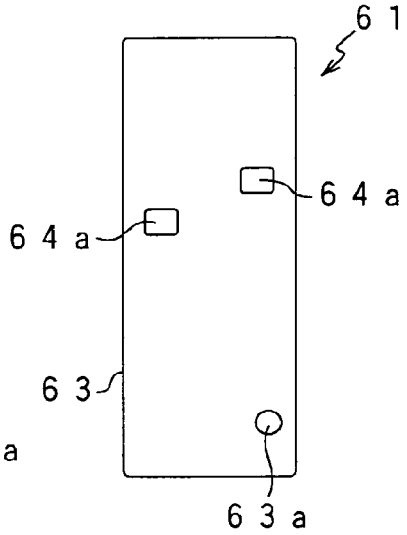

According to this embodiment, the projecting portion 112 can extend to the upper portion as shown in FIG. 21B so as to increase the size of the surface 113 where the electrodes 114, etc. are formed, and arrange the electrodes 114 with greater space. This can eliminate short-circuits that might be caused by the presence of ink or the like, and can provide a reliable contact with the elastic contact members 140 of the recording apparatus.

Features of the aforementioned ink cartridges according to the first and second embodiments will be discussed in more detail.

Figure 3C:
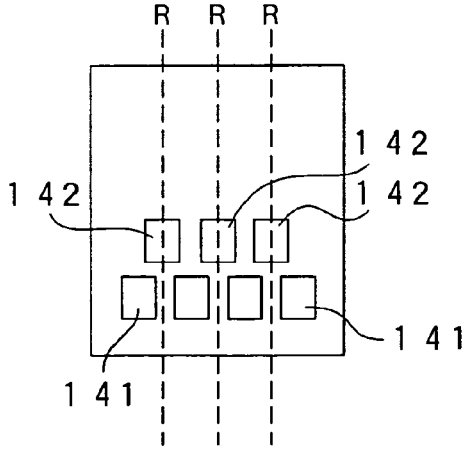
FIG. 3C is a schematic view showing the locations of contacts which are to be contacted with the electrodes.

With continued reference to FIGS. 14A-B, the ink cartridge 1, 101 is constructed such that the side surface 8, 108, which is to be substantially parallel to the arraying direction when the ink cartridge 1, 101 is mounted on the cartridge holder, is elongated vertically in the cartridge mounting direction. The color ink cartridge according to each of the first and second embodiments is dimensioned so that the height H1 is about five times as large as the cartridge width (thickness) D1. By this structure, the width of the cartridge holder for mounting a plurality of ink cartridges can be made small in the cartridge arraying direction as shown in FIGS. 6 and 16. Again, other proportions also could be used Further, the circuit board 15, 115 is disposed on the vertically elongated side surface 8, 108 at a location as close to the bottom surface 3, 103 as possible, and the electrodes 14, 114 of the circuit board 15, 115 are disposed on the surface of the circuit board 15, 115 at a location (a lower portion side) close to the bottom surface 3, 103 in an offset fashion. The electrodes 14, 114 are further arranged at this location to be close to each other. In each of the first and second embodiments, the plural electrodes 14, 114 (the second electrodes 14, 114 in each of the first and second embodiments) are disposed concentrically and in a staggered manner such that the lower row of the electrodes 14, 114 at the bottom surface is longer in length than the upper row of the electrodes 14, 114. Since the plural electrodes 14, 114 are disposed in a staggered manner, when the elastic contacts 41, 140 of the recording apparatus abut against the electrodes 14, 114, the elastic contacts 41, 140 to be contacted with the upper side electrodes 142 (the electrodes 41, 140 of the upper row being referred to as the electrodes 142) pass through clearances or gaps between the lower side electrodes 141 (the electrodes 41, 140 of the lower row being referred to as the electrodes 141) as shown by loci R in FIG. 3C. That is, even when the elastic contacts 41, 140 of the recording apparatus are moved along the circuit board 15, 115 while contacting the circuit board 15, 115 until the proper electric connection is established, the elastic contacts 41, 140 for contact with the electrodes 142 can be prevented from contacting the electrodes 141 during the movement of the elastic contacts 41, 140. Accordingly, it is possible to eliminate the damage of the data stored in the memory device 18, which may be otherwise caused by an improper contact of the elastic contact 41, 140 with the electrode 41, 140. Further, each of the electrodes 14, 114 is designed to have an elongated shape longer in the cartridge insertion direction in order to prevent short circuit between the adjacent electrodes 14, 114 and to establish reliable electric communication.

In each of the first and second embodiments, a large number of electrodes 14, 114 are efficiently disposed to be close to each other on the side surface 8, 108 having the narrow cartridge width (thickness) D1, and the circuit board 15, 115 is to be positioned at the deepest location side of the cartridge holder where shifting of the ink cartridge in the cartridge insertion direction is reduced. Accordingly, the electrodes 14, 114 can be precisely positioned. In this arrangement, since the bottom surface of the cartridge is located at the deepest location side and the ink supply port 4, 104 is disposed on the bottom surface, it is preferable to dispose the electrodes 14, 114 on one of the side surfaces in order to prevent ink from adhering thereto from the ink supply port 4, 104. More preferably, the electrodes 14, 114 are disposed on the side surface 8, 108 away from the ink supply port 4, 104, not on the side surface 7, 107 closer to the ink supply port 4, 104 in view of eliminating the ink adhering problem.

The side walls 12*b*, 12*c*, 112*a*, 112*b* of the projecting portion 12, 112 are respectively located as close to the cartridge widthwise left and right ends of the circuit board 15, 115 as possible, and preferably are located close to the ends of the electrode row. By this arrangement, the electrodes 14, 114 can be precisely positioned against the elastic contacts 41, 140 of the cartridge holder 30, 130.

In the second embodiment, the projecting portion 111 serving as the lever receptacle portion is disposed at least above the projecting portion 112 (at the rear side of the projecting portion 112 in the cartridge insertion direction) on which the electrodes 114 are disposed, so as to precisely position the electrodes 14 without applying a rotational force to the electrodes 114. The projecting portion 111 is preferably located within the width of the electrode row, and more preferably located on the center of the electrode row and symmetrically with respect to the center of the electrode row.

The projecting portion 111 serving as the lever receptacle portion is dimensioned such that the projecting height h1 from the side surface of the cartridge is smaller than the projecting height h2 of the projecting portion 112, as can be seen in FIG. 14B. This arrangement makes it possible to design a portion of the cartridge holder in the vicinity of the projecting portion to be closer to the cartridge, to thereby prevent size increase of the cartridge holder. Further, the rigidity of the projecting portion 111 can be increased to insure that the projecting portion 111 is not unduly deformed when the ink cartridge is positioned by the lever of the cartridge holder. Moreover, the projecting portion 111 is formed integral with the case main body, thereby increasing its rigidity and enabling the formation of the projecting portion 111 with high positional accuracy. This arrangement also contributes to the secure connection between the electrodes and the elastic contacts.

At least the surface of the projecting portion 111 to be contacted with the lever is formed to extend in the direction perpendicular to the surface on which the electrodes 114 are formed. By this arrangement, the cartridge pressing direction of the lever can be set parallel to the surface on which the electrodes 114 are formed, so that the secure connection between the electrodes 114 and the elastic contacts 140 can be realized. In the cartridge according to the second embodiment, the surface of the projecting portion 111 to be contacted with the lever is set substantially parallel to the bottom surface or substantially perpendicular to the surface on which the projecting portion 111 is formed, and the surface on which the electrodes 114 are formed is set substantially perpendicular to the bottom surface or substantially parallel to the side surface on which the projecting portion 111 is formed.

Figure 6A:
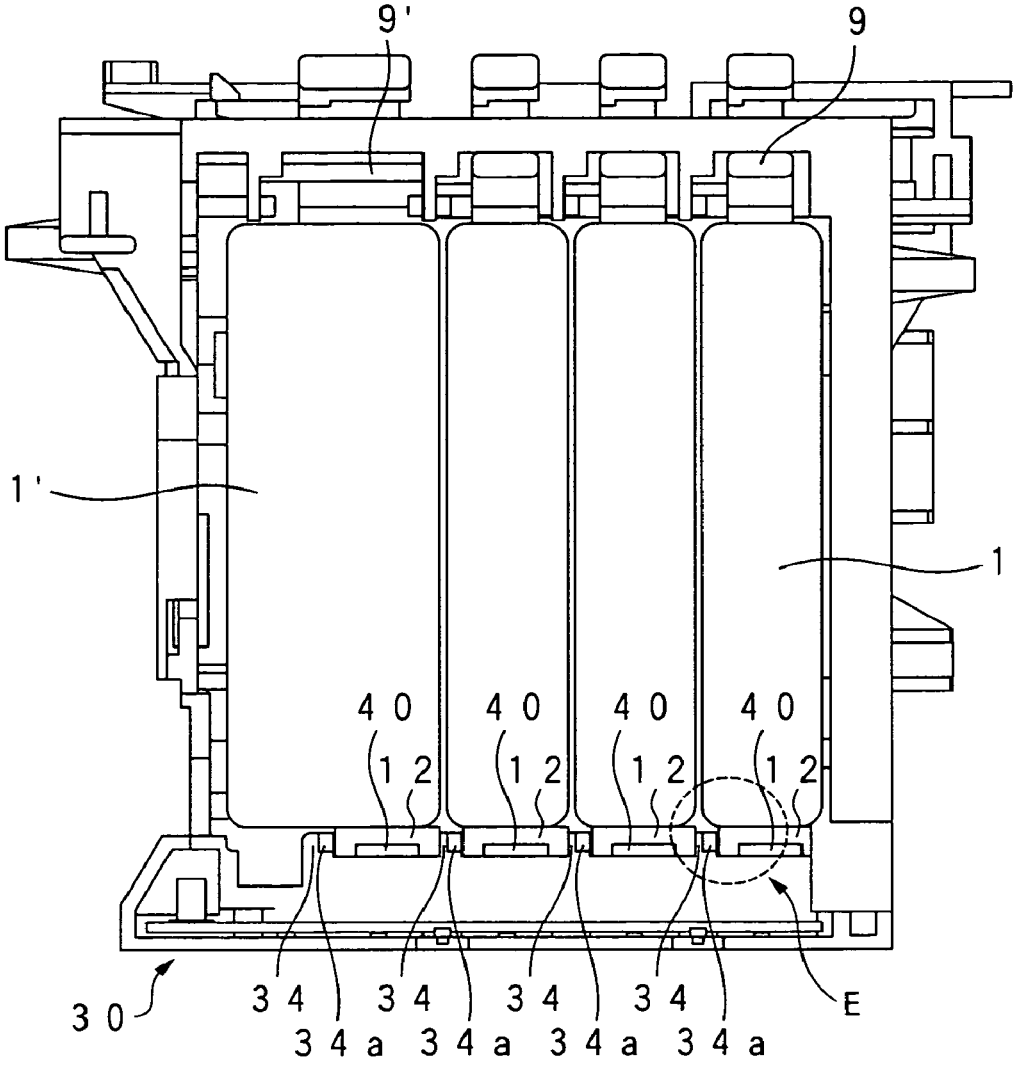
FIG. 6A is a top plan view showing the state in which the ink cartridge of FIGS. 1A and 1B is mounted on the carriage.
Figure 6B:
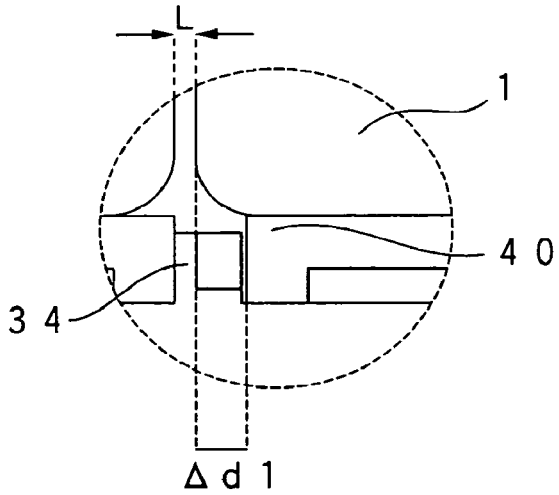
FIG. 6B is an enlarged view showing the proximity of a projecting portion defining a circuit board fixing surface.

In each of the first and second embodiments, the width D2 of the projecting portion 12, 112 is smaller than the width D1 of the cartridge main body, and a space Δd1 (see FIGS. 6B and 14B) between the projecting portion 12, 112 and the side surface of the cartridge is used as a region for inserting therein a rib 34, 134, formed in the cartridge holder 30, 130, for positioning the electrodes 14, 114 of the cartridge as shown in FIGS. 6A and 16. This makes it possible to form a member for precisely positioning the electrodes 14, 114 to the cartridge holder 30, 130 without unnecessarily increasing a distance L between the adjacent ink cartridges, as shown in FIG. 6B.

Preferably, the projecting portion 112 is offset to one side in the widthwise direction of the cartridge 1, 101. This makes is possible to set one side surface 12*c*, 112*b* of the projecting portion 12, 112 substantially flush with the side wall of the cartridge main body, and therefore the side wall facing the adjacent ink cartridge can be also used to position the ink cartridge. Further, by this arrangement, in case of the ink cartridge constructed by the container main body 2*a*, 102*a* and the lid 2*b*, 102*b* joined together according to the first and second embodiments of the present invention, a fixing portion for fixing the projecting portion 12, 112 can be formed on the container main body 2*a*, 102*a*, and therefore the projecting portion 12, 112 can be jointed to or fixed to the container main body 2*a*, 102*a* with high precision.

In the second embodiment, preferably, the location of the projecting portion 111 is substantially the same level in the cartridge insertion direction as the location of the claw portion 119 of the lever 109 formed on the side wall opposite from the side wall on which the projecting portion 111 is formed. By this arrangement, the ink cartridge is not subjected to unnecessary force in the rotational direction or the like, especially the ink supply port 104, and so this avoids damaging the ink supply needle of the cartridge holder.

FIGS. 22A, 22B, 23A and 23B show a third embodiment of a color ink cartridge according to the present invention, which adopts generally the same structure as that of the ink cartridge discussed in the second embodiment with reference to FIG. 14. A feature of the third embodiment is an identification piece 60 provided to prevent erroneous mounting of the ink cartridge.

The erroneous mounting preventive identification piece 60 prevents erroneous insertion in cooperation with a groove formed in an ink cartridge insertion opening side of the carriage. Were a user to attempt to mount the incorrect ink cartridge, the identification piece(s) 60 could not enter the groove(s), and thereby would prevent the ink supply port of the ink cartridge from moving to a position engaging the ink supply needle. Also, the electrodes 114 could not establish contact with the elastic contact members 140.

These identification pieces 60 preferably extend beyond the surface 113 on which the electrical contacts are disposed. This way, if the ink cartridge 101 is placed against another surface, the identification pieces 60 prevent that other surface from striking the electrical contacts, and so by projecting beyond the plane of the electrical contacts the identification pieces help to prevent objects from striking and damaging the electrical contacts.

Another benefit to having one or more identification pieces 60 is that they can be arranged to lie in planes approximately parallel to the sides of the projection 112 of the ink cartridge 101 (these are the sides parallel to the large sides of the ink container), and so they also can help to secure the ink cartridge 101 in a desired position and prevent sideways shifting thereof. This effect is remarkable when plural identification pieces 60 are provided.

FIGS. 24A-B and 25A-C show another embodiment of the ink cartridge of the invention. Similarly to the black ink cartridge 1' discussed with reference to the first embodiment, the container body 102*a*' of this black ink cartridge 101' differs in depth (thickness) d3 and thereby capacity from that of the aforesaid ink cartridge 101, but the other strictures such as the lid body 102*b* of the ink cartridge 101' have the same configuration as those of the aforesaid ink cartridge 101. Taking this difference in ink cartridge width into account, the projecting portion 112 is formed at a position offset in the direction of width to one side of a container body 102*a*' by Δd2. The widthwise center of the electrode group 114 is suitably disposed so as to be positioned on a line C' that is parallel to a central axis C of an ink supply port 104' as in the aforesaid ink cartridge 101.

Since the shape of the container body used in the black ink cartridge 101' differs from the shape of the container body used in the color ink cartridge 101, it is not essential to use the identification piece 60 for preventing erroneous insertion of the black ink cartridge 101' and so this structure can be omitted. However, it is preferable to retain the identification piece(s) 60 on the black ink cartridge 101' because the identification piece(s) serves as a guide member operating in a manner similar to the projecting portion 110, and so does not just have an identification function.

Further, in order to realize high quality printing, it is possible to use two kinds of black inks, dark black ink and light black ink. In this case, the identification piece(s) 60 can be used as a member that identifies whether the ink in the cartridge is dark or light black ink.

In this embodiment, the erroneous mounting preventive identification piece(s) 60 and the projecting portion 112 having the surface 113 onto which the aforementioned circuit board 115 is fixed are formed as an integral block 61. The block 61 preferably is a separate member discrete from the ink cartridge (101) components, i.e. the container main body 102*a*, the lid member 103, the ink supply port 104, the lever 109 and the projecting portion 111. The block 61 is mounted onto the ink cartridge below the projecting portion 111 that is pressed by the cartridge holding mounting lever 132.

Since the projecting portion 112 for fixing the circuit board 115 and the identification piece 60 are formed as a block 61 which is a discrete member from the ink cartridge in this fashion, an ink cartridge corresponding to an ink color can be constructed by simply mounting, onto the container main body 102*a*, a suitable block 61 selected from an existing collection of different blocks 61 prepared to correspond to the different ink colors even when the ink cartridge components, such as the container main body 102*a*, the lid member 103, the ink supply port 104, the lever 109 and the projecting portion 111, are formed with standardized shapes by injection molding using the same molding dies.

The projecting portion 112 on which the circuit board 115 is fixed is formed on the block 61 which is the discrete member. Therefore, the block 61, which is easily held in comparison to the container main body constructing the ink cartridge, can be set on an automated assembly device, and the circuit board 115 can be attached to the block 61 in an automated fashion.

Further, it is possible to check ink color information and so on to be written into the memory element of the circuit board, while confirming the erroneous insertion preventive identification piece, thereby eliminating non-conformity between the identification piece and the data of the memory element.

FIGS. 26A-D show an embodiment of the block 61 for the aforementioned color ink cartridge. One end of the block 61 is formed with the identification pieces 60 at predetermined positions, i.e. positions corresponding to grooves formed in the carriage to designate a particular ink color. The other end of the block 61 is formed with a projecting portion 62 defining the surface onto which the circuit board 15 is to be fixed.

Figure 29A:
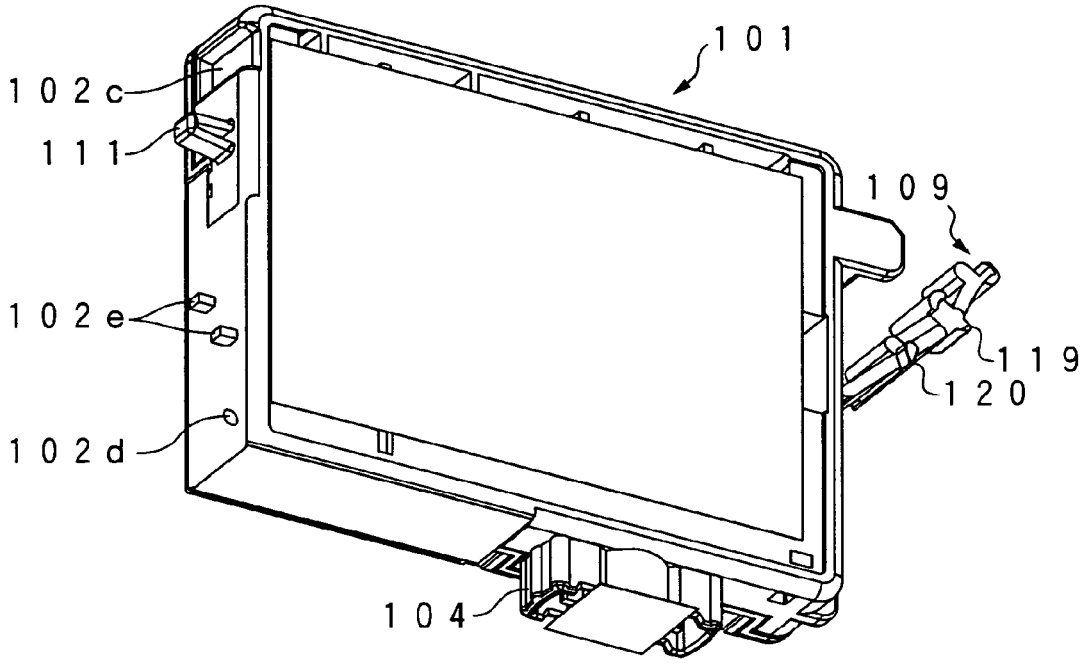
FIGS. 29A and 29B are perspective views showing an embodiment of a fixing system formed in each of the color ink cartridge and the black ink cartridge to fix the block thereon.
Figure 29B:
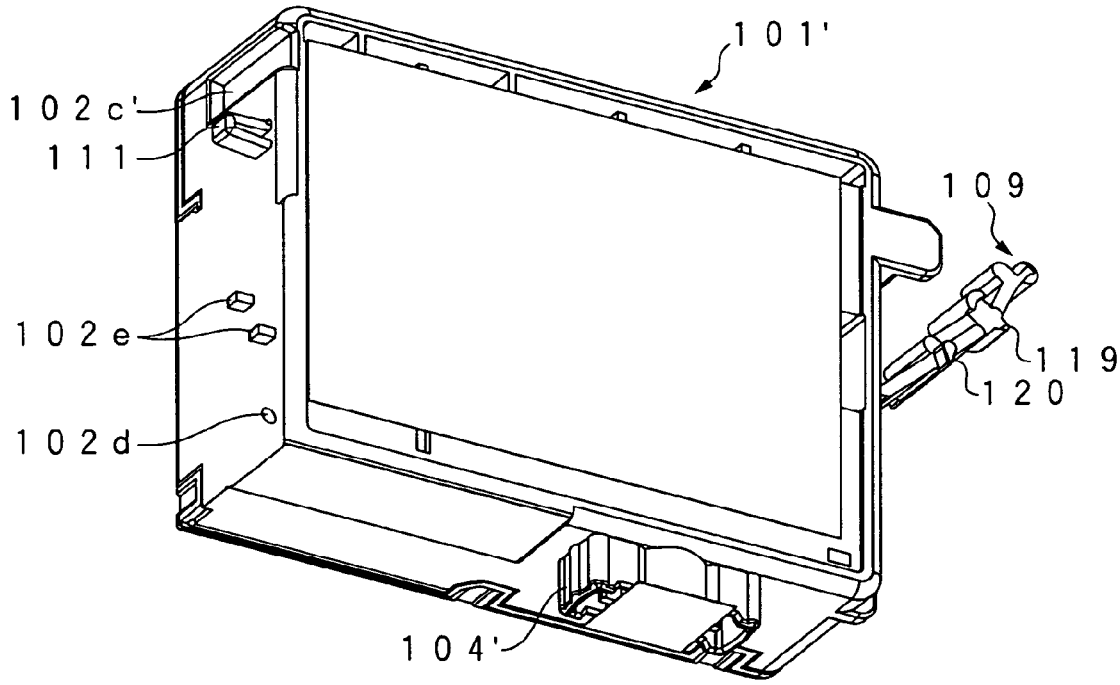

A rear surface 63 of the block 61 is formed with a positioning protrusion 63*a* which is to be inserted into a corresponding positioning recess formed at a predetermined position in the container main body 102*a*. Recessed portions 64 are formed in a front surface of the block 61, which are respectively provided with engagement holes 64*a* through which protrusions 102*e* (shown in FIGS. 29A and 29B) of the container main body 102*a* can pass.

With this arrangement, the block 61 is fixed in place by inserting the positioning protrusion 63*a* into the positioning recess 102*d* (FIGS. 29A and 29B) formed in the container main body 102*a* and by thermally bonding the protrusions 102*e* of the container main body 102 protruding through the through-holes 64*a*. In addition, the same effect can be obtained even if the joining of the block is carried out using an adhesive, or by press-fitting of the protruded and recessed portions.

To designate the color of ink in a cartridge, the number of the identification pieces 60 may be changed color-by-color. Alternatively, as shown in FIGS. 27A-D, a distance between the two identification pieces 60 may be changed color-by-color, so that each color ink has a particular arrangement of the identification pieces, even through the number of the identification pieces 60 is the same.

As shown in FIGS. 28A-D, the block 61 for the black ink cartridge differs in the number of the identification pieces 60 formed on the one end thereof, and because the identification piece 60 has a greater width w than the identification piece 60 shown in FIGS. 27A-D. Other structures are constructed similarly to those of the color ink cartridge, that is, the projecting portion 62 forming the surface 113 onto which the circuit board 115 is fixed, the protrusion 63*a* formed on the rear surface 63 and the through-holes 64*a* into which the protrusions 102*e* of the container main body 102*a* are fitted.

The number of ink cartridges that can be identified can be increased by changing the width of the identification piece 60 per se, changing the number of the identification pieces disposed thereon, and changing the distance between mutually adjacent identification pieces 60 to correspond to the different kinds of inks.

In the aforementioned embodiment, the block is constructed while taking into account the fixing of the circuit board thereon. In case of an ink cartridge that does not require the circuit board, the block can be constructed to only have the identification piece(s). It is clear that this construction also provides the same benefits.

Although the present invention has been described and illustrated in detail, it is clearly understood that the same is by way of illustration and example only and is not to be taken by way of limitation, the spirit and scope of the present invention being defined only by the terms of the accompanying claims.

What is claimed is:

1. An ink cartridge for an ink jet recording apparatus, the ink cartridge comprising:

an ink supply port disposed at a position offset toward a first side of the ink cartridge;

a projection having a surface; and a plurality of electrodes formed on the surface, wherein:

the surface is disposed at a second side of the ink cartridge opposite from the first side; and at least a portion of the surface lies in a plane that is parallel to an axial direction of the ink supply port.

2. The ink cartridge according to claim 1, further comprising a pressed surface lying in a plane that is parallel to a bottom of the ink cartridge, wherein the pressed surface is positioned so that a structure of the ink jet recording apparatus contacts the pressed surface and presses the pressed surface toward the bottom when the ink cartridge is mounted in the ink jet recording apparatus.

3. A combination of an ink jet recording apparatus and an ink cartridge, the ink jet recording apparatus comprising:

a cartridge holder having a bottom portion, a first wall surface extending from the bottom portion, a second wall surface extending from the bottom portion and opposing the first wall surface, an ink cartridge storage region defined by the bottom, the first wall surface and the second wall surface;

an ink supply needle protruded from the bottom, and disposed at a position offset toward the first wall surface in the ink cartridge storage portion; and a plurality of elastic contacts disposed on the second wall surface, and the ink cartridge comprising:

an ink supply port that engages the ink supply needle when the ink cartridge is mounted in the ink cartridge storage portion at a predetermined position; and a plurality of electrodes that are electrically connected to the elastic contacts when the ink cartridge is mounted in the ink cartridge storage portion at the predetermined position.

4. An ink cartridge mountable to an ink jet recording apparatus including a cartridge holder having a bottom portion, a first wall surface extending from the bottom portion, a second wall surface extending from the bottom portion and opposing the first wall surface, an ink cartridge storage region defined by the bottom, the first wall surface and the second wall surface; an ink supply needle protruded from the bottom, and disposed at a position offset toward the first wall surface in the ink cartridge storage portion; and a plurality of elastic contacts disposed on the second wall surface, the ink cartridge comprising:

an ink supply port that engages the ink supply needle when the ink cartridge is mounted in the ink cartridge storage portion at a predetermined position; and a plurality of electrodes that are electrically connected to the elastic contacts when the ink cartridge is mounted in the ink cartridge storage portion at the predetermined position.

5. An ink cartridge, to be mounted on a recording apparatus, the ink cartridge comprising:

a front, a back, a top and a bottom;

an ink supply port formed in the bottom and disposed closer to the front than the to the back, the ink supply port having an axis;

a first projection disposed on the back closer to the bottom than to the top, the projection having a surface lying in a plane that is parallel to the axis, the projection extending away from the front;

a memory unit disposed on the ink cartridge; and a plurality of electrodes disposed on the surface, wherein at least some of said electrodes are in electrical communication with the memory unit.

6. The ink cartridge according to claim 5, in which the first projection has a plurality of side portions for being restricted in position when the ink cartridge is mounted on the recording apparatus.

7. The ink cartridge according to any of claims 5 or 6, in which a width of the first projection is narrower than a width of the ink cartridge.

8. The ink cartridge according to any of claims 5 or 6, further comprising an elastic sealing member, housed in the ink supply port, for engaging an ink supply member of the recording apparatus when the ink cartridge is mounted on the recording apparatus.

9. The ink cartridge according to any of claims 5 or 6, in which the electrodes are arranged in at least one row, and the row is perpendicular to said axis of the ink supply port.

10. The ink cartridge according to any of claims 5 or 6, in which the electrodes and the memory unit are disposed on a circuit board mounted on said surface of the first projection, the surface being parallel to an insertion direction of the ink cartridge into the recording apparatus, and the electrodes are formed on an exposed surface side of the circuit board.

11. The ink cartridge according to claim 10, in which the electrodes are disposed on the circuit board at an offset position closer to the bottom than to the top.

12. The ink cartridge according to any of the claims 5 or 6, in which each of the electrodes has a vertically elongated shape so that a length of each of the electrodes in a vertical direction is longer than a length of each of the electrodes in a lateral direction perpendicular to the vertical direction.

13. The ink cartridge according to any of claims 5 or 6, further comprising a pressed surface lying in a plane that is parallel to the bottom, wherein the pressed surface is positioned so that a structure of the recording apparatus contacts the pressed surface and presses the pressed surface toward the bottom when the ink cartridge is mounted in the recording apparatus.

14. The ink cartridge according to claim 13, wherein the pressed surface is located on the first projection.

15. The ink cartridge according to claim 14, wherein the pressed surface is an upper surface of the first projection, and wherein, when the ink cartridge is mounted on the recording apparatus, said upper surface is pressed toward the bottom by a position restricting elastic piece which is part of a pressing member of the recording apparatus.

16. The ink cartridge according to claim 13, further comprising a protuberance extending from the back, the protuberance being located closer to the top than to the first projection, wherein the pressed surface is located on the protuberance.

17. The ink cartridge according to claim 16, in which the protuberance is dimensioned and disposed so as to be pressed toward the bottom by a cartridge holding mounting lever which is part of the recording apparatus.

18. The ink cartridge according to claim 17, in which the protuberance is located within a region defined by and between the outermost electrodes in a direction that is perpendicular to an insertion direction of the ink cartridge into the recording apparatus and that is parallel to the back.

19. The ink cartridge according to claim 16, wherein a height of the protuberance from the back is smaller than a height of the first projection from the back.

20. The ink cartridge according to claim 16, wherein said pressed surface of the protuberance at least partially extends perpendicular to said surface on which the electrodes are formed.

21. The ink cartridge according to claim 16, wherein the protuberance is integral with the first projection on which the electrodes are disposed.

22. The ink cartridge according to claim 16, further comprising an identification protrusion extending outward from the back at a position located between the top and the first projection, and wherein said identification protrusion is disposed between the first projection and the protuberance.

23. The ink cartridge according to claim 6, further comprising at least one of a second projection, a ridge and a groove formed on one of the side portions of the first projection.

24. The ink cartridge according to claim 6, further comprising a first one of a second projection, a ridge and a groove formed on a first side portion, and a second one of a second projection, a ridge and a groove formed on a second side portion of the first projection.

25. The ink cartridge according to claim 6, wherein the side portions of the first projection, respectively define side surfaces parallel to an insertion direction of the ink cartridge into the recording apparatus.

26. The ink cartridge according to claims 5 or 6, further comprising an identification protrusion extending outward from the back at a position located between the top and the first projection.

27. The ink cartridge according to claim 26, wherein the identification protrusion extends outward past the plane in which the surface lies.

28. The ink cartridge according to claim 26, wherein at least one of a shape, a width and a length of the identification protrusion corresponds to a property of an ink carried in the ink container.

29. The ink cartridge according to claim 26, in which the identification protrusion is a block fixed to the ink cartridge by a fixing member.

30. The ink cartridge according to claim 29, in which the identification protrusion and the first projection are a unitary block fixed to the ink container by a fixing member.

31. The ink cartridge according to claim 26, wherein a distal end of the identification protrusion protrudes outward beyond said surface on which the electrodes are formed.

32. The ink cartridge according to claim 26, having a plurality of the identification protrusions.

33. The ink cartridge according to claims 5 or 6, in which the retaining member is disposed on the front.

34. An ink cartridge detachably mountable on a recording apparatus having an ink supply needle, comprising:

an upper wall, a bottom wall, a first side wall intersecting the bottom wall and a second side wall intersecting the bottom wall and facing the first side wall;

an ink supply port disposed on the bottom wall at an offset position closer to the first side wall than to the second side wall; and a circuit board disposing portion provided at a lower location on the second side wall, said circuit board disposing portion provided with a circuit board with a memory unit and a plurality of electrodes thereon, and further comprising opposite two sides for regulating a horizontal position of the ink cartridge with respect to the recording apparatus; wherein the plurality of electrodes are in electrical communication with the memory unit of the circuit board.

35. The ink cartridge according to claim 34, further comprising a guide projecting portion provided at a lower location on the first side wall and adapted for regulating a horizontal position of the ink cartridge with respect to the recording apparatus.

36. The ink cartridge according to claim 35, wherein the regulation of the horizontal position of the ink cartridge by the guide projecting portion is realized in a manner that the guide projection portion is limited in the horizontal direction by a corresponding portion which is located on the recording apparatus at a position corresponding to. the lower location on the first side wall of the ink cartridge.

37. The ink cartridge according to claim 34, further comprising a projecting portion provided at an upper location on the second side wall and adapted for regulating a vertical position of the ink cartridge with respect to the recording apparatus.

38. The ink cartridge according to claim 37, wherein the regulation of the vertical position of the ink cartridge by the projecting portion is realized in a manner that the projecting portion is limited in the vertical direction by a corresponding portion which is located on the recording apparatus at a position corresponding to the upper location on the second side wall of the ink cartridge.

39. The ink cartridge according to any of claims 35 to 38, wherein the ink cartridge has a substantially flat upper portion and a substantially flat bottom portion.

40. The ink cartridge according to claim 39, wherein the substantially flat upper portion and the substantially flat bottom portion define the upper wall and the bottom wall, respectively, of the ink cartridge, at least a portion of the upper wall being substantially parallel to the bottom wall.

41. The ink cartridge according to any of claims 35 to 38, wherein the ink cartridge includes a container body having a first side and a second side, the first side being substantially parallel to the second side, and the second side being separated from the first side by the upper portion and the bottom portion.

42. The ink cartridge according to claim 34, wherein the regulation of the horizontal position of the ink cartridge by the circuit board disposing portion is realized in a manner that the two sides of the circuit board disposing portion are limited in the horizontal direction by a corresponding portion which is located on the recording apparatus at a position corresponding to the lower location on the second side wall of the ink cartridge.

43. An ink cartridge detachably mountable on a recording apparatus having an ink supply needle, comprising:

a front, a back, a top, and a bottom;

an ink supply port formed in the bottom and disposed closer to the front than to the back; the ink supply port having an axis, a circuit board having a memory unit and a plurality of electrodes;

a circuit board disposing portion provided at a lower location on the back and having two opposite sides for regulating a position of the ink cartridge with respect to the recording apparatus.

44. The ink cartridge according to claim 43, in which the opposite sides are adapted to be restricted by ribs provided in the recording apparatus in such a position that the electrodes are brought into electrical communication with contacts provided in the recording apparatus when the ink cartridge is mounted on the recording apparatus.

45. The ink cartridge according to claim 43, in which a width of the circuit board disposing portion is narrower than a width of the ink cartridge.

46. The ink cartridge according to claim 43, further comprising an elastic sealing member, housed in the ink supply port, for engaging the needle of the recording apparatus when the ink cartridge is mounted on the recording apparatus.

47. The ink cartridge according to claim 43, in which the electrodes are arranged in at least one row that is perpendicular to the axis of the ink supply port.

48. The ink cartridge according to claim 43, in which the circuit board is mounted on a surface of the circuit board disposing portion that is parallel to an insertion direction of the ink cartridge into the recording apparatus, and the electrodes are formed on an exposed surface side of the circuit board.

49. The ink cartridge according to claim 48, in which the electrodes are disposed on the circuit board at an offset position closer to the bottom than to the top.

50. The ink cartridge according to claim 43, wherein each of the electrodes has a vertically elongated shape so that a length of each of the electrodes in a vertical direction is longer than a length of each of the electrodes in a lateral direction perpendicular to the vertical direction.

51. The ink cartridge according to claim 43, further comprising a pressed surface lying in a plane that is parallel to the bottom, wherein the pressed surface is positioned so that a structure of the recording apparatus contacts the pressed surface and presses the pressed surface toward the bottom when the ink cartridge is mounted in the recording apparatus.

52. The ink cartridge according to claim 51, further comprising a protuberance extending from the back, the protuberance being located closer to the top than is the circuit board disposing portion, wherein the pressed surface is located on the protuberance.

53. The ink cartridge according to claim 52, in which the protuberance is dimensioned and disposed so as to be pressed toward the bottom by a cartridge holding mounting lever which is part of the recording apparatus.

54. The ink cartridge according to claim 53, in which the protuberance is located within a region defined by and between the outermost electrodes in a direction that is perpendicular to an insertion direction of the ink cartridge into the recording apparatus and that is parallel to the back.

55. The ink cartridge according to claim 54, wherein the side portions of the circuit board disposing portion respectively define side surfaces parallel to an insertion direction of the ink cartridge into the recording apparatus.

56. The ink cartridge according to claim 52, wherein a height of the protuberance from the back is smaller than a height of the circuit board disposing portion from the back.

57. The ink cartridge according to claim 52, wherein said pressed surface of the protuberance at least partially extends perpendicular to a surface on which the electrodes are formed.

58. The ink cartridge according to claim 52, wherein the protuberance is integral with the circuit board disposing portion on which the electrodes are disposed.

59. The ink cartridge according claim 43, further comprising an identification protrusion extending outward from the back at a position located between the top and the circuit board disposing portion.

60. The ink cartridge according to claim 59, wherein the identification protrusion extends outward past the plane in which the surface lies.

61. The ink cartridge according to claim 59, wherein at least one of a shape, a width and a length of the identification protrusion corresponds to a property of an ink carried in the ink cartridge.

62. The ink cartridge according to claim 59, further comprising a protuberance extending from the back, the protuberance being located closer to the top than is the circuit board disposing portion, wherein the pressed surface is located on the protuberance, and wherein said identification protrusion is disposed between the circuit board disposing portion and a protuberance.

63. The ink cartridge according to claim 59, wherein a distal end of the identification protrusion protrudes outward beyond said surface on which the electrodes are formed.

64. The ink cartridge according to claim 59, having a plurality of the identification protrusions.

* * * * *